US006685054B2

(12) United States Patent
Kameyama

(10) Patent No.: US 6,685,054 B2
(45) Date of Patent: Feb. 3, 2004

(54) APPARATUS AND METHOD FOR DELIVERING LIQUIDS

(75) Inventor: Bunichiro Kameyama, Saitama-ken (JP)

(73) Assignee: Sanyo Electric Co., Ltd., Osaka-Fu (JP)

( * ) Notice: Subject to any disclaimer, the term of this patent is extended or adjusted under 35 U.S.C. 154(b) by 185 days.

(21) Appl. No.: 09/924,545

(22) Filed: Aug. 9, 2001

(65) Prior Publication Data

US 2002/0060226 A1 May 23, 2002

Related U.S. Application Data

(63) Continuation-in-part of application No. 09/718,501, filed on Nov. 24, 2000.

(30) Foreign Application Priority Data

Aug. 9, 2000 (JP) ..... 2000-241471
Oct. 6, 2000 (JP) ..... 2000-307915

(51) Int. Cl.[7] ..... B67D 5/16

(52) U.S. Cl. ..... 222/63; 222/71; 222/129.3; 417/44.1

(58) Field of Search ..... 417/44.1, 410.4; 418/206.5; 137/2, 12.5, 87.02, 87.03; 222/57, 63, 71, 129.1, 129.3, 129.4

(56) References Cited

U.S. PATENT DOCUMENTS 3,121,530 A * 2/1964 Lorenz ..... 418/9
3,721,253 A * 3/1973 Remke ..... 137/3
4,336,213 A * 6/1982 Fox ..... 264/40.1
4,433,701 A * 2/1984 Cox et al. ..... 137/101.19
5,228,594 A * 7/1993 Aslin ..... 222/63
5,388,761 A * 2/1995 Langeman ..... 239/1
6,053,703 A * 4/2000 Kawaguchi et al. ..... 417/44.1

* cited by examiner

*Primary Examiner*—Michael Mar
*Assistant Examiner*—Patrick Buechner
(74) *Attorney, Agent, or Firm*—Sughrue Mion, PLLC

(57) ABSTRACT

A flow regulator is provided in a liquid delivery line. The flow regulator includes flow regulation a body having an inflow port through which liquids different from each other in a property such as density, viscosity, etc flow in the body, and an outflow port through which the liquids flow out from the body. A set of rotators, which are rotated within the body in respective directions opposite to each other is provided to move the liquid by given volumes along the internal wall of the body. And a drive unit for driving the set of rotators is also provided. This construction provides an apparatus which can be used for delivering a liquid, which, in delivering liquids different from each other in viscosity, a given volume of the liquid can be accurately delivered to a liquid delivery line in a continuous manner even though the viscosity of the liquids have varied.

33 Claims, 46 Drawing Sheets

FIG. 12A
| AMOUNT OF BEVERAGE FED (PER SEC) | REDUCTION RATIO |
|---|---|
| 50 cc ~ 80 cc | 3:1 |
| 30 cc ~ 50 cc | 4:1 |
| NOT MORE THAN 30 cc | 5:1 |
FIG. 12B
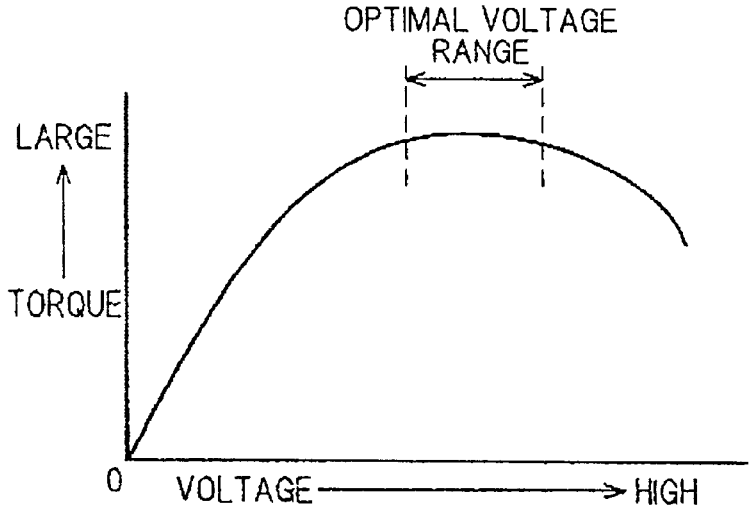
FIG. 12C
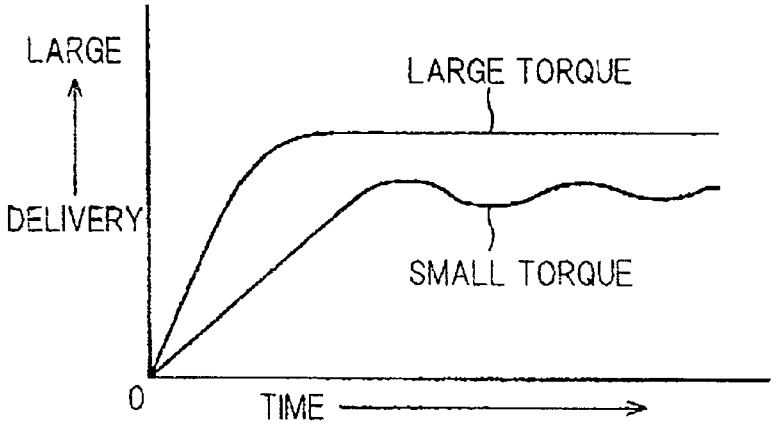

APPARATUS AND METHOD FOR DELIVERING LIQUIDS

This is a Continuation-in-Part of application Ser. No. 09/718,501 (Confirmation No. 2504) filed Nov. 24, 2000.

FIELD OF THE INVENTION

The invention relates to an apparatus and method for delivering liquids different from each other in a property such as density, viscosity, etc.

BACKGROUND OF THE INVENTION

In liquid delivery apparatuses for delivering liquids different from each other in a property such as density, viscosity, etc for example, oils such as edible or lubricating oils, paints, blood, and syrup, for example, the delivery is regulated according to the properties of the liquid to be delivered. Further, the delivery is regulated according to a fluctuation in delivery of the liquid as a result of a change in a property of the liquid due to a change in external environment, such as a change in temperature. These types of regulation work produce, for example, a waste of a lot of money and a waste of a lot of time, because they incur personnel expenses and cause a miss of an opportunity of production or sale due to the necessity of suspending the operation of the liquid delivery apparatus during the regulation.

For example, in the case of beverage dispensers or cup-type vending machines, syrup as a concentrate of a beverage material is diluted with diluting water, such as water or carbonated water, at a predetermined dilution level to prepare a beverage which is then sold. For conventional beverage dispensers or cup-type vending machines, in order to dilute the syrup at a proper dilution level, a flow regulator or a flow meter is provided in a feed line for the syrup and a feed line for the diluting water so that the syrup can be mixed with the diluting water while controlling the flow rate of the syrup and the flow rate of the diluting water.

FIG. 1 is a schematic diagram showing the construction of a beverage feeding apparatus wherein a flow regulator for regulating the flow rate is provided in each of a feed line for syrup and a feed line for diluting water. In FIG. 1, numeral 1 designates a solenoid valve for a water inlet, numeral 2 a water pump, numeral 3 a water cooling coil, numeral 41 a flow regulator for water, numeral 5 a solenoid valve for water, numeral 6 a water feed line, numeral 7 a solenoid valve for water feed to a carbonator, numeral 8 a carbonator, numeral 42 a flow regulator for carbonated water, numeral 10 a carbonated water cooling coil, numeral 11 a solenoid valve for carbonated water, numeral 12 a carbonated water feed line, numeral 13 a carbon dioxide bomb, numeral 14 a syrup tank, numeral 15 a syrup cooling coil, numeral 43 a flow regulator for syrup, numeral 17 a solenoid valve for syrup, numeral 18 a syrup feed line, and numeral 19 a multivalve.

Water enters the water pump 2 through the solenoid valve 1 for a water inlet, and is fed by means of the water pump 2 into the multivalve 19 through the water feed line 6. In this case, upon the delivery from the water pump 2, water is passed through the water cooling coil 3 for cooling water, the flow regulator 41 for regulating the flow rate of water, and the solenoid valve 5 for water, and then enters the multivalve 19. As soon as a preset time has elapsed, a feed control unit (not shown) stops the water pump 2, and, at the same time, closes the solenoid valve 1 for a water inlet and the solenoid valve 5 for water to stop the feed of water.

Further, the water feed line 6 is branched off at a position between the water cooling coil 3 and the flow regulator 41 for water, and is connected to the carbonator 8 through the solenoid valve 7 for water feed to a carbonator. A float switch (not shown) for detecting the level of water is provided within the carbonator 8. As soon as the level of water within the carbonator 8 reaches the lower limit position, the solenoid valve 1 for a water inlet and the solenoid valve 7 for water feed to a carbonator are opened and, in addition, the water pump 2 is operated to feed water into the carbonator 8. As soon as the level of water within the carbonator 8 reaches the upper limit position, the solenoid valve 1 for a water inlet and the solenoid valve 7 for water feed to a carbonator are closed, and, in addition, the operation of the water pump 2 is stopped. Carbon dioxide fed from the carbon dioxide bomb 13 is dissolved in the fed water to prepare carbonated water. The carbonated water is forced out from the carbonator 8 by pressure of the carbon dioxide, and is fed into the multivalve 19 through the carbonated water feed line 12, that is, through the flow regulator 42 for regulating the flow rate of carbonated water, the carbonated water cooling coil 10 for cooling carbonated water, and the solenoid valve 11 for carbonated water. As soon as a preset time has elapsed, the feed control unit closes the solenoid valve 11 for carbonated water to stop the feed of carbonated water.

On the other hand, syrup is forced out from the syrup tank 14 by the pressure of carbon dioxide fed from the carbon dioxide bomb 13, and is then fed into the multivalve 19 through the syrup feed line 18, that is, through the syrup cooling coil 15 for cooling syrup, the flow regulator 43 for regulating the flow rate of syrup, and the solenoid valve 17 for syrup. As soon as a preset time has elapsed, the feed control unit closes the solenoid valve 17 for syrup to stop the feed of syrup. In this connection, it should be noted that the syrup tank 14, the syrup cooling coil 15, the flow regulator 43 for syrup, the solenoid valve 17 for syrup, and the syrup feed line 18 are provided by the number corresponding to the number of types of beverages to be sold.

Within the multivalve 19, the syrup fed from the syrup tank 14 through the syrup feed line 18, that is, through the syrup cooling coil 15, the flow regulator 43 for syrup, and the solenoid valve 17 for syrup is mixed with diluting water such as water or carbonated water fed through the solenoid valve 5 for water or the solenoid valve 11 for carbonated water to prepare a beverage which is then discharged.

FIG. 2 is a schematic diagram showing the construction of a beverage feeding apparatus wherein a flow meter, which has a rotator of paddle, oval or other type rotated in synchronization with the flow rate of syrup or the flow rate of diluting water, detects the speed of rotation of the rotator, and outputs pulses synchronized with the flow rate to permit the output pulses to be input into a feed control unit (not shown) to measure the flow rate of the syrup or the diluting water, is provided in each of a syrup feed line and a diluting water feed line. In FIGS. 1 and 2, like parts have the same reference numerals. In FIG. 2, numeral 1 designates a solenoid valve for a water inlet, numeral 2 a water pump, numeral 3 a water cooling coil, numeral 44 a flow meter for water, numeral 5 a solenoid valve for water, numeral 6 a water feed line, numeral 7 a solenoid valve for water feed to a carbonator, numeral 8 a carbonator, numeral 45 a flow meter for carbonated water, numeral 10 a carbonated water cooling coil, numeral 11 a solenoid valve for carbonated water, numeral 12 a carbonated water feed line, numeral 13 a carbon dioxide bomb, numeral 14 a syrup tank, numeral 15 a syrup cooling coil, numeral 46 a flow meter for syrup, numeral 17 a solenoid valve for syrup, numeral 18 a syrup feed line, and numeral 19 a multivalve.

Water enters the water pump 2 through the solenoid valve 1 for a water inlet, and is fed by means of the water pump 2 into the multivalve 19 through the water feed line 6, that is, through the water cooling coil 3 for cooling water, the flow meter 44 for measuring the flow rate of water, and the solenoid valve 5 for water, As soon as the number of pulses output from the flow meter 44 for water reaches a preset number of pulses, the feed control unit stops the water pump 2 and, at the same time, closes the solenoid valve 1 for a water inlet and the solenoid valve 5 for water to stop the feed of water. Further, the water feed line 6 is branched off at a position between the water cooling coil 3 and the flow meter 44 for water, and is connected to the carbonator 8 through the solenoid valve 7 for water feed to a carbonator. A float switch (not shown) for detecting the level of water is provided within the carbonator 8. As soon as the level of water within the carbonator 8 reaches the lower limit position, the solenoid valve 1 for a water inlet and the solenoid valve 7 for water feed to a carbonator and opened and, in addition, the water pump 2 is operated to feed water into the carbonator 8. As soon as the level of water within the carbonator 8 reaches the upper limit position, the solenoid valve 1 for a water inlet and the solenoid valve 7 for water feed to a carbonator are closed, and, in addition, the operation of the water pump 2 is stopped, Carbon dioxide fed from tile carbon dioxide bomb 13 is dissolved in the fed water to prepare carbonated water. The carbonated water is forced out from the carbonator 8 by pressure of the carbon dioxide, and is fed into the multivalve 19 through the carbonated water feed line 12, that is, through the flow meter 45 for measuring the flow rate of carbonated water, the carbonated water cooling coil 10 for cooling carbonated water, and the solenoid valve 11 for carbonated water. As soon as the number of pulses output from the flow meter 45 for carbonated water reaches a preset number of pulses, the feed control unit closes the solenoid valve 11 for carbonated water to stop the feed of carbonated water.

On the other hand, syrup is forced out from the syrup tank 14 by the pressure of carbon dioxide fed from the carbon dioxide bomb 13, and is then fed into the multivalve 19 through the syrup feed line 18, that is, through the syrup cooling coil 15 for cooling syrup, the flow meter 46 for measuring the flow rate of syrup, and the solenoid valve 17 for syrup. As soon as the number of pulses output from the flow meter 46 for syrup has reached a preset number of pulses, the feed control unit closes the solenoid valve 17 for syrup to stop the feed of syrup. In this connection, it should be noted that the syrup tank 14, the syrup cooling coil 15, the flow meter 46 for syrup, the solenoid valve 17 for syrup, and the syrup feed line 18 are provided by the number corresponding to the number of types of beverages to be sold.

A flow meter, which has a rotator of paddle, oval or other type rotated in synchronization with the flow rate of syrup or the flow rate of diluting water, detects the speed of rotation of the rotator, and outputs pulses synchronized with the flow rate to permit the output pulses to be input into a feed control unit to measure the flow rate of the syrup or the diluting water, is provided in each of the syrup feed line and the diluting water feed line. As soon as the number of pulses output from the flow meter provided in the syrup feed line and the number of pulses output from the flow meter provided in the diluting water feed line reach respective preset numbers of pulses, the feed control unit closes the solenoid valve in the syrup feed line and the solenoid valve in the diluting water feed line to stop the feed of the syrup and the diluting water.

In this case, in the dilution of the syrup with the diluting water, the amount of the diluting water used is larger than the amount of the syrup used, that is, the ratio of diluting water to syrup in the dilution is generally about 3:1 to about 6:1, and, consequently, the feed of the syrup is completed earlier than the feed of the diluting water. Therefore, the dilution level in the first half of the feed of the beverage is different from the dilution level in the latter half of the feed of the beverage, leading to a fear that, in the resultant beverage, the level of dilution of the syrup with the diluting water is heterogeneous. In order to overcome this problem, an attempt has been made to intermittently open and close the solenoid valve 17 for syrup to intermittently feed the syrup, whereby the timing of stopping the feed of the syrup is rendered identical to the timing of stopping the feed of the diluting water such as water or carbonated water.

Within the multivalve 19, the syrup fed from the syrup tank 14 through the syrup feed line 18, that is, through the syrup cooling coil 15, the flow meter 46 for syrup, and the solenoid valve 17 for syrup, is mixed with diluting water such as water or carbonated water fed through the solenoid valve 5 for water or the solenoid valve 11 for carbonated water to prepare a beverage which is then discharged.

When a beverage feeding apparatus having a flow regulator in each of a syrup feed line and a diluting water feed line is actually installed at a predetermined sale site, an engineer has regulated the flow regulator for syrup in the syrup feed line and the flow regulator for diluting water in the diluting water feed line to regulate the flow rate of the syrup and the flow rate of the diluting water, thereby providing a proper dilution level. For one beverage dispenser or cup-type vending machine, about 20 to 30 min was necessary for this regulation work when the number of types of syrup is assumed to be 4. This has incurred a lot of personnel expenses.

FIG. 3 shows a change in viscosity and flow rate of syrup as a function of temperature. The beverage feeding apparatuses shown in FIGS. 20 and 21 have the following problems in addition to the above-described problems. Specifically, since the flow rate is regulated only under specific conditions, particular dilution is likely to be influenced, for example, by a variation in external environment at the installation site, a fluctuation in pressure of tap water, and the temperature of syrup at the time of installation. As shown in the drawing, the flow rate of the syrup regulated by the flow regulator 43 for syrup varies depending upon the viscosity of syrup. Further, the viscosity of syrup depends upon the temperature of syrup. Therefore, the flow rate of syrup, even when regulated by the flow regulator 43 for syrup, is unfavorably varied depending, for example, upon a change in temperature caused by a change in season. This requires a periodical inspection of which the cost is very high.

Syrup has high viscosity. This viscosity greatly varies depending upon the temperature. Further, the dilution level and the viscosity greatly vary depending upon the type of the syrup. Therefore, if the periodical inspection is not performed, then beverages having an inappropriate level of dilution of the syrup with the diluting water would be provided to customers.

As described above, the ratio of diluting water to syrup in the dilution is generally about 3:1 to about 6:1. In the case of the beverage feeding apparatus having a flow meter in each of the diluting water feed line and the syrup feed line, the feed of the syrup is completed earlier than the feed of the diluting water, because the flow rate of the diluting water and the flow rate of the syrup cannot be regulated. This leads to a fear that, in the resultant beverage, the level of dilution of the syrup with the diluting water is heterogeneous. In order to overcome this problem, a method as shown in FIG. 4 has been adopted. In this method, as shown in a timing chart (ii) of FIG. 4 for the operation of the solenoid valve 17 for syrup, the solenoid valve 17 for syrup is intermittently opened and closed to intermittently feed the syrup over a period between the start of the feed of diluting water and the stop of the feed of diluting water as shown in a timing chart (i) of FIG. 4 for the operation of the solenoid valve 5 for water or the solenoid valve 11 for carbonated water so that the timing of the stop of the feed of syrup becomes identical to the timing of the stop of the feed of diluting water such as water or carbonated water. In this case, as shown in (iii) of FIG. 4, a beverage having portions with a high dilution level of syrup and portions with a low dilution level of syrup is discharged from the multivalve 19, and provided to customers.

Further, in the method wherein the flow rate is regulated with a flow regulator or a flow meter according to liquids fed into the feed line, such as syrup and diluting water, the regulation depending upon a liquid to be fed is required each time when a new liquid having a property, such as density, viscosity, etc different from those of a liquid, which has been used before the feed of the new liquid, is fed into the feed line. In this case, however, as described above, a change in viscosity caused, for example, by a change in temperature causes a change in flow rate from the regulated flow rate. For example, an increase in viscosity of the liquid caused by a lowering in temperature leads to an increase in flow resistance within the feed line, and, consequently, the flow rate of the actually fed liquid is smaller than the preset flow rate. Increasing the liquid feed time in order to compensate for this difference leads to the delay of the sale time. Further, there is a fear of a beverage having a dilution level different from the predetermined dilution level being produced unless the magnitude of the change in feed time is accurately set. Moreover, for each type of syrup, inherent viscosity characteristics exist besides the change in viscosity derived from environmental factors. Therefore, disadvantageously, the flow regulator should be regulated for each type of syrup.

A tube pump is an example of means which, even when the viscosity of a liquid has been changed, does not cause a lowering in fluidity of the liquid.

FIG. 5 shows a tube pump 110 for use, for example, in beverage production apparatuses. The tube pump 110 comprises: a tube 111 through which a liquid, such as syrup, is passed; a tube guide 112 for guiding the tube; a plurality of rollers 113 which sandwich the tube 111 between the rollers 113 and the tube guide 112 and are rotated while elastically deforming the tube 111; roller supports 114A and 114B which rotatably support the plurality of rollers 113; an axis 115 of rotation which is driven by a drive motor (not shown) to transmit torque to the roller supports 114A and 114B; and a pump case 116 provided with a section 116A through which the tube is extended. The tube guide 112 comprises: a lever 112A having a locking mechanism; and a shaft 112B which can rotatably support the tube guide 112 by removing the locking mechanism of the lever 112A at the time of mounting of the tube. The plurality of rollers 113 are rotatably supported by a shaft 113A provided between the roller supports 114A and 114B.

FIG. 6 shows the flow of syrup S based on the drive of the tube pump 110. In the drawing, for simplification of the explanation, the roller support 114A is not shown. Although syrup S is continuous within the tube 111, only syrup S delivered based on the delivery operation of the two rollers 113 is shown in the drawing. In FIG. 6A, the tube 111 is mounted on the tube pump 110 as shown in the drawing. Syrup S is fed from a syrup tank (not shown), and the roller support 114A is driven and rotated. In FIG. 6B, the two rollers 113 press the tube 111 toward the tube guide 112 while sandwiching the tube 111 between the two rollers 113 and the tube guide 112 to transfer by pressure the syrup S by a volume based on the length of the tube sandwiched between the two rollers 113 and the sectional area of the tube toward the direction of rotation of the roller support 114A. In FIG. 6C, the rollers 113 move the syrup S toward the downstream side while elastically deforming the tube 111 based on the rotation of the roller support 114A. As soon as the roller 113 on the downstream side is separated from the tube guide 112, the syrup S is delivered toward the downstream side. The roller 113 on the upstream side is moved based on the rotation of the roller support 114A while pressing the tube 111, whereby the syrup S is delivered toward the downstream side.

According to this type of tube pump, a given volume of syrup S can be moved toward the downstream side by rotating the two rollers 113 while pressing the tube 111 in the direction of delivery of the syrup S. However, when a fluctuation in viscosity has occurred in the syrup S which is passed through the tube 111, the following problem occurs. Specifically, in this case, although the fluctuation in viscosity could be detected, for example, based on a fluctuation in load of the drive motor which drives the roller support 114A, the detected value of the fluctuation in load includes property values of, for example, the material constituting the tube, making it impossible to control the delivery of the syrup based on a subtle fluctuation in viscosity of the liquid.

SUMMARY OF THE INVENTION

The invention has been achieved to solve the problems above, and is to provide a liquid delivery apparatus capable of continuously and accurately delivering a given volume of liquid whose viscosity is large, further varies according to temperature, and furthermore differs according to its kind, without fluctuation of flow rate even though a change in properties of the liquid due to a change in external environment such as a change in temperature or the like occurs, and a method for delivering a liquid.

Further, the invention is to provide a liquid delivery apparatus capable of continuously and accurately delivering a plural number of liquids having different viscosities at a given volume level, based on a given time or a dilution ratio with other liquid when they are simultaneously delivered, and a method for delivering the liquid.

Further, the invention is to provide a liquid delivery apparatus capable of precisely synchronizing a delivery motion of delivering a plural number of liquids having different viscosities at a given volume level, based on a given time or a dilution ratio with other liquid when they are simultaneously delivered, and a method for delivering the liquid.

The liquid delivery apparatus of the invention comprises a liquid delivery line which can deliver liquids which have different properties such as density, viscosity and the like; and a flow regulation means which comprises a body having an inflow port in which the above-described liquid flows and an outflow port out which the above-described liquid flows out, and a rotator of moving the above-described liquid from the above-described inflow port to the above-described outflow port by given volumes along the internal wall of the above-described body by being rotated in the above-described body, and continuously delivers the above-described liquid to the above-described liquid delivery line by given volumes, based on the rotation of the above-described rotator.

Further, in the liquid delivery apparatus equipped with a liquid delivery line which can deliver liquids which have different properties such as density, viscosity and the like, the liquid delivery apparatus of the invention provided a flow regulation means comprising a body having an inflow port in which the above-described liquid flows and an outflow port out which the above-described liquid flows; a rotator of moving the above-described liquid which flows in from the above-described inflow port by given volumes along the internal wall of the above-described body by being rotated in the above-described body, and continuously delivering the liquid from the above-described outflow port to the above-described liquid delivery line; and a drive unit for driving the above-described rotator, within the above-described liquid delivery line.

Further, in the liquid delivery apparatus of the present invention, the above-described drive unit flows a pressurized liquid out from the above-described outflow port by a fixed volume, based on the rotation drive of the above-described rotator as the above-described liquid which flows in from the above-described inflow port to the above-described body through the above-described liquid delivery line.

Further, in the liquid delivery apparatus of the present invention, the above-described drive unit comprises a drive motor for driving the above-described rotator and a controlling unit for controlling the delivery of the above-described pressurized liquid so that the pressure of the above-described inflow port is not negative pressure.

Further, in the liquid delivery apparatus of the present invention, the above-described drive unit comprises a drive motor for driving the above-described rotator and a control unit for setting the current-carrying level of the above-described drive motor so that the above-described pressurized liquid are continuously delivered at a desired flow rate from the start of delivery.

Further, the liquid delivery apparatus of the present invention comprises a liquid delivery line capable of delivering the liquid, an another liquid delivery line for delivering the above-described liquid which is delivered through the above-described liquid delivery line and other liquids having different properties, and a flow regulation means for controlling the flow rate of the above-described liquid which is continuously delivered through the above-described liquid delivery line based on the flow fluctuation of the above-described other liquids.

Further, the liquid delivery apparatus of the present invention comprises a liquid delivery line which can deliver liquids which have different properties such as density, viscosity and the like; a body which is provided in the above-described liquid delivery apparatus and comprises an inflow port in which the above-described liquid flows and an outflow port out which the above-described liquid flows out; a rotator of moving the above-described liquid by given volumes from the above-described inflow port to the above-described outflow port along the internal wall of the above-described body by being rotated in the above-described body; a flow meter which outputs a flow signal corresponding to the flow rate of the above-described liquid based on the rotation of the above-described rotator; a flow regulator for regulating the flow rate of the above-described liquid which is continuously delivered through the above-described liquid delivery line by being driven based on the above-described flow signal; and a control unit for setting the control level of the above-described flow regulator.

Further, the liquid delivery apparatus of the present invention provides, a fluid delivery system for conveying a first fluid in response to the flow of a second fluid, comprising:

constant volume flow regulator for moving the first fluid therethrough at rate proportional to the flow rate of the second fluid and a control system responsive to the flow rate of said second fluid for controlling said constant volume fluid regulator to output said first fluid at a rate proportional to the flow rate of the second fluid.

Further, the liquid delivery apparatus of the present invention provides, a fluid delivery system for conveying a first fluid at a constant volume over a selected time interval, comprising:

constant volume flow regulator for moving the first fluid therethrough at a constant volume over a selected time interval, and a control system responsive to changes in the flow rate of said first fluid for controlling said constant volume fluid regulator to output said first fluid at a constant volume over a selected time interval.

Further, the liquid delivery apparatus of the present invention provides, a fluid delivery system for conveying a first fluid in response to the flow of a second fluid, comprising:

a constant volume flow regulator for moving the first fluid therethrough at rate at least partially determined by the flow rate of the second fluid, and a control system comprising, a memory storing a flow rate of said second fluid and a value representing a ratio of a first fluid volume to a second fluid volume, and a feed control unit responsive to a stored flow rate of the second fluid and ratio value for controlling said constant volume fluid regulator to output said first fluid at a rate proportional to the flow rate of the second fluid and the ratio of the first fluid volume to the second fluid volume.

Further, the liquid delivery apparatus of the present invention provides, a fluid delivery system for conveying a first fluid in response to the flow of a second fluid, comprising:

a constant volume flow regulator for moving the first fluid therethrough at rate at least partially determined by the flow rate of the second fluid, and a fluid flow meter measuring the flow rate of said second fluid, and a control system comprising, a feed control unit responsive to the measured value of the flow rate of the second fluid for controlling said constant volume fluid regulator to output said first fluid at a rate proportional to the measured flow rate of the second fluid.

Further, the liquid delivery apparatus of the present invention provides, a fluid delivery system for conveying a first fluid in response to the flow of a second fluid, comprising:

a constant volume flow regulator for moving the first fluid therethrough at rate determined by the flow rate of the second fluid, including a set of rotators which are rotated within the body in respective directions opposite to each other to move the first fluid therethrough, a mixing means for mixing said first and second fluids, a first valve means in a fluid line between said fluid flow meter and said mixing means to selectively block flow of said second fluid to said mixing means, a second valve means in a fluid line between said constant volume flow regulator and said mixing means to selectively block flow of said first fluid to said mixing means, and a control system comprising, a feed control unit responsive to the flow rate of the second fluid, for controlling said constant volume fluid regulator to output said first fluid at a rate proportional to the flow rate of the second fluid and said ratio, said feed control unit including a timer.

Further, the liquid delivery apparatus of the present invention provides, a fluid delivery system for conveying a first fluid at a constant volume over a time interval, comprising:

a constant volume flow regulator for moving the first fluid therethrough at a constant rate independent of changes in a physical property of said first fluid, said constant volume flow regulator producing a signal proportional to the rate of fluid flow therethrough, a control system coupled to said constant volume flow regulator and responsive to the fluid flow rate signal for controlling the flow rate through the constant volume flow regulator to be a constant rate independent of variations in a physical property of said first fluid that tend to alter its flow rate.

Further, the liquid delivery apparatus of the present invention provides, a fluid delivery system for conveying a first fluid at a constant volume over a selected time interval, comprising:

a constant volume flow regulator for moving the first fluid therethrough at a constant rate independent of changes in a physical property of said first fluid, said constant volume flow regulator producing a signal proportional to the rate of fluid flow therethrough, a control system coupled to said constant volume flow regulator and responsive to the fluid flow rate signal for controlling the flow rate through the constant volume flow regulator to be a constant rate independent of variations in a physical property of said first fluid that tend to alter its flow rate, a first conduit for carrying said first fluid, an inlet for said second fluid, a second conduit connected to said inlet for carrying said second fluid to a first location, a third conduit for carrying said second fluid to a second location, said third conduit branching off from said second conduit, a fluid flow meter connected between the inlet and the location where the third conduit branches from the second conduit.

The method for delivering a liquid of the present invention provides a flow regulator in a passage in which the liquid is passed, and controls a flow regulation level so that the above-described liquid of a reference volume level is sequentially delivered to the above-described passage by passing it through the above-described flow regulator.

Further, the method for delivering a liquid of the present invention provides a flow regulator in a passage in which the liquid is passed, detects the flow regulation level of the above-described flow regulator which varies in accordance with the changes of physical properties such as the density, viscosity and the like of the above-described liquid, and controls the above-described flow regulator so that the above-described flow regulation level is a reference volume level.

Further, the method for delivering a liquid of the present invention provides a flow regulator in a passage in which the liquid is passed, pressurizes the above-described liquid by a container in which the above-described liquid is reservoired, feeds the pressurized liquid from the above-described container to the above-described flow regulator through the above-described passage, detects the flow regulation level of the above-described flow regulator which receives the above-described pressurized liquid, and controls the above-described flow regulator so that the above-described flow regulation level is a reference volume level.

Further, the method for delivering a liquid of the present invention provides a flow regulator in a passage in which the liquid is passed, detects the flow regulation level of the above-described flow regulator which varies in accordance with the changes of physical properties such as the density, viscosity and the like which differ according to the kind of the above-described liquid, and controls the above-described flow regulator so that the flow of the above-described liquid of a reference volume level occurs continuously from the above-described flow regulator.

Further, the method for delivering a liquid of the present invention comprises a feed step of pressurizing a liquid reservoired in a container and feeding the above-described liquid into a passage connected to the above-described container; a detection step of detecting, in the above-described passage, values of properties such as density, viscosity and the like which vary according to the kind of the above-described liquid; and a control step of controlling the flow rate of the above-described liquid at a given flow rate determined by a reference volume level of the above-described liquid even though the above-described values of properties are varied.

Further, the method for delivering a liquid of the present invention provides a flow regulator in a passage through which a liquid is passed, and a pressure control valve upstream or downstream of the flow regulator; pressurizes the above-described liquid in a container reservoiring the above-described liquid; feeds the pressurized liquid from the above-described container to the above-described flow regulator through the above-described passage; detects the flow regulation level of the above-described flow regulator which receives the above-described pressurized liquid; and controls the above-described flow regulator so as to render the above-described flow regulation level identical to a reference volume level.

Further, the method for delivering a liquid of the present invention provides a flow regulator which regulates the flow rate of the feeding medium such as a liquid, a gas or the like, in a tube passage; feeds the above-described feeding medium to the above-described flow regulator through the above-described tube passage; and delivers the above-described feeding medium to the above-described tube passage when the condition of the load of the above-described flow regulator based on the feeding of the above-described feeding medium is larger than the control range of the above-described flow regulator, while limiting the flow rate of the above-described feeding medium based on the load which exceeds the above-described control range.

Further, the method for delivering a liquid of the present invention provides a flow regulator which delivers a pressurized liquid of a fixed volume level in a tube passage; feeds the above-described pressurized liquid to the above-described flow regulator through the above-described tube passage; measures the flow rate of the above-described pressurized liquid which is delivered by driving the above-described flow regulator; sets the drive level of the above-described flow regulator so that the above-described pressurized liquid is continuously delivered at a desired flow rate based on the above-described flow rate; and delivers the above-described pressurized liquid based on the above-described drive level which was set.

Further, the method for delivering a liquid of the present invention provides, a method of conveying a first fluid at a constant volume over a selected time interval, comprising:

providing a constant volume flow regulator, measuring the flow rate of said first fluid, comparing the measured flow rate with a reference flow rate, and modifying the flow rate of the first fluid through said constant volume flow regulator to maintain said reference flow rate, whereby the flow rate of the first fluid is maintained constant independent of changes in a physical property of said first fluid that tend to alter its flow rate.

Further, the method for delivering a liquid of the present invention provides, a fluid delivery system a method of determining a quantify of available fluid to be delivered comprising:

providing a constant volume flow regulator including a set of rotators which are rotated within the body in respective directions opposite to each other to move the fluid, measuring the flow rate of said fluid, comparing the measured flow rate with a reference flow rate, and modifying the speed of rotation of said rotators to modify the flow rate of the fluid through said constant volume flow regulator to maintain said reference flow rate, producing a signal from said constant volume flow regulator derived from the load on said rotators, providing a reference signal value corresponding to a load change an said rotators resulting from the absence of said fluid, and signaling when said produced signal corresponds with said reference signal to indicate that the fluid has been used up.

Further, the method for delivering a liquid of the present invention provides, a method of conveying a fluid at a constant volume over a selected time interval, comprising:

providing a constant volume flow regulator, measuring the flow rate of said first fluid, comparing the measured flow rate with a reference flow rate, and modifying the flow rate of the first fluid through said constant volume flow regulator to maintain said reference flow rate, whereby the flow rate of the first fluid is maintained constant independent of changes in a physical property of said first fluid that tend to alter its flow rate, wherein said step of measuring said flow rate includes measuring one of a voltage and current supplied to said constant volume flow regulator, said step of comparing includes the step of comparing the measured current or voltage to a reference current or voltage, and said step of modifying the flow rate includes modifying one of the voltage and current applied to the constant volume flow regulator.

BRIEF DESCRIPTION OF THE DRAWINGS

The invention will be explained in more detail in conjunction with the appended drawings, wherein:

FIGS. 12A, 12B and 12C are diagrams showing the reduction ratio of a reduction gear in the first preferred embodiment of the invention;

FIGS. 21A, 21B, 219 and 21D are diagrams illustrating the sequential delivery of a liquid as a result of the rotation of the two cocoon type rotators as a constant volume flow regulator in the fourth preferred embodiment of the invention;

DESCRIPTION OF THE PREFERRED EMBODIMENTS

Figure 1:
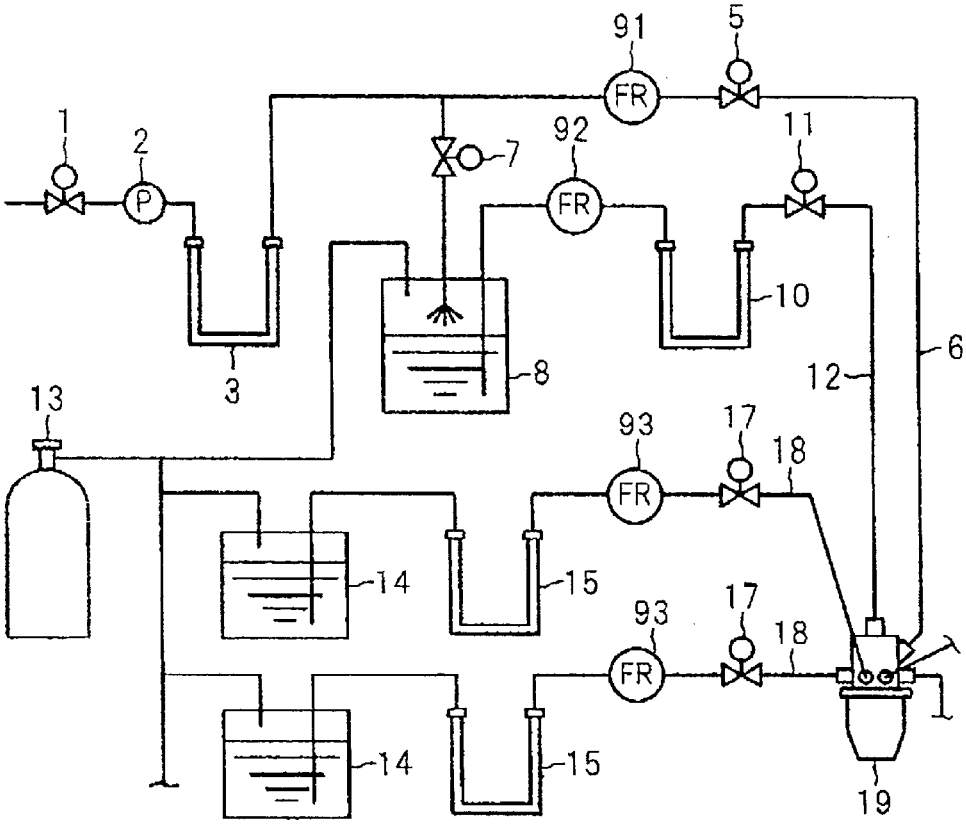
FIG. 1 PRIOR ART
FIG. 1 is a schematic diagram showing the construction of a conventional beverage feeding apparatus provided with a flow regulator in each of a syrup feed line and a diluting water feed line.

Preferred embodiments of the invention will be explained in more detail in conjunction with the accompanying drawings. Like parts have the same reference numerals throughout all of the drawings.

Figure 7:
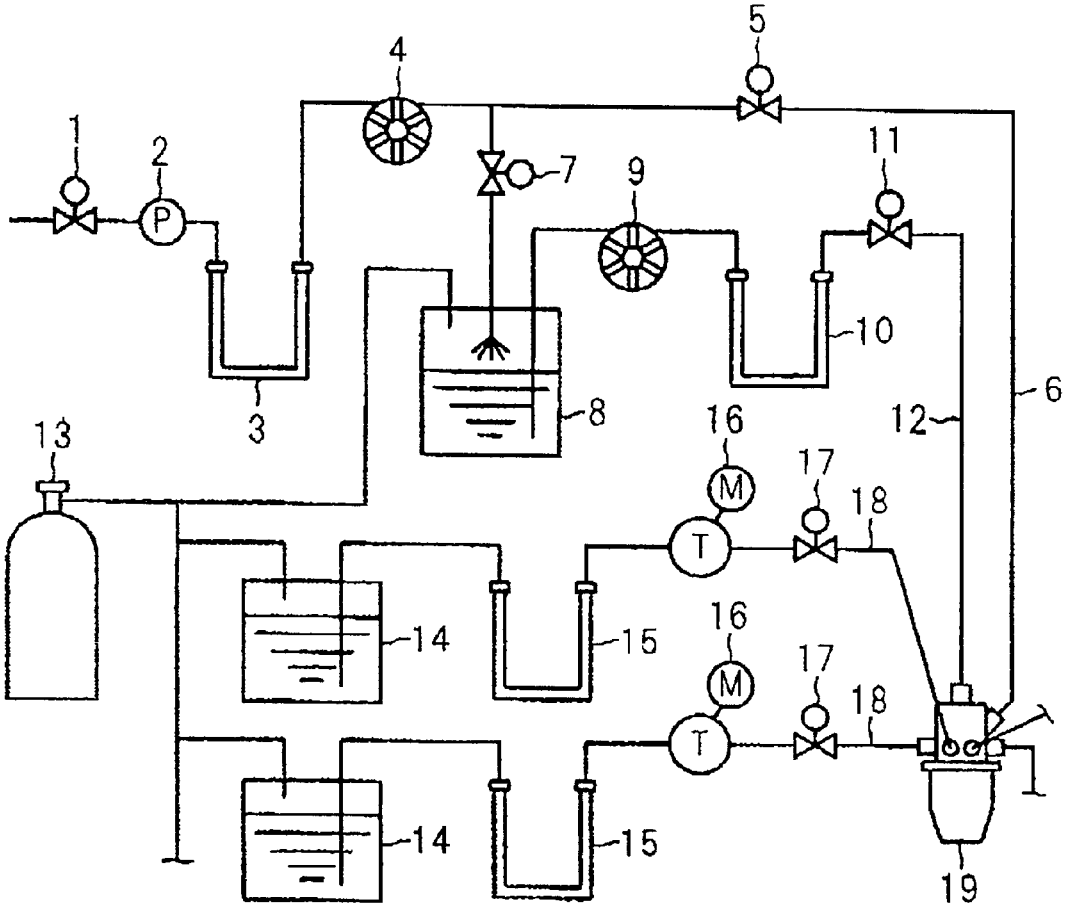
FIG. 7 is a schematic diagram showing the construction of a beverage feeding apparatus as a liquid delivery apparatus according to the first preferred embodiment of the invention.

FIG. 7 is a schematic diagram showing the construction of a beverage feeding apparatus as a liquid delivery apparatus according to the first preferred embodiment of the invention. In FIG. 7, numeral 1 designates a solenoid valve for a water inlet, numeral 2 a water pump, numeral 3 a water cooling coil, numeral 4 a flow meter for water, numeral 5 a solenoid valve for water, numeral 6 a water feed line, numeral 7 a solenoid valve for water feed to a carbonator, numeral 8 a carbonator (a carbonated water production unit), numeral 9 a flow meter for carbonated water, numeral 10 a carbonated water cooling coil, numeral 11 a solenoid valve for carbonated water, numeral 12 a carbonated water feed line, numeral 13 a carbon dioxide bomb, numeral 14 a syrup tank (liquid feeding means being constituted by the carbon dioxide bomb 13 and the syrup tank 14), numeral 15 a syrup cooling coil, numeral 16 a constant volume flow regulator (flow regulation means), numeral 17 a solenoid valve (valve means) for syrup, numeral 18 a syrup feed line, and numeral 19 a multivalve. The constant volume flow regulator 16 comprises: a body having an inflow port, through which syrup (a liquid material) flows in the body, and an outflow port through which the syrup flows out from the body; a set of rotators which are rotated within the body in respective directions opposite to each other to move the syrup from the inflow port to the outflow port by given volumes along the internal wall of the body; and a drive unit for driving the set of rotators at a speed of rotation according to the property of the syrup. The constant volume flow regulator 16 is a flow regulator which permits the set of rotators to be rotated in response to a signal output from a feed control unit 100 described later and functions to accurately and continuously deliver a given volume of syrups different from each other in a property such as density, viscosity, etc without causing a change in flow rate even when the property of syrup have varied due to a change in external environment such as a change in temperature.

Water enters the water pump 2 through the solenoid valve 1 for a water inlet, and is fed by means of the water pump 2 into the multivalve 19 through the water feed line 6, that is, through the water cooling coil 3 for cooling water, a flow meter 4 for water which measures the flow rate of water and outputs pulses of frequency corresponding to the flow rate, and a solenoid valve 5 for water. As soon as the number of pulses output from the flow meter 4 for water has reached a preset number of pulses, the water pump 2 is stopped and, in addition, the solenoid valve 1 for a water inlet and the solenoid vale 5 for water are closed to stop the feed of water.

Further, the water feed line 6 is branched off at a position between the flow meter 4 for water and the solenoid valve 5 for water, and is connected to the carbonator 8 through the solenoid valve 7 for water feed to a carbonator. A float switch (not shown) for detecting the level of water is provided within the carbonator 8. As soon as the level of water within the carbonator 8 reaches the lower limit position, the solenoid valve 1 for a water inlet and the solenoid valve 7 for water feed to a carbonator are opened and, in addition, the water pump 2 is operated to feed water into the carbonator 8 through the flow meter 4 for water. In this case, upon the operation of the water pump 2 and the measurement of the flow rate of water followed by the feed of water through the flow meter 4 for water which outputs pulses by a number corresponding to the flow rate, the flow meter 4 for water measures the flow rate of water fed and outputs pulses by a number corresponding to the flow rate. As soon as the number of pulses output from the flow meter 4 for water reaches the reference number of pulses stored in a memory 102 described later, the feed control unit 100 stops sending a signal to the solenoid valve 1 for a water inlet, a water pump 2, and a solenoid valve 7 for water feed to a carbonator, and stops the feed of water to the carbonator 8. Carbon dioxide fed from the carbon dioxide bomb 13 is dissolved in the fed water to prepare carbonated water. The carbonated water is forced out from the carbonator 8 by pressure of the carbon dioxide fed from the carbon dioxide bomb 13, and is fed into the multivalve 19 through the carbonated water feed line 12, that is, through the flow meter 9 for carbonated water which measures the flow rate of carbonated water and outputs pulses of a frequency corresponding to the flow rate, the carbonated water cooling coil 10 for cooling carbonated water, and the solenoid valve 11 for carbonated water. As soon as the number of pulses output from the flow meter 9 for carbonated water reaches a preset number of pulses, the solenoid valve 11 for carbonated water is closed to stop the feed of carbonated water.

On the other hand, syrup is forced out from the syrup tank 14 by the pressure of carbon dioxide fed from the carbon dioxide bomb 13, and is fed into the multivalve 19 through the syrup feed line 18. That is, the syrup forced out from the syrup tank 14 is cooled by means of a syrup cooling coil 15 for cooling syrup, is continuously delivered by a given volume through the constant volume flow regulator 16 for delivering a constant volume of syrup, and enters the multivalve 19 through the solenoid valve 17 for syrup. In this connection, it should be noted that the syrup tank 14, the syrup cooling coil 15, the constant volume flow regulator 16, the solenoid valve 17 for syrup, and the syrup feed line 18 are provided by a number corresponding to the number of types of beverages to be sold.

Within the multivalve 19, the syrup fed from the syrup tank 14 through the syrup feed line 18, that is, through the syrup cooling coil 15, the constant volume flow regulator 16, and the solenoid valve 17 for syrup, is mixed with diluting water, such as water or carbonated water, fed through the flow meter 4 for water and the solenoid valve 5 for water or through the flow meter 9 for carbonated water and the solenoid valve 11 for carbonated water to prepare a beverage with a proper dilution level which is then discharged.

Figure 8A:
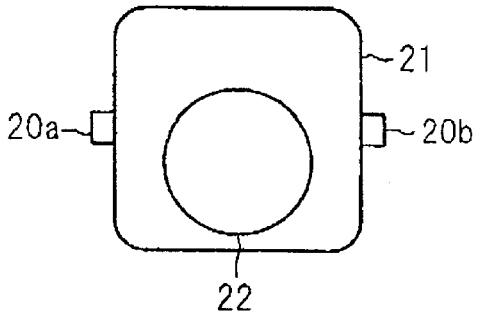
FIGS. 8A, 8B and 8C are diagrams showing the construction of a set of rotators, which are two circular gears, as a constant volume flow regulator used in the first preferred embodiment of the invention.
Figure 8B:
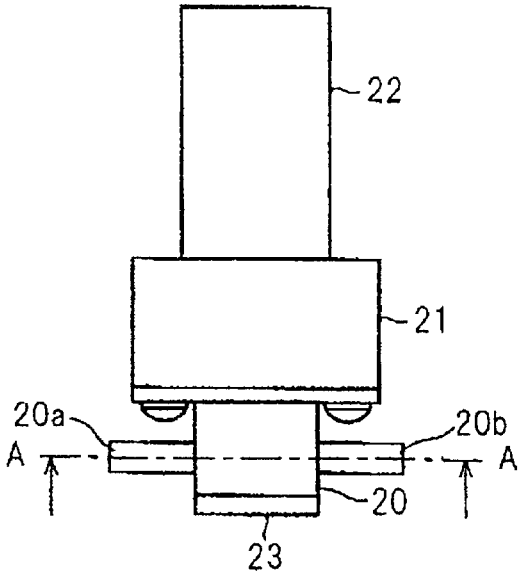
Figure 8C:
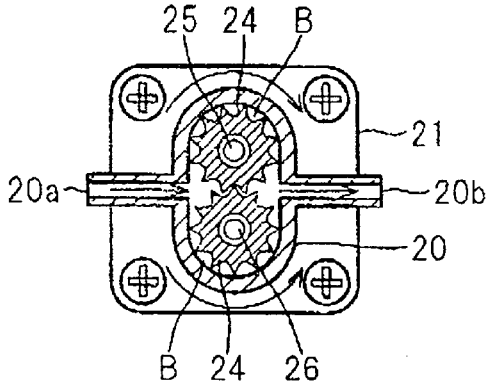

FIG. 8 is a diagram showing the construction of a constant volume flow regulator 16 according to the first preferred embodiment of the invention which comprises a set of rotators constituted by two circular gears including drive gears and engaged with each other and moves the liquid from the inflow port to the outflow port along the internal wall of the body while holding the liquid in a space defined by a portion, between teeth of the circular gear, and the internal wall of the body. FIG. 8A shows the constant volume flow regulator in its state as viewed from the plan, FIG. 8B the constant volume flow regulator in its state as viewed from the side, and FIG. 8C the cross section taken on line A—A of FIG. 8B as viewed from a direction indicated by arrows. This constant volume flow regulator 16 delivers a given volume of syrup in a continuous manner by moving the syrup forced out from the syrup tank 14 to the outflow port side along the internal wall of the body by the pressure of carbon dioxide fed from the carbon dioxide bomb 13 while holding the syrup in a space defined by a portion, between teeth of the circular gear, and the internal wall of the body. The constant volume flow regulator 16 comprises: a body 20; an inflow port 20*a* through which syrup flows in the body 20; an outflow port 20*b* through which the syrup flows out from the body 20; a reduction gear 21 fixed on the top of the body 20, for example, by means of a screw; a rotator drive motor 22 which is fixed onto the body 20 through the reduction gear 21; a lid 23 fixed at the lower part of the body 20; and a set of circular gears 24 (rotators) provided within the body 20. The set of circular gears 24 are rotatably supported by shafts 25 (drive side) and 26 (driven side) which are supported on the body 20 and the lid 23. Upon the drive of the shaft 25 through the reduction gear 21 in the state of coupling with the rotating shaft of the rotator drive motor 22, the set of circular gears 24 are rotated in directions indicated by respective arrows.

Further, an encoder 50 (not shown) is provided which outputs pulses in synchronization with the speed of rotation of the rotator drive motor 22 for detecting the speed of rotation of the circular gears 24 (the speed of rotation of the rotator drive motor 22 driven in the state of coupling with the shaft 25 through the reduction gear 21).

According to the constant volume flow regulator 16, upon the rotation of the set of circular gears 24, the syrup forced out from the syrup tank 14 by the pressure of carbon dioxide fed from the carbon dioxide bomb 13 flows through the inflow port 20*a* into the body 20, is delivered to the outflow port 20*b* along the internal wall of the body 20 while being held in a space B defined by a portion, between teeth of the circular gears 24, and the internal wall of the body 20, and then flows out from the outflow port 20*b*.

Figure 9:
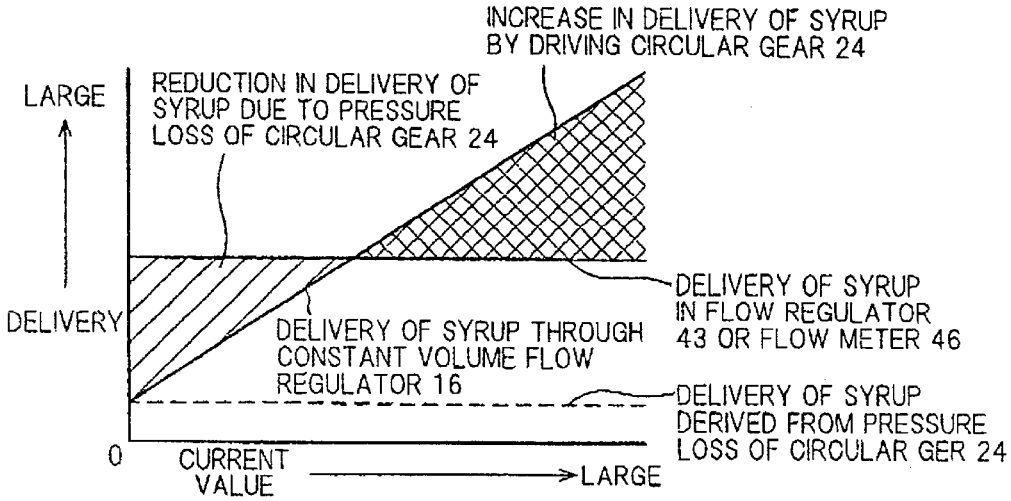
FIG. 9 is a diagram showing the delivery of a liquid in a liquid feed line provided with the constant volume flow regulator according to the first preferred embodiment of the invention.

FIG. 9 is a diagram showing the delivery of a liquid through the liquid delivery line when the constant volume flow regulator 16 according to the first preferred embodiment has been applied to a beverage feeding apparatus. During the stop of the constant volume flow regulator 16, since a rotator drive motor 22 serves as a brake for inhibiting the rotation of the circular gears 24, the pressure loss is larger than that in the flow regulator 43 for syrup and the flow meter 46 for syrup. Therefore, the delivery of the syrup by the pressure loss of the circular gears 24 is smaller than that of the flow regulator 43 for syrup and the flow meter 46 for syrup which discharge syrup forced out from the syrup tank 14 by the pressure of carbon dioxide fed from the carbon dioxide bomb 13. In FIG. 9, a portion where the delivery of the syrup by the constant volume flow regulator 16 is smaller than the delivery of syrup by the flow regulator 43 for syrup and the flow meter 46 for syrup, is a reduction in delivery of syrup caused by the pressure loss of the circular gears 24, and the force necessary for the rotator drive motor 22 to drive the circular gears 24 is reduced by such an extent that the pressure of carbon dioxide is applied for forcing out the syrup. On the other hand, a portion where the delivery of the syrup by the constant volume flow regulator 16 is larger than the delivery of syrup by the flow regulator 43 for syrup and the flow meter 46 for syrup, is an increase in delivery of syrup created by delivering the syrup forced out from the syrup tank 14 by the pressure of carbon dioxide through the drive of the circular gears 24 by the rotator drive motor 22, and the force necessary for the rotator drive motor 22 to drive the circular gears 24 is reduced by such an extent that the pressure of carbon dioxide is applied for forcing out the syrup from the syrup tank 14.

Next, the control of a beverage feeding apparatus as the first preferred embodiment of the liquid delivery apparatus according to the present invention will be explained based on the feed operation of a non-carbonated beverage.

Figure 10:
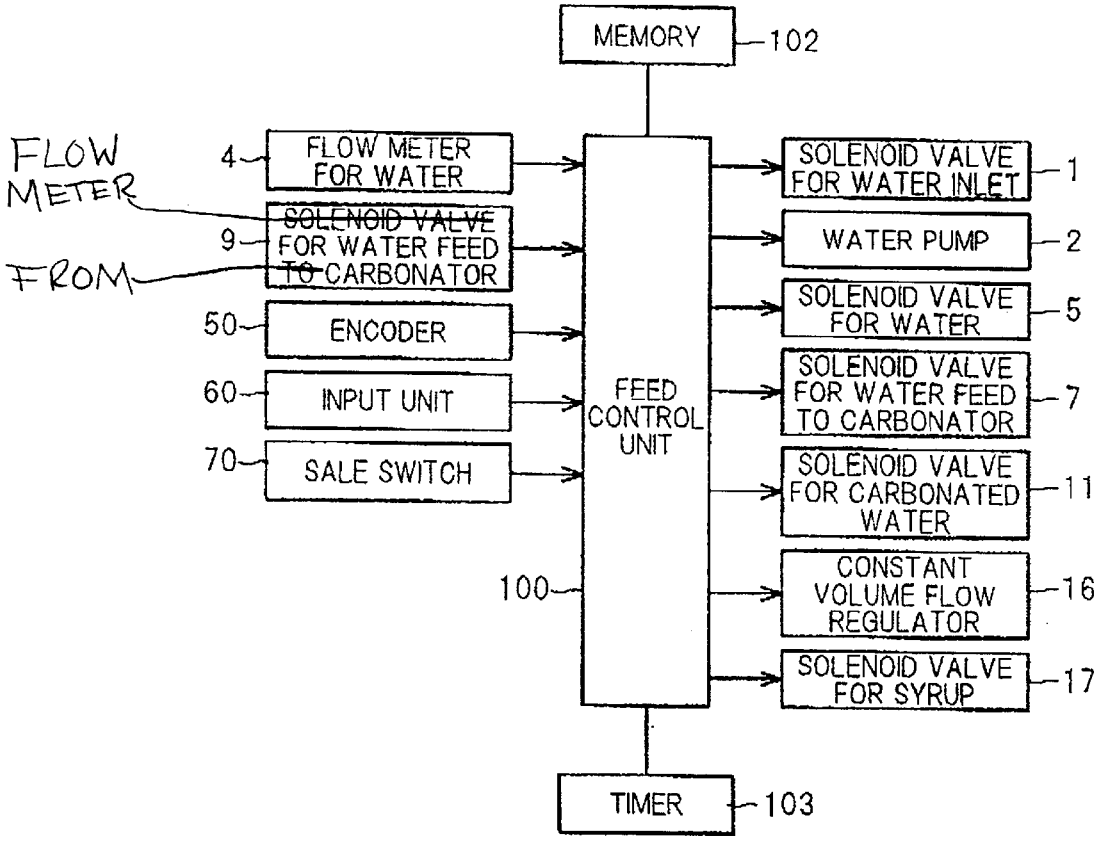
FIG. 10 is a control block diagram of the beverage feeding apparatus according to the first preferred embodiment of the invention.

FIG. 10 is a block diagram for the control of a beverage feeding apparatus according to the first preferred embodiment of the invention. In FIG. 10, reference numerals correspond to those in FIGS. 7 and 8. This beverage feeding apparatus comprises: an input unit 60 having, for example, a key board for inputting various setting values for control; a plurality of sale switches 70 for the selection of beverages provided on the front of the beverage feeding apparatus; a memory 102 for storing data for controlling each section of the beverage feeding apparatus; a timer 103 for counting a clock generated in a reference clock generator (not shown) to measure a delay time t elapsed in a period between the opening of the solenoid valve 5 for water and the initiation of the operation of the constant volume flow regulator 16 (for example, about 0.2 sec), a delay time $t_1$ which has elapsed until the rotator drive motor (not shown) of the constant volume flow regulator 16 is driven with respect to the timing of opening the solenoid valve 17 for syrup, and a delay time $t_2$ which has elapsed in a period between the stop of the drive of the rotator drive motor (not shown) in the constant volume flow regulator 16 and the closing of the solenoid valve 17 for syrup; and a feed control unit 100 for controlling each of the above units. For example, a syrup number, the amount of sale (cup size: large, medium, and small), carbonation (carbonated beverage, weakly carbonated beverage, and non-carbonated beverage) are assigned to the sale switches 70, respectively. The feed control unit 100 supplies power to the rotator drive motor 22 based on voltage or current value stored for each beverage in the memory 102. Further, if necessary, the set value input by the input unit 60 is displayed on a display (not shown). The memory 102 stores, for each beverage: a reference number of pulses which are compared with the number of pulses output from the flow meter 4 for water; a voltage or current value supplied to the rotator drive motor 22 for driving the circular gears 24 in the constant volume flow regulator 16 at a predetermined speed of rotation required for feeding a predetermined amount of syrup; a reference frequency of pulses which are compared with a pulse frequency output from the encoder 50 provided in the constant volume flow regulator 16; and the ratio of the amount of diluting water, such as water or carbonated water, to the amount of syrup, that is, dilution ratio (dilution level).

The reason why the delay time t is provided for the operation of the constant volume flow regulator 16, is as follows. When the constant volume flow regulator 16 is operated simultaneously with the opening of the solenoid valve 5 for water, there is a fear of the syrup being left on the bottom of the cup despite passage through the multivalve 19 because the viscosity and specific gravity of the syrup are larger than the viscosity and specific gravity of the diluting water. The provision of the delay time $t_1$ can prevent syrup staying on the bottom of the cup. Further, the object of providing the delay time $t_2$ is to inhibit the occurrence of a water hammer at the time of closing of the constant volume flow regulator.

Figure 11A:
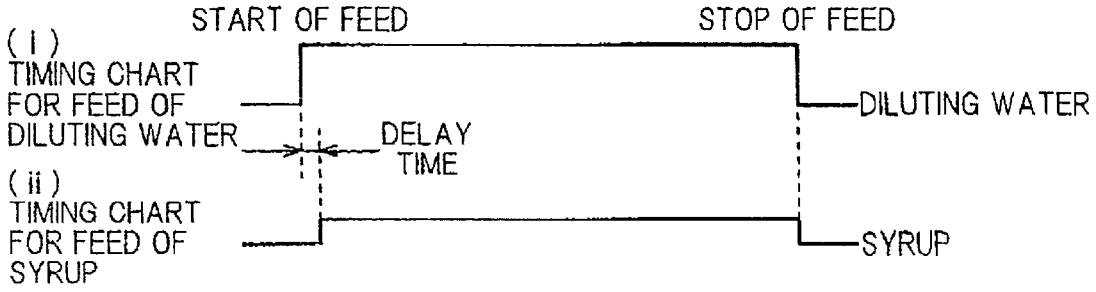
FIGS. 11A and 11B are timing charts for the feed of diluting water and the feed of syrup in the first preferred embodiment of the invention.
Figure 11B:
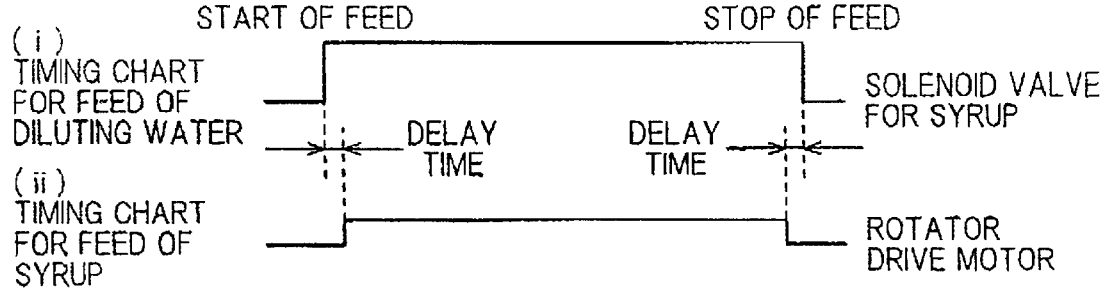

FIG. 11 shows a timing chart for the feed of dilution water and a timing chart for the feed of syrup, wherein FIG. 11A is timing charts where the timing of stopping the feed of the diluting water is the same as the timing of stopping the feed of the syrup, and FIG. 11B is timing charts showing the timing of driving the solenoid valve 17 for syrup and the rotator drive motor 22 in conjunction with the stop of feeding the syrup. Upon the selection of the sale switch 70 by a purchaser, the feed control unit 100 outputs, based on data stored on the memory 102, a drive signal which is input into the solenoid valve 1 for a water inlet, the water pump 2, and the solenoid valve 5 for water. The solenoid valve 1 for a water inlet and the solenoid valve 5 for water open the water feed line 6 based on the drive signal. The water pump 2 is turned ON based on the drive signal, and initiates the feed of water through the water feed line 6 into the multivalve 19 through the flow meter 4 for water, as shown in the timing chart (i) for the feed of diluting water of FIG. 11.

For example, t=0.2 sec after the opening of the solenoid valve 5 for water, the feed control unit 100 outputs a drive signal which is input into the rotator drive motor 22 in the constant volume flow regulator 16, and the solenoid valve 17 for syrup. Upon the receipt of the drive signal, the solenoid valve 17 for syrup opens the syrup feed line 18. As shown in FIG. 11 (ii), the rotator drive motor 22 starts to drive, for example, $t_1$ sec after the operation of opening of the solenoid valve 17 for syrup. The rotator drive motor 22 drives and rotates the set of circular gears 24 in a direction of rotation shown in FIG. 8C. The set of circular gears 24 allow the syrup, which is forced out from the syrup tank 14 by the pressure of carbon dioxide fed from the carbon dioxide bomb 13 and fed through the syrup feed line 18, to flow into the body 20 through the inflow port 20*a* in the constant volume flow regulator 16, and moves the syrup along the internal wall of the body 20 while holding the syrup in a space B defined by a portion, between the teeth of the circular gears 24, and the internal wall of the body 20 to continuously flow out from the outflow port 20*b*. The syrup is passed through the solenoid valve 17 for syrup and the syrup feed line 18, and reaches the multivalve 19. The multivalve 19 mixes the water fed through the water feed line 6 with the syrup fed through the syrup feed line 18 at a proper dilution ratio (a proper dilution level) to prepare a non-carbonated beverage having a proper syrup concentration which is then discharged.

Regarding the operation of feed of the syrup, the feed control unit 100 determines the speed of rotation of the set of circular gears 24 per minute in the constant volume flow regulator 16 by a calculation formula $M \cdot f \cdot 60/(R \cdot m)$ wherein f represents the frequency of pulses per sec output from the flow meter 4 for water; R represents the dilution ratio of a beverage previously stored in the memory 102; M represents the flow rate of diluting water per pulse in the flow meter; and m represents the delivery of syrup per revolution of the set of circular gears 24. The speed of rotation of the rotator drive motor 22 per minute can be determined from the speed of rotation of the circular gears 24 per minute determined by the above calculation formula and the reduction ratio of the rotator drive motor 22 and the circular gears 24. The feed control unit 100 outputs, based on the speed of rotation determined by the calculation formula, a drive signal which is input into the rotator drive motor 22.

As soon as the number of pulses output from the flow meter 4 for water reaches the reference number of pulses stored in the memory 102 for each beverage, the feed control unit 100 stops the drive of the solenoid valve 1 for a water inlet, the water pump 2, and the solenoid valve 5 for water. As shown in the timing chart (i) for the feed of the diluting water of FIG. 11A, this stops the feed of the diluting water. The feed control unit 100 stops sending the signal to the constant volume flow regulator 16 and the solenoid valve 17 for syrup, whereby, as shown in the timing chart (ii) for the feed of the syrup of FIG. 11A, the feed of syrup is stopped simultaneously with the stop of feed of the diluting water. When the feed of the syrup is stopped, as shown in FIG. 11B, the feed control unit 100 first stops the rotator drive motor 22 to stop the delivery of the syrup from the constant volume flow regulator 16 and, $t_2$ sec after the stop of the delivery of the syrup from the constant volume flow regulator 16, then stops sending the signal to the solenoid valve 17 for syrup to stop the feed of the syrup through the syrup feed line 18. The leak of the liquid from a set of circular gears 24 is prevented thereby, and it is prevented that the amount of the liquid which is fed is changed. Regarding the drive time for the solenoid valve 1 for a water inlet, the water pump 2, the solenoid valve 5 for water, and the rotator drive motor 22, which are operated based on the output pulse of the flow meter 4 for water, data stored in the memory 102 may be used which have been previously input, for example, by the input unit 60. For example, a method may be adopted wherein data on sale time based on the cup size are stored in the memory 102 and are used to selectively determine the drive time.

FIG. 12A shows a table exemplifying the reduction ratio of the reduction gear 21 for coping with various amounts of beverage fed in a proper voltage range of the rotator drive motor 22. For example, when the rotator drive motor 22 used in a beverage dispenser, which feeds a beverage at a rate of 80 cc/sec, is used in a beverage dispenser which feeds a beverage at a rate of 40 cc/sec, the speed of rotation of the rotator drive motor 22 should be halved. As a result, as shown in FIG. 12B, the voltage unfavorably deviates from the optimal voltage range. When the rotator drive motor 22 is used at a voltage outside the optimal voltage range, as shown in FIG. 12C, the torque of the rotator drive motor 22 is reduced. This renders the amount of syrup fed unstable. When the torque for a liquid as a pressurized fluid (for example, 0.35 MPa) is small, in some cases, the rotator drive motor 22 is not rotated. Further, in this case, the service life of the rotator drive motor 22 is often reduced.

In the beverage feeding apparatus, the amount of sale varies depending upon installation sites. For example, there are places where, since there are a large number of customers, a large flow rate is required in the beverage feeding apparatus, and places where the amount of sale is so small that only a small flow rate is required in the beverage feeding apparatus. Thus, the selection of a motor according to the necessary flow rate of syrup requires the provision of various motors according to the type of the apparatus and the installation site. For this reason, the reduction gear 21 is provided so that one rotator drive motor 22 has a satisfactory torque, and can stably feed syrup.

Figure 13A:
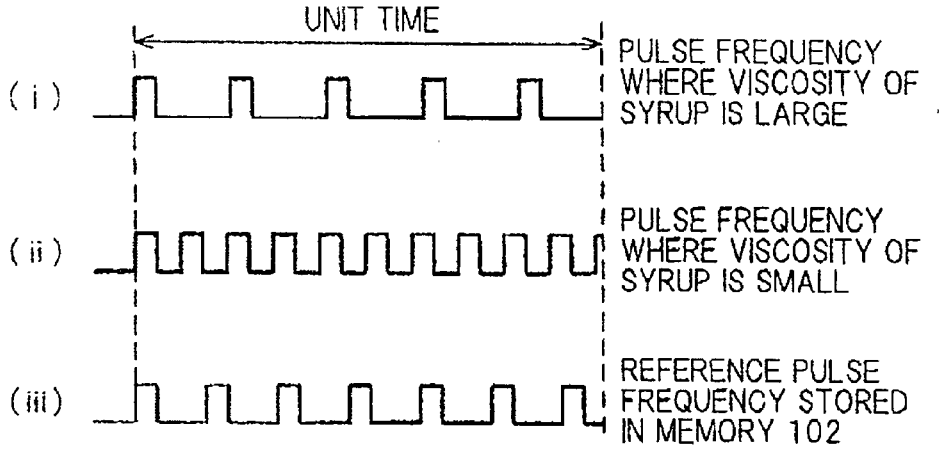
FIGS. 13A, 13B and 13C are diagrams showing the frequency of pulses output from an encoder in the first preferred embodiment of the invention.

FIG. 13 is a diagram showing the pulse frequency output from the encoder 50. For example, as shown in (i) of FIG. 13A, when the temperature is low and the viscosity of the syrup is high, the load applied to the rotator drive motor 22 for driving the circular gears 24 is increased, and, consequently, the speed of rotation is decreased. This results in a reduced frequency of pulses per unit time output from the encoder 50. Further, as shown in (ii) of FIG. 13A, when the temperature is high and, in addition, the viscosity of the syrup is low, the load applied to the rotator drive motor 22 for driving the circular gears 24 is reduced to increase the speed of rotation. This results in an increased frequency of pulses output from the encoder 50 per unit time. (iii) of FIG. 13A shows the reference pulse frequency per unit time required in delivering the syrup previously stored in the memory 102.

Figure 13B:
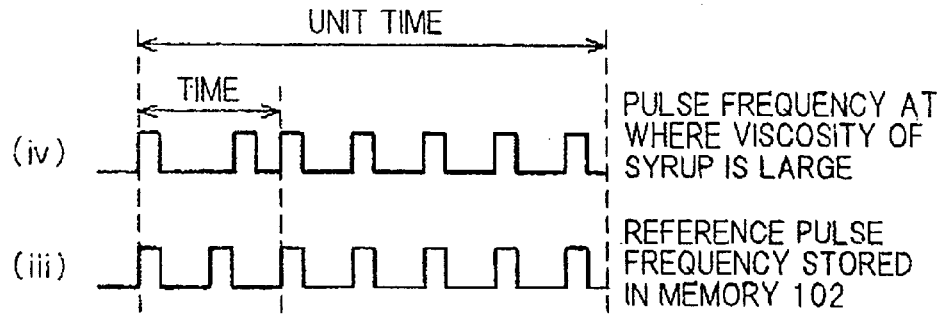
Figure 13C:
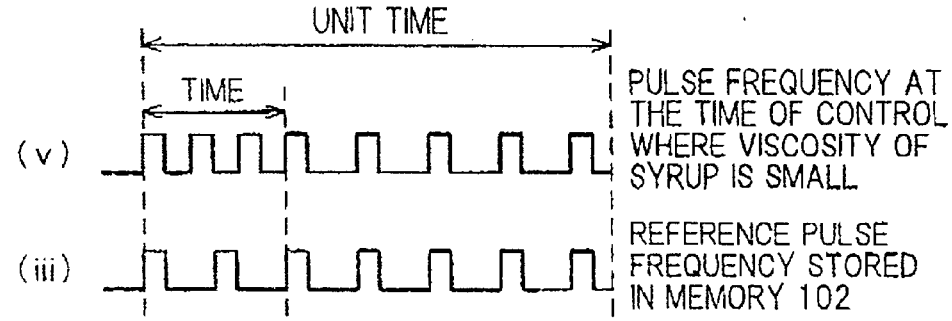

The feed control unit 100 compares at time t the frequency of pulses output from the encoder 50 with the reference pulse frequency stored in the memory 102 for each syrup or each beverage. When the frequency of pulses output from the encoder 50 is smaller than the reference pulse frequency stored in the memory 102 for each syrup or each beverage, as shown in FIG. 13B, the feed control unit 100 increases the value of voltage supplied to the rotator drive motor 22 to perform control as shown in a pulse waveform (iv). When the number of pulses output from the encoder 50 is larger than the reference pulse frequency stored in the memory 102 for each syrup or each beverage, as shown in FIG. 13C, the value of voltage supplied to the rotator drive motor 22 is reduced to perform control as shown in a pulse waveform (v). The speed of rotation of the rotator drive motor 22 is controlled so as to be the same as the reference pulse frequency previously stored in the memory 102. This permits a given volume of the syrup to be delivered in a predetermined time without undergoing an influence of the viscosity by regulating the speed of rotation of the rotator drive motor 22 even when the viscosity of the syrup has been varied due to a change in temperature.

The delivery of a liquid based on the set of circular gears 24 has been described on an embodiment wherein a single type of syrup is fed into the syrup feed line. However, even in the case where, for example, a mixed syrup prepared by mixing two or more types of syrup different from each other in density together or two or more types of syrup are continuously fed into the syrup feed line, a given volume of syrup can be continuously fed based on the rotation of the set of circular gears 24 without a fluctuation in flow rate caused according to the fluidity of the syrup.

Figure 14:
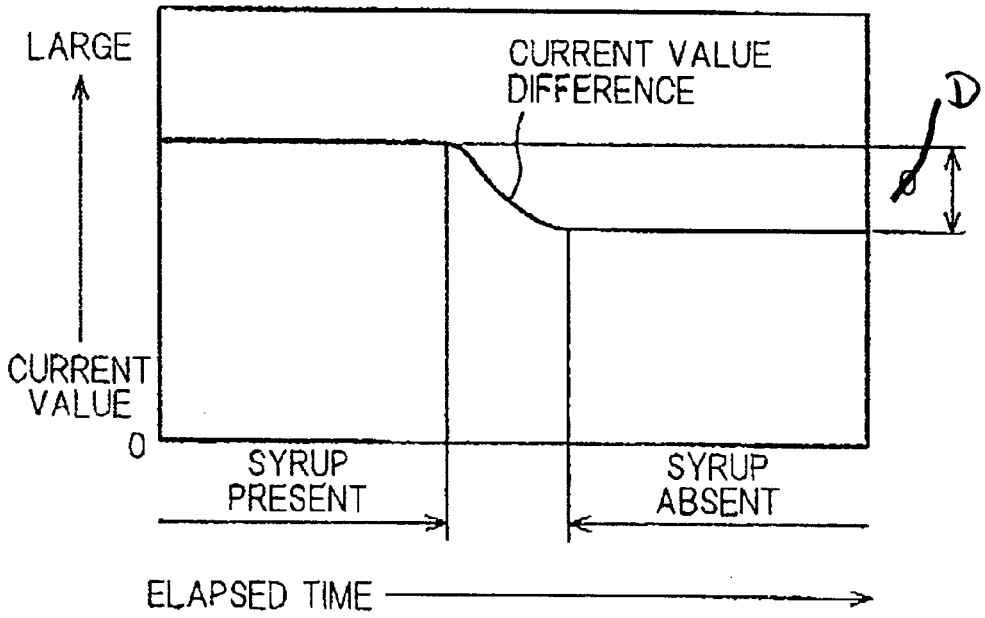
FIG. 14 is a diagram showing a change in current which flows across a rotator drive motor in the first preferred embodiment of the invention.

FIG. 14 is a diagram showing a change in the value of current flown through the rotator drive motor 22 at the time of the rotation of the circular gears 24. When the circular gears 24 are rotated in such a state that the interior of the body 20 in the constant volume flow regulator 16 is filled with syrup, a load is applied to the circular gears 24. This increases the value of current flown through the rotator drive motor 22. However, a reduction in syrup within the body 20 reduces the load applied to the circular gears 24. This reduces the value of current flown through the rotator drive motor 22 by a current value difference D. For example, a construction may be adopted wherein upon the detection of a change in a current value difference D, the feed control unit 100 may judge that the syrup within the body 20 has been used up, and give the sale switch 70 an instruction on the lighting of a beverage sold-out indication.

Further, a reduction in the amount of syrup within the body 20 reduces the load applied to the circular gears 24. This leads to a change in the frequency of pulses output from the encoder 50. Therefore, instead of the detection of a change in the value of current flown through the rotator drive motor 22, a change in the frequency of pulses output from the encoder 50 may be detected by the feed control unit 100. A construction may be adopted wherein, as soon as the feed control unit 100 detects that the change in the frequency of pulses exceeds an acceptable value, the feed control unit 100 may judge that the syrup within the body 20 has been used up, and give the sale switch 70 an instruction on the lighting of a beverage sold-out indication.

Further, in the constant volume flow regulator 16, in order to drive the circular gears 24 at a speed of rotation depending upon the dilution level or viscosity of the beverage, instead of storing the value of voltage or current supplied to the rotator drive motor 22 in the memory 102, time data representing the intermittent on-off intervals of the voltage supplied to the rotator drive motor 22 may be stored for each beverage in the memory 102. That is, intermittent supply of voltage to the rotator drive motor 22 based on the time data stored for each beverage in the memory 102 can also rotate the circular gears 24 at a speed of rotation depending upon the dilution ratio or viscosity of the beverage. Thus, a plurality of types of beverages may be delivered by a proper time depending upon the dilution level or viscosity of the beverage.

An example of a method for changing the voltage supplied to the rotator drive motor 22 is a resistance control method wherein a voltage regulator comprising a transistor or a variable resistor is provided between a power supply (not shown), located in the feed control unit 100, and the rotator drive motor 22 to vary the voltage. An example of a method for varying the intermittent on-off intervals of the voltage supplied to the rotator drive motor 22 is a pulse control method. In the pulse control method, the on or off state is repeated. Therefore, there is no power loss during off time. Even during on time, since the control transistor is completely saturated, the power loss is small.

According to the first preferred embodiment described above, the provision of a constant volume flow regulator 16 in a syrup feed line 18, the constant volume flow regulator 16 comprising a body 20 having a syrup inflow port 20*a* and a syrup outflow port 20*b*, a set of circular gears 24 for moving syrup from the inflow port 20*a* to the outflow port 20*b* along the internal wall of the body 20, and a rotator drive motor 22 for driving the set of circular gears 24, permits the delivery of the syrup to be controlled based on the speed of rotation (the number of revolutions per unit time) of the circular gears 24 and a volume determined by multiplying a volume of a space B defined by a portion, between the teeth of the set of circular gears 24 which are rotated respectively in directions opposite to each other, and the internal wall of the body 20 by the number of teeth of the circular gears 24. Thus, a given volume of the syrup can be continuously and surely delivered by controlling the speed of rotation of the circular gears 24 even when the viscosity of the syrup has been varied, for example, due to a change in temperature.

Further, since a given volume of syrup is flown based on the rotational motion of the set of circular gears 24, the flow of the syrup is less likely to be influenced by the type of syrup, the pressure of carbon dioxide, or a fluctuation in viscosity. Therefore, the syrup is continuously delivered in a single direction from the body 20 to the outflow port 20*b* at the same speed as the syrup flown through the inflow port 20*a* into the body 20. This can realize the delivery of syrup with a high metering accuracy.

Further, since syrup pressurized by the pressure of carbon dioxide is fed into the constant volume flow regulator 16, the additional effect of a reduction in delivery of syrup due to pressure loss by the circular gears 24 and an increase in delivery of syrup based on the receipt of syrup pressurized by the pressure of carbon dioxide in driving the circular gears 24 by the rotator drive motor 22 can broaden a syrup delivery range in which the delivery of syrup can be regulated. Further, the backward flow of the syrup toward the syrup tank 14 can be prevented. Furthermore, the force necessary for delivering the syrup by driving the circular gears 24 through the rotator drive motor 22 can be reduced by a force applied by the pressure of carbon dioxide. Therefore, the self-absorption is so small that the size of the rotator drive motor 22 can be reduced. This contributes to a reduction in cost.

The above-described constant volume flow regulator 16 delivers a given volume of a liquid downward at a certain number of revolutions. Therefore, the constant volume flow regulator 16 can be used as a flow meter under certain conditions. In general, when the constant volume flow regulator 16 is used as the flow meter, minimizing the pressure loss within piping for the liquid is ideal. Since the set of rotators are rotated by a pressurized liquid, the pressure loss can be reduced, permitting the liquid to be stably fed without sacrificing the accuracy of detection of the flow rate. The pressure loss within the piping for the liquid varies depending upon the shape of the rotator. For example, the use of triangular rice ball-type gears or oval gears as the rotator instead of the circular gears 24 described in connection with the first preferred embodiment permits the pressure conveyed through the liquid to more effectively act as external force which accelerates the rotation of the rotators. Therefore, for example, even when the viscosity of the liquid is large, the pressure loss can be reduced. Alternatively, rotators other than the gears may be used including rotators having a smooth peripheral surface (cocoon-type or clover-type rotators) which will be described later.

Further, the provision of a reduction gear 21 having a reduction ratio set so as for the rotator drive motor 22 to be driven within an optimal voltage range depending upon the now rate of the syrup enables even a small motor to stably drive the set of circular gears 24 by selecting a [property] proper voltage range in which good drive efficiency can be realized. This can contribute to a reduction in size of the apparatus and a reduction in cost. In addition, the drive in the optimal voltage range call prevent a lowering in service life of the rotator drive motor 22.

In the first preferred embodiment as described above, a solenoid valve has been used as valve means for feeding diluting water or syrup into the multivalve 19. The valve means, however, is not limited to the solenoid valve. Specifically, any valve means may be used so far as diluting water or syrup is fed by opening the valve while the feed of the diluting water or syrup is stopped by closing the valve. For example, an electric motor may be used to open and close the valve. Further, the frequency or number of pulses output from the flow meter 4 for water and the ratio of the amount of diluting water, such as water, to the amount of syrup, that is, dilution ratio (dilution level), may be freely input for each beverage through the input unit 60, for example, when a beverage feeding apparatus is installed, and may be stored in the memory 102. The same function and effect can be attained in the operation of feed of the above-described non-carbonated beverage, as well as in the operation of feed of carbonated beverages.

In the first preferred embodiment, a construction in which the delivery control is carried out based on the flow rate of diluting water or syrup was illustrated, but for example, signals corresponding to the flow rates from the water flow meter 4 and the carbonate flow meter 9 may be input in the main controller 100, and the main controller 100 can also carry out the liquid delivery control based on the flow rate of the liquid.

Figure 2:
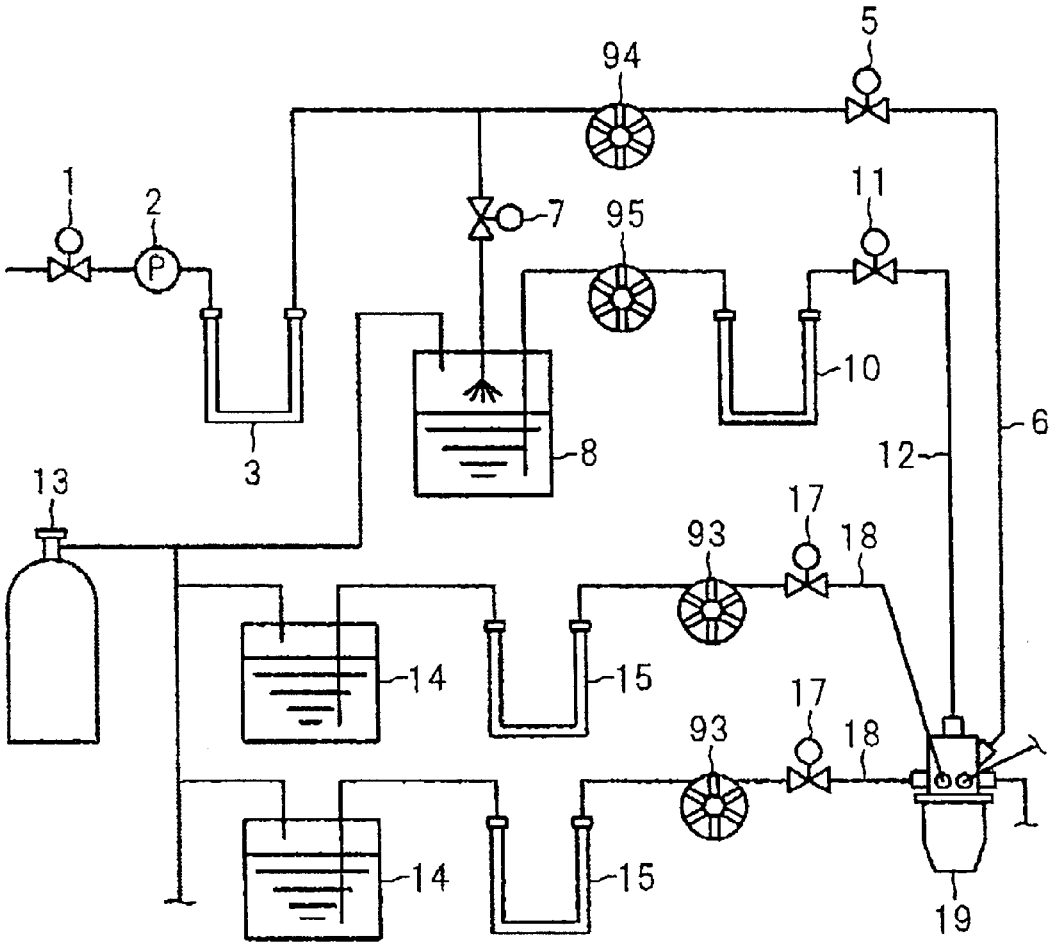
FIG.2 PRIOR ART
FIG. 2 is a schematic diagram showing the construction of a conventional beverage feeding apparatus provided with a flow meter in each of a syrup feed line and a diluting water feed line.
Figure 3:
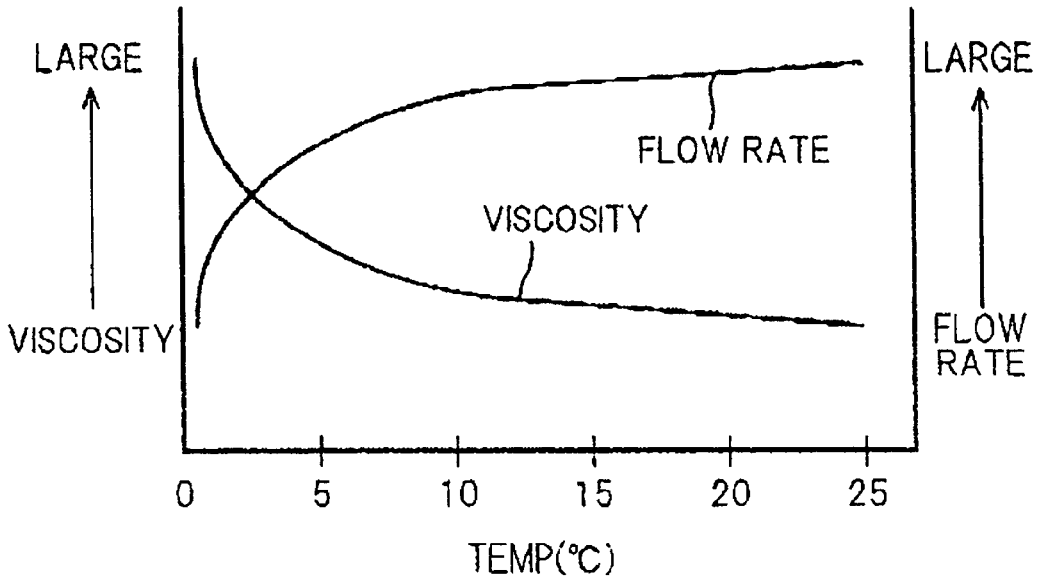
FIG.3 PRIOR ART
FIG. 3 is a diagram showing a change in viscosity and flow rate of syrup upon a change in temperature.
Figure 4:
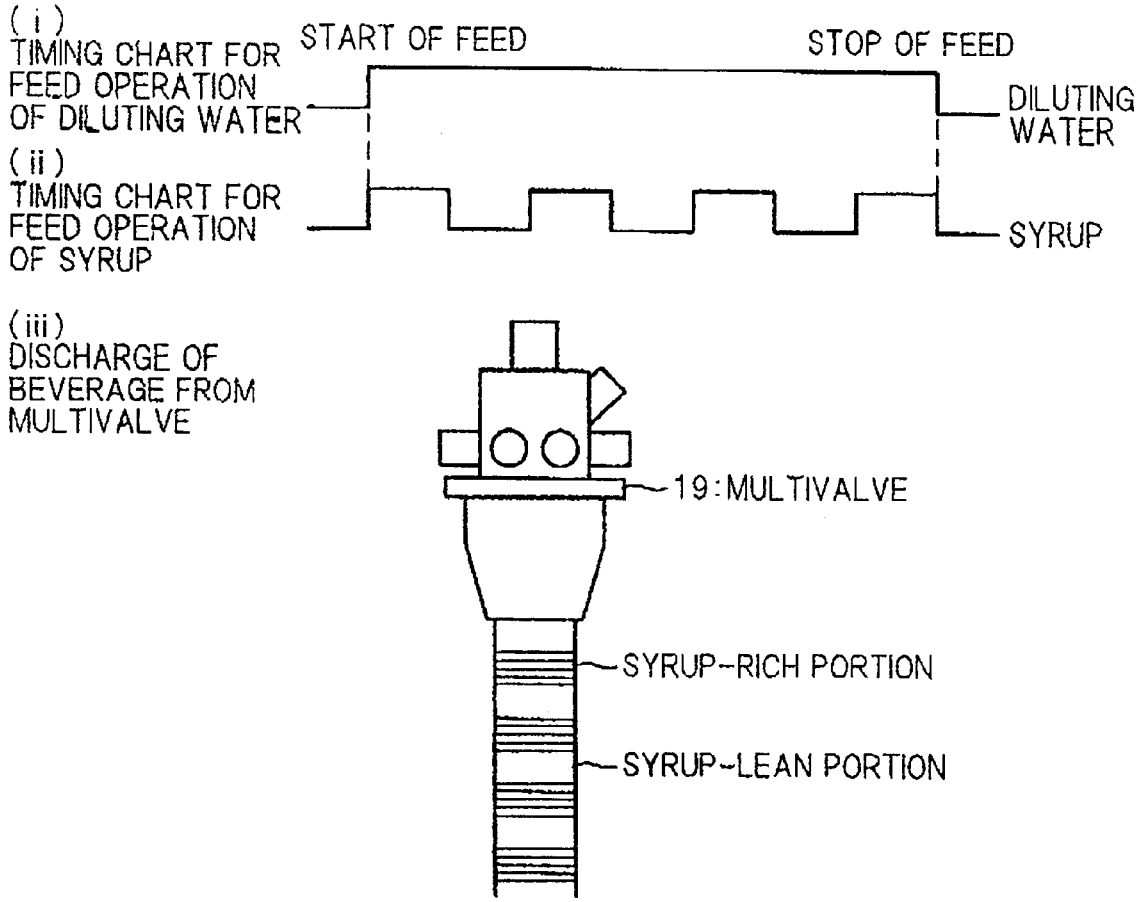
FIG.4 PRIOR ART
FIG. 4 is a diagram showing a timing chart for the operation of the feed of syrup and the operation of the feed of diluting water and the discharge of a beverage from a multivalve according to a prior art technique.
Figure 5:
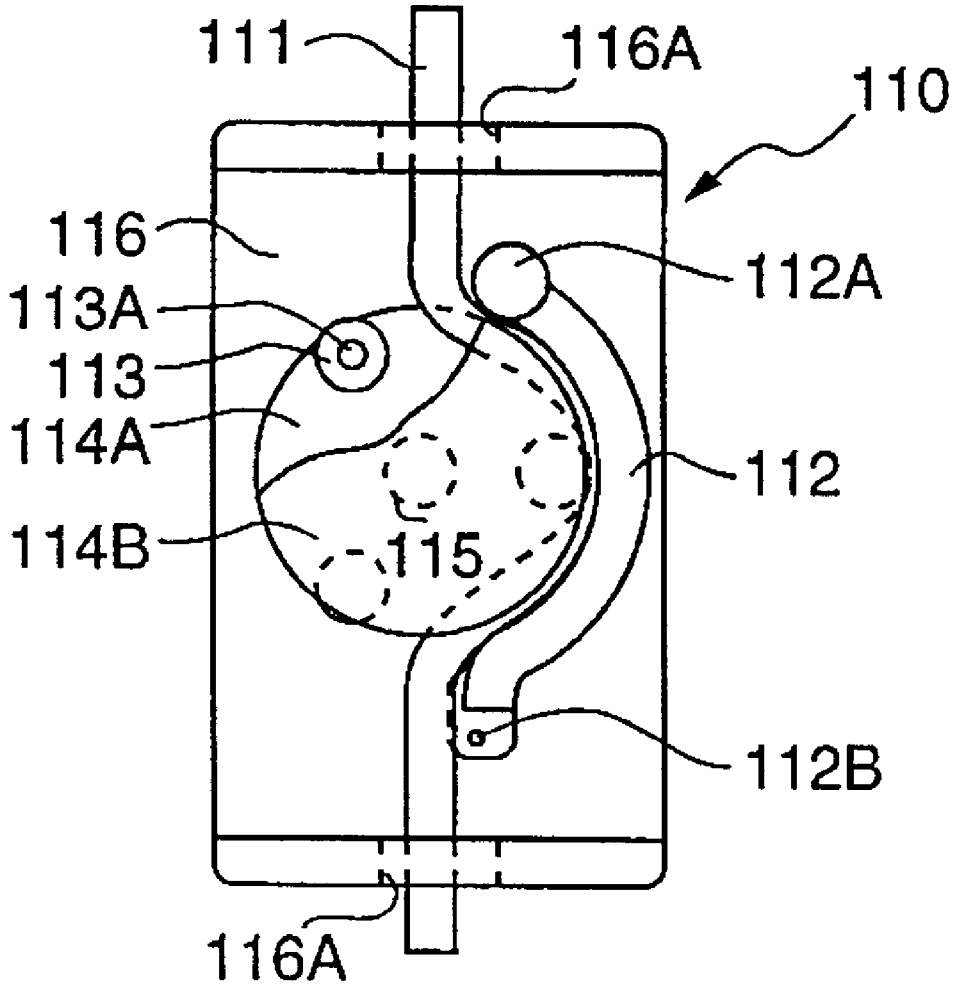
FIG.5 PRIOR ART
FIG. 5 is a schematic diagram showing the construction of a conventional tube pump.
Figure 6A:
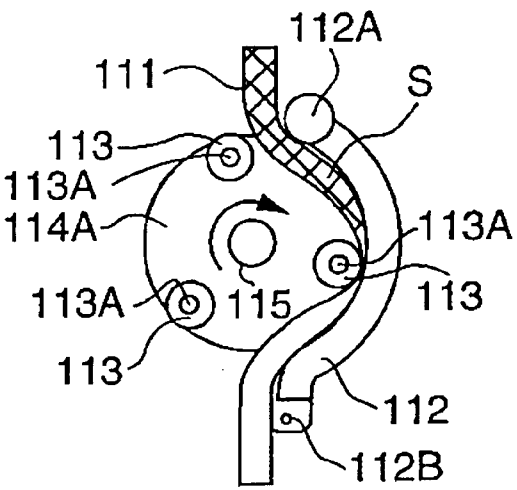
FIG.6A PRIOR ART
FIGS. 6A, 6B and 6C are diagrams showing the operation of a conventional tube pump.
Figure 6B:
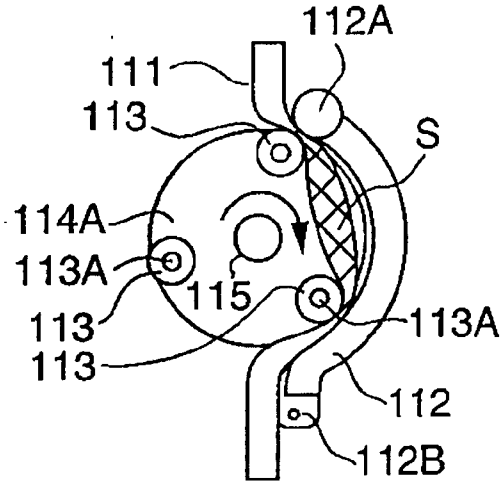
FIG.6B PRIOR ART
Figure 6C:
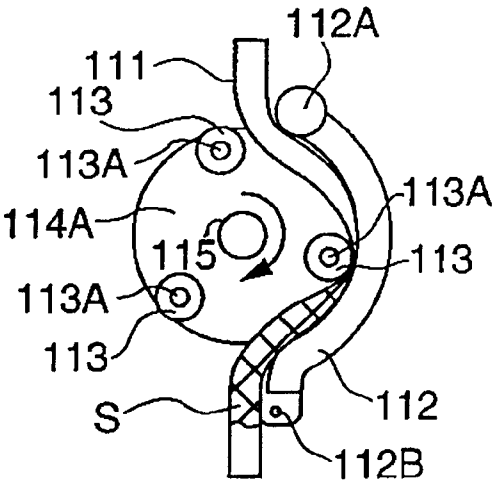
FIG.6C PRIOR ART
Figure 15A:
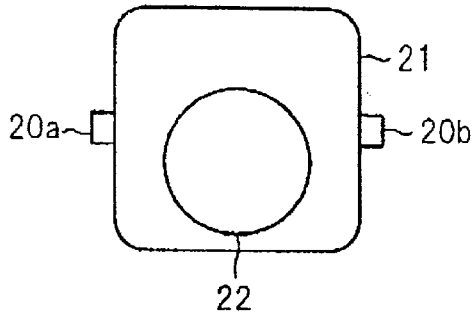
FIGS. 15A, 15B and 15C are schematic diagrams showing the construction of a set of rotators, which are two triangular rice ball-type gears, as a constant volume of flow regulator used in the second preferred embodiment of the invention.
Figure 15B:
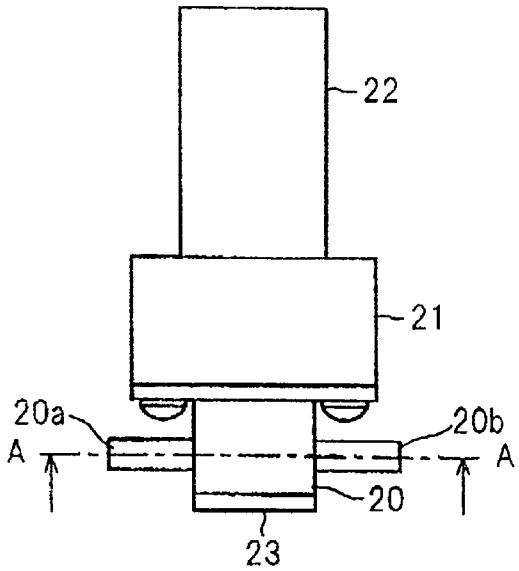
Figure 15C:
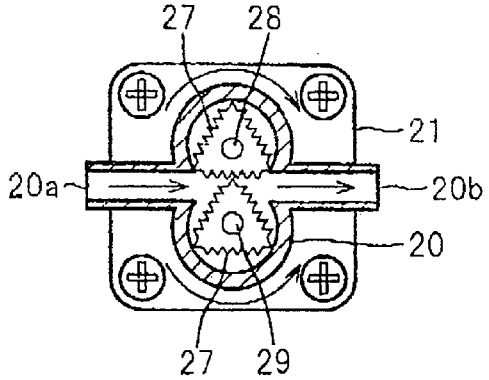
Figure 16A:
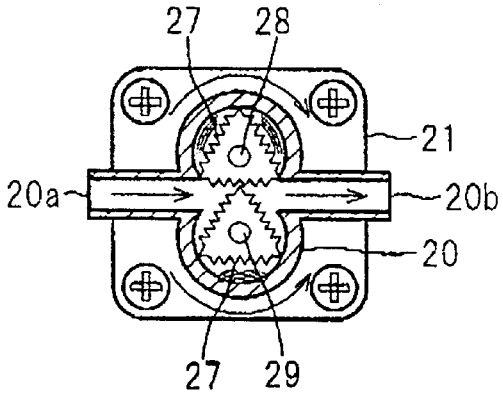
FIGS. 16A, 16B and 16C are diagrams illustrating the sequential delivery of a liquid as a result of the rotation of the two triangular rice ball-type gears as a constant volume flow regulator in the second preferred embodiment of the invention.
Figure 16B:
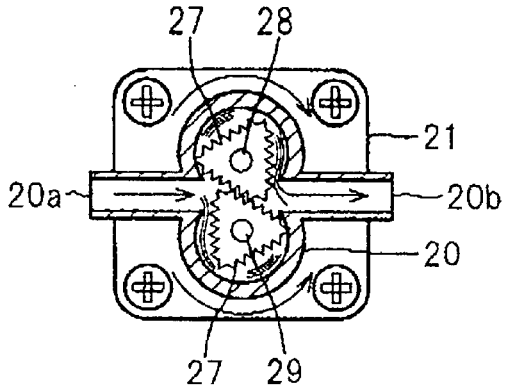
Figure 16C:
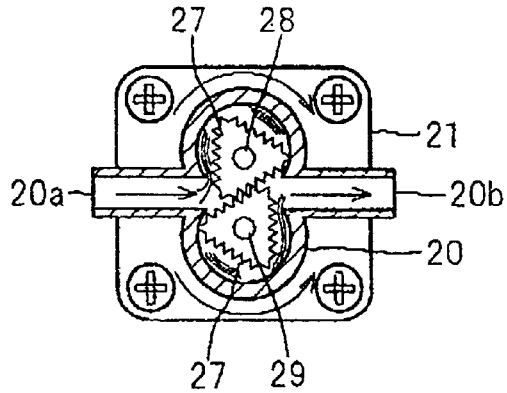
Figure 16D:
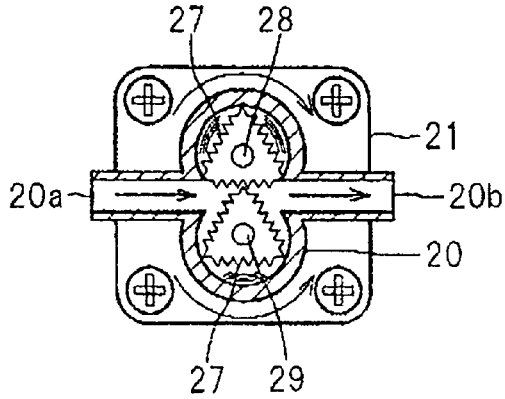

FIG. 15 is a diagram showing the construction of a constant volume flow regulator 16 according to the second preferred embodiment of the invention which comprises a set of rotators constituted by two triangular rice ball-type gears (polygonal gears) including drive gears and engaged with each other and moves a liquid material from the inflow port to the outflow port along the internal wall of the body while holding the liquid material in a space defined by the side wall of the set of triangular rice ball-type gears and the internal wall of the body. FIG. 15A shows the constant volume flow regulator in its state as viewed from the plan, FIG. 15B the constant volume flow regulator in its state as viewed from the side, and FIG. 15C the cross section taken on line A—A of FIG. 15B as viewed from a direction indicated by arrows. In FIG. 2 showing the first preferred embodiment of the invention and FIG. 15 showing the second preferred embodiment of the invention, like parts have the same reference numerals to omit the repetition of the explanation of the same construction. This constant volume flow regulator 16 delivers a given volume of syrup in a continuous manner by moving the syrup forced out from the syrup tank 14 to the outflow port side along the internal wall of the body by the pressure of carbon dioxide fed from the carbon dioxide bomb 13 while holding the syrup in a space defined by the side wall of triangular rice ball-type gears and the internal wall of the body. The set of triangular rice ball-type gears 27 provided within the body 20 are two polygonal gears which each have at least three sides, have teeth fabricated on the rotational face, and are rotated while engagement with each other. The set of triangular rice ball-type gears 27 are rotatably supported by shafts 28 (drive side) and 29 (driven side) which are supported on the body 20 and the lid 23. Upon the drive of the shaft 28 through the reduction gear 21 in the state of coupling with the rotating shaft of the rotator drive motor 22, the set of triangular rice ball-type gears 27 are rotated in directions indicated by respective arrows.

Further, an encoder 50 (not shown) is provided which outputs pulses in synchronization with the speed of rotation of the rotator drive motor 22 for detecting the speed of rotation of the triangular rice ball-type gears 27 (the speed of rotation of the rotator drive motor 22 driven in the state of coupling with the shaft 28 through the reduction gear 21).

In the constant volume flow regulator 16 according to the second preferred embodiment, upon the rotation of the set of triangular rice ball-type gears 27, the syrup forced out from the syrup tank 14 by the pressure of carbon dioxide flows through the inflow port 20*a* into the body 20, is delivered to the outflow port 20*b* along the internal wall of the body 20 while being held in a space defined by the side wall of the triangular rice ball-type gears 27 and the internal wall of the body 20, and then flows out from the outflow port 20*b*. The amount of syrup delivered, during a period in which the set of triangular rice ball-type gears 27 are rotated by one turn, is six times larger than the volume of the space defined by the side wall of the triangular rice ball-type gears 27 and the internal wall of the body 20. Therefore, the delivery of syrup can be controlled by the volume of the space defined by the side wall of the triangular rice ball-type gears 27 and the internal wall of the body 20 and the speed of rotation (the number of revolutions per unit time) of the triangular rice ball-type gears 27. The syrup is delivered to the outflow port 20*b* along the internal wall of the body 20 while being held in a space defined by the side wall of the triangular rice ball-type gears 27 and the internal wall of the body 20, and flows out from the outflow port 20*b*. Therefore, a given volume of syrup can be surely delivered by controlling the speed of rotation of the triangular rice ball-type gears 27.

FIG. 16 is a diagram illustrating the sequential delivery of a liquid material as a result of the rotation of the set of triangular rice ball-type gears 27 in the constant volume flow regulator 16 shown in FIG. 15. FIG. 16A illustrates the holding of syrup in three spaces defined by the side wall of the triangular rice ball-type gears 27 supported on the shafts 28, 29 and the internal wall of the body 20. Upon the rotation of the set of triangular rice ball-type gears 27 to create a state shown in FIG. 16B, the syrup held in the space defined by one side wall of the triangular rice ball-type gears 27 supported on the shaft 28 and the internal wall of the body 20 is transferred along the internal wall of the body 20, reaches the outflow port 20*b*, and flows out from the outflow port 20*b*. In addition, syrup, which has been fed by feeding means and flowed through the inflow port 20*a* into the body 20, is incorporated into a space defined by the side wall of the triangular rice ball-type gears 27 supported on the shaft 29 and the internal wall of the body 20. Further, upon the rotation of the set of triangular rice ball-type gears 27 to create a state shown in FIG. 16C, the syrup held in the space defined by one side wall of the triangular rice ball-type gears 27 supported on the shaft 29 and the internal wall of the body 20 is transferred along the internal wall of the body 20, reaches the outflow port 20*b*, and flows out from the outflow port 20*b*. In addition, syrup, which has been fed by feeding means and flowed through the inflow port 20*a* into the body 20, is incorporated into a space defined by the side wall of the triangular rice ball-type gears 27 supported on the shaft 28 and the internal wall of the body 20. Upon the rotation of the set of the triangular rice ball-type gears 27 from the state shown in FIG. 16C to create a state shown in FIG. 16D, the syrup is held in three spaces defined by the side wall of the triangular rice ball-type gears 27 supported on the shafts 28, 29 and the internal wall of the body 20. The above operations are sequentially repeated, and, as soon as the set of triangular rice ball-type gears 27 are rotated by a preset number of times, the delivery of a predetermined amount of syrup is completed to terminate the rotation of the triangular rice ball-type gears 27.

According to the above-described second preferred embodiment, the use of a set of triangular rice ball-type gears 27 as a set of rotators can provide, in addition to advantageous property attained by the first preferred embodiment, an effect such that the amount of the syrup delivered by one revolution of the set of triangular rice ball-type gears 27 can be made larger than that in the case of the set of circular gears. Further, it should be noted that a single delivery corresponds to one-third revolution. Therefore, as compared with the combination of the circular gears, the pressure loss within the piping for the liquid can be reduced, although a pulsation occurs. Therefore, the construction according to the second preferred embodiment of the invention is suitable for use as a flow meter.

Figure 17A:
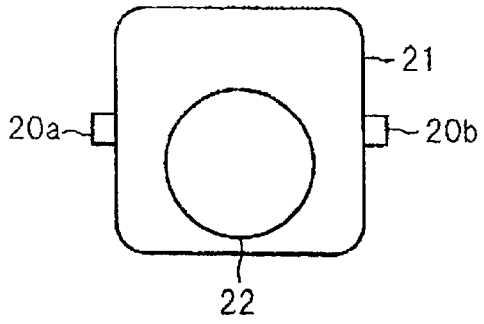
FIGS. 17A, 17B and 17C are diagrams showing the construction of a set of rotators, which are two oval gears, as a constant volume flow regulator used in the third preferred embodiment of the invention.
Figure 17B:
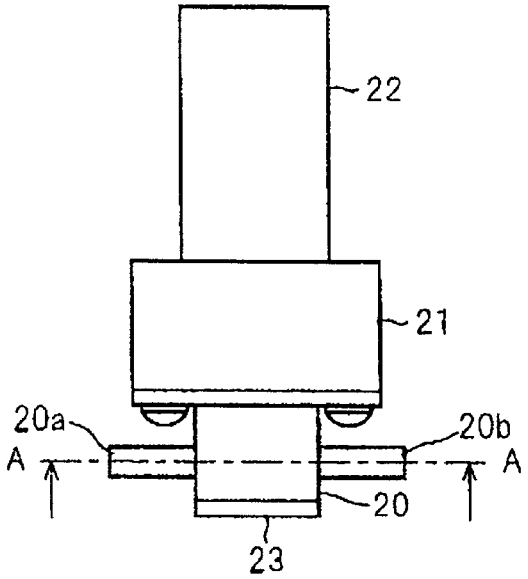
Figure 17C:
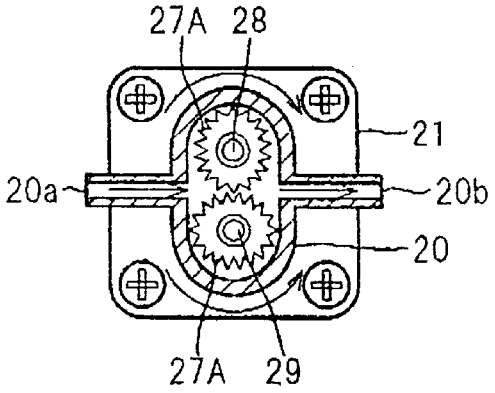
Figure 18A:
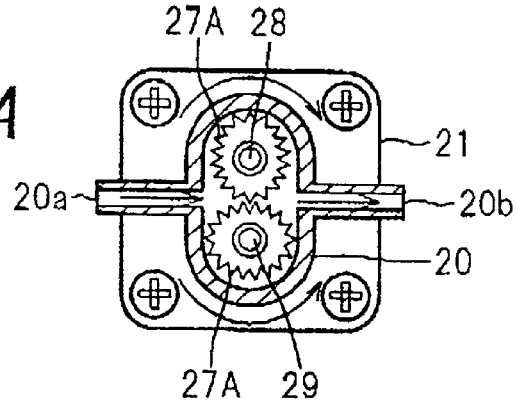
FIGS. 18A, 18B, 18C and 18D are diagrams illustrating the sequential delivery of a liquid as a result of the rotation of the two oval gears as a constant volume flow regulator in the third preferred embodiment of the invention.
Figure 18B:
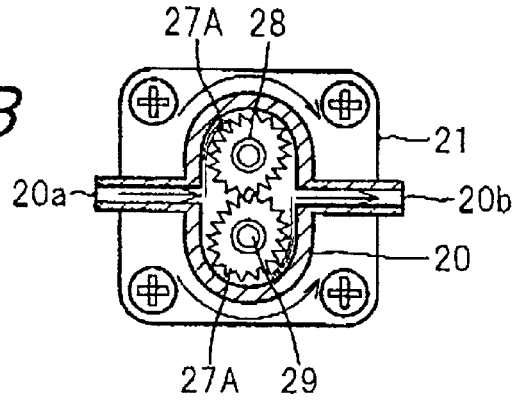
Figure 18C:
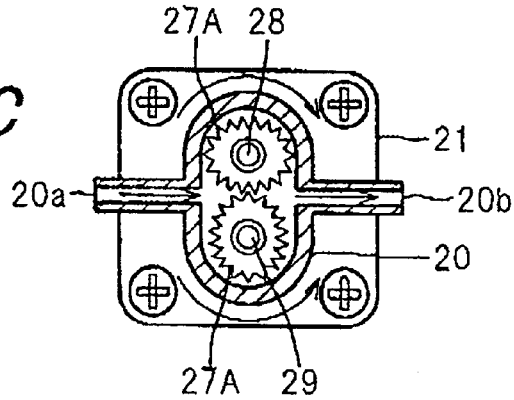
Figure 18D:
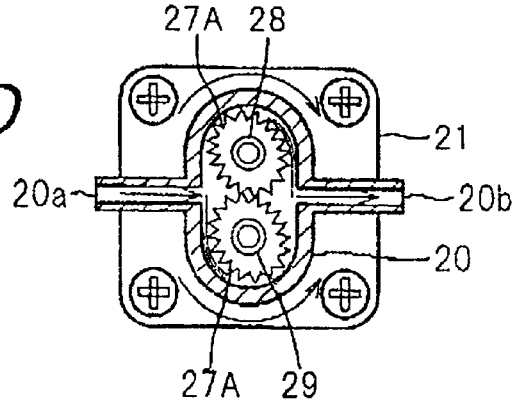

FIG. 17 is a diagram showing the construction of a constant volume flow regulator 16 according to the third preferred embodiment of the invention which comprises a set of rotators constituted by two oval gears including drive gears and engaged with each other and moves a liquid from the inflow port to the outflow port along the internal wall of the body while holding the liquid in a space defined by the side wall of the oval gears and the internal wall of the body. FIG. 17A shows the constant volume flow regulator in its state as viewed from the plan, FIG. 17B the constant volume flow regulator in its state as viewed from the side, and FIG. 17C the cross section taken on line A—A of FIG. 17B as viewed from a direction indicated by arrows. In FIG. 12 showing the first preferred embodiment of the invention and FIG. 17 showing the third preferred embodiment of the invention, like parts have the same reference numerals to omit the repetition of the explanation of the same construction. This constant volume flow regulator 16 delivers a given volume of syrup in a continuous manner by moving the syrup forced out from the syrup tank 14 to the outflow port side along the internal wall of the body by the pressure of carbon dioxide fed from the carbon dioxide bomb 13 while holding the syrup in a space defined by the side wall of the oval gears and the internal wall of the body. The set of oval gears 27A provided within the body 20 are oval, have teeth fabricated on the rotational face, and are rotated while engagement with each other. The set of oval gears 27A are rotatably supported by shafts 28 (drive side) and 29 (driven side) which are supported on the body 20 and the lid 23. Upon the drive of the shaft 28 in the state of coupling with the rotating shaft of the rotator drive motor 22, the set of oval gears 27A are rotated in directions indicated by respective arrows.

Further, an encoder 50 (not shown) is provided which outputs pulses in synchronization with the speed of rotation of the rotator drive motor 22 for detecting the speed of rotation of the oval gears 27A (the speed of rotation of the rotator drive motor 22 driven in the state of coupling with the shaft 28).

In the constant volume flow regulator 16 according to the third preferred embodiment, upon the rotation of the set of oval gears 27A, the syrup forced out from the syrup tank 14 by the pressure of carbon dioxide flows through the inflow port 20*a* into the body 20, is delivered to the outflow port 20*b* along the internal wall of the body 20 while being held in a space defined by the side wall of the oval gears 27A and the internal wall of the body 20, and then flows out from the outflow port 20*b*. The amount of syrup delivered, during a period in which the set of oval gears 27A are rotated by one turn, is four times larger than the volume of the space defined by the side wall of the oval gears 27A and the internal wall of the body 20. Therefore, the delivery of syrup can be controlled by the volume of the space defined by the side wall of the oval gears 27A and the internal wall of the body 20 and the speed of rotation (the number of revolutions per unit time) of the oval gears 27A. The syrup is delivered to the outflow port 20*b* along the internal wall of the body 20 while being held in a space defined by the side wall of the oval gears 27A and the internal wall of the body 20, and flows out from the outflow port 20*b*. Therefore, a given volume of syrup can be surely delivered by controlling the speed of rotation of the oval gears 27A.

Instead of the construction wherein the set of rotators constituted by the two oval gears engaged with each other hold a liquid from the inflow port in a space defined by the side wall of the oval gears and the internal wall of the body and moves the liquid along the internal wall of the body toward the outflow port side, a construction may be adopted wherein the constant volume flow regulator 16 is constituted by a set of rotators which are two clover-type (for example, a three-leaf clover-type) gears having teeth fabricated on the rotational face and engaged with each other, and are rotated while engagement with each other. In this construction, a liquid from the inflow port can be held in a space defined by the side wall of the three-leaf clover-type gears and the internal wall of the body, and can be moved toward the outflow port side along the internal wall of the body. When the set of rotators are constituted by the two three-leaf clover-type gears, the amount of syrup delivered, during a period in which the set of three-leaf clover-type gears are rotated by one turn, is six times larger than the volume of the space defined by the side wall of the three-leaf clover-type gears and the internal wall of the body.

FIG. 18 is a diagram illustrating the sequential delivery of a liquid as a result of the rotation of the set of oval gears in the constant volume flow regulator 16 shown in FIG. 17. FIG. 18A illustrates the holding of syrup in a space defined by the side wall of the oval gears 27A supported on the shaft 29 and the internal wall of the body 20. Upon the rotation of the set of oval gears 27A to create a state shown in FIG. 18B, the syrup held in the space defined by the side wall of the oval gears 27A supported on the shaft 29 and the internal wall of the body 20 is transferred along the internal wall of the body 20, reaches the outflow port 20*b*, and flows out from the outflow port 20*b*. In addition, syrup, which has been forced out from the syrup tank 14 by the pressure of carbon dioxide fed from the carbon dioxide bomb 13 and flowed through the inflow port 20*a* into the body 20, is incorporated into a space defined by the side wall of the oval gears 27A supported on the shaft 28 and the internal wall of the body 20. Further, upon the rotation of the set of oval gears 27A to create a state shown in FIG. 18C, the syrup is held in a space defined by the side wall of the oval gears 27A supported on the shaft 28 and the internal wall of the body 20. Upon the rotation of the set of the oval gears 27A from the state shown in FIG. 18C to create a state shown in FIG. 18D, the syrup held in a space defined by the side wall of the oval gears 27A supported on the shaft 28 and the internal wall of the body 20 is transferred along the internal wall of the body 20, reaches the outflow port 20*b*, and flows out from the outflow port 20*b*. In addition, the syrup, which has been forced out from the syrup tank 14 by the pressure of carbon dioxide fed from the carbon dioxide bomb 13 and flown through the inflow port 20*a* into the body 20, is incorporated into a space defined by the side wall of the oval gears 27A supported on the shaft 29 and the internal wall of the body 20. The above operations are sequentially repeated, and, as soon as the set of oval gears 27A are rotated by a preset number of times, the delivery of a predetermined amount of syrup is completed to terminate the rotation of the oval gears 27A.

Figure 19:
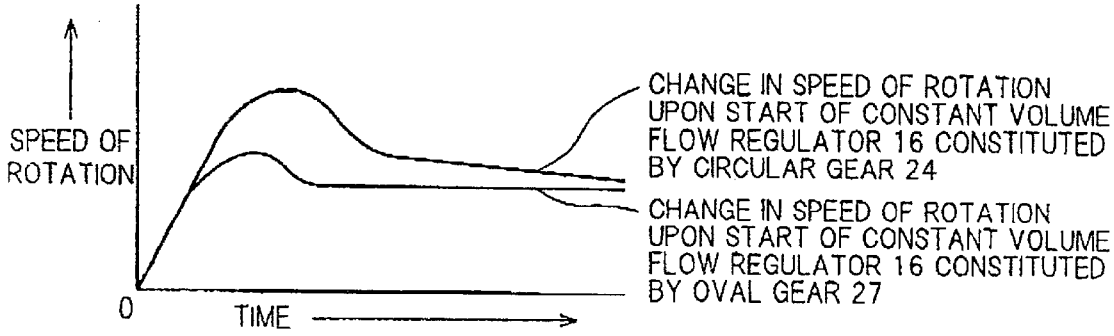
FIG. 19 is a diagram showing a change in speed of rotation upon the start of the constant volume flow regulator in the third preferred embodiment of the invention.

FIG. 19 is a diagram showing a change in speed of rotation upon the start of the rotator drive motor 22, for a case where the rotators in the constant volume flow regulator 16 are constituted by oval gears 27A, and a case where the rotators are constituted by circular gears 24. As compared with the circular gears 24, the oval gears 27A are exposed to a higher pressure of syrup forced out from the syrup tank 14 by the pressure of carbon dioxide fed from the carbon dioxide bomb 13, and, as soon as the solenoid valve 17 for syrup is opened, the pressure of syrup permits the oval gears 27A as such to begin to rotate. Therefore, the torque necessary for the start of the rotator derive motor 22 may be small. This can shorten the time necessary for the speed of rotation of the oval gears 27A to be brought to a stable one.

According to the above-described third preferred embodiment, the use of a set of oval gears 27A as a set of rotators can provide, in addition to advantageous property attained by the first preferred embodiment, an effect such that the time necessary for the speed of rotation of the rotator drive motor 22 to be brought to a stable one at the time of start of the rotator drive motor 22 can be shortened and the oval gears 27A can provide good delivery properties suitable for use as a constant volume flow regulator 16 for delivering a given volume of a liquid. Further, even after the speed of rotation of the oval gears 27A reaches the stable one, receiving syrup fed under pressure based on the pressure of carbon dioxide can reduce the torque necessary for the rotator drive motor 22 to rotate the oval gears 27A. By virtue of this, the value of current supplied from the feed control unit 100 to the rotator drive motor 22 can be made smaller than that in the case of the circular gears 24. This can contribute to power saving.

Figure 20A:
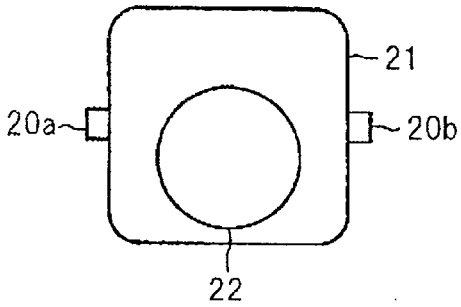
FIGS. 20A, 20B and 20C are diagrams showing the construction of a set of rotators, which are two cocoon type rotators, as a liquid delivery apparatus used in the fourth preferred embodiment of the invention.
Figure 20B:
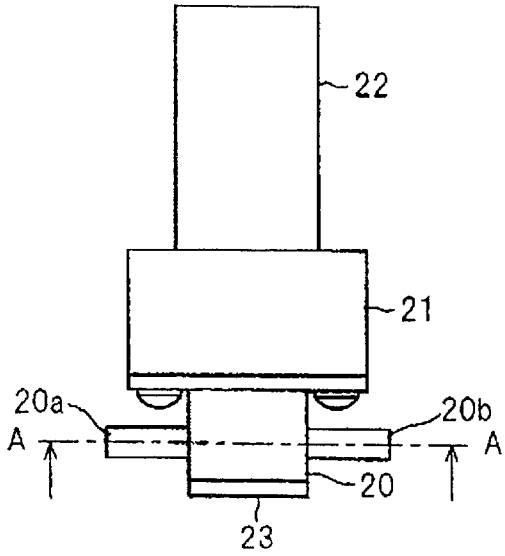
Figure 20C:
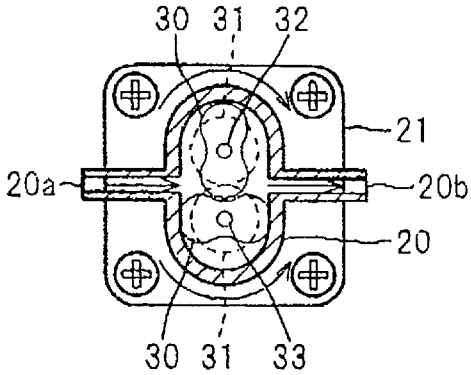
Figure 21A:
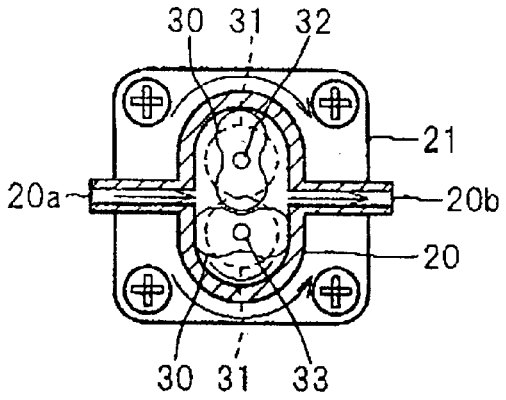
Figure 21B:
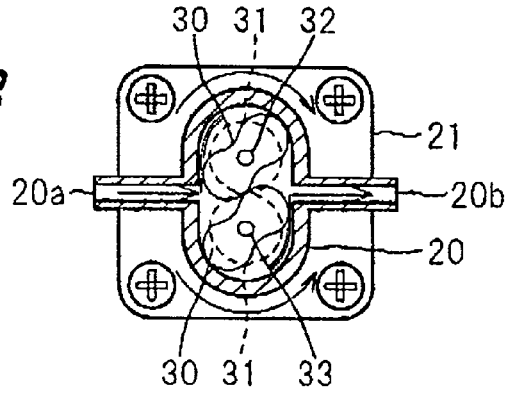
Figure 21C:
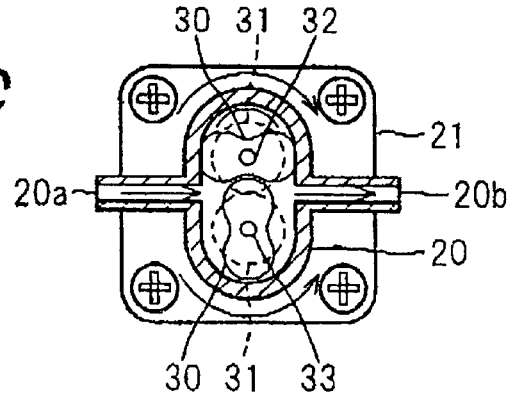
Figure 21D:
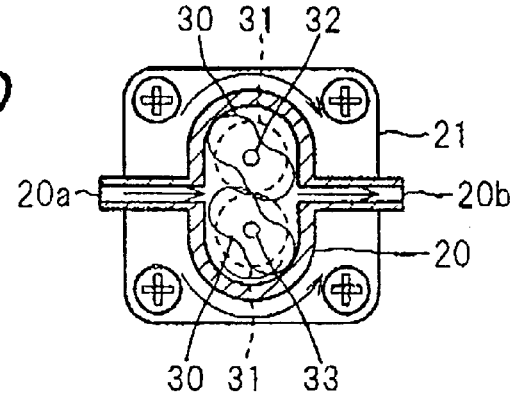

FIG. 20 is a diagram showing the construction of a constant volume flow regulator 16 according to the fourth preferred embodiment of the invention which comprises a set of rotators comprising: two cocoon-type rotators; and two gears coaxially linked respectively to the two cocoon-type rotators to rotate the two cocoon-type rotators in the state of interlocking with each other. This constant volume flow regulator 16 holds a liquid from the inflow port in a space defined by the side wall of the cocoon-type rotators and the internal wall of the body, and moves the liquid to the outflow port along the internal wall of the body. FIG. 20A shows the constant volume flow regulator in its state as viewed from the plan, FIG. 20B the constant volume flow regulator in its state as viewed from the side, and FIG. 20C the cross section taken on line A—A of FIG. 20B as viewed from a direction indicated by arrows. In FIG. 12 showing the first preferred embodiment of the invention and FIG. 20 showing the fourth preferred embodiment of the invention, like parts have the same reference numerals to omit the repetition of the explanation of the same construction. This constant volume flow regulator 16 delivers a given volume of syrup in a continuous manner by moving the syrup forced out from the syrup tank 14 to the outflow port side along the internal wall of the body by the pressure of carbon dioxide fed from the carbon dioxide bomb 13 while holding the syrup in a space defined by the side wall of the cocoon-type rotators and the internal wall of the body. Within the body 20 are provided a set of cocoon-type rotators 30 (rotators) and a set of gears 31 which are provided within a motor bracket 21 and are coaxially linked respectively to the set of cocoon-type rotators 30 to rotate the set of cocoon-type rotators 30 in the state of interlocking with each other. The set of cocoon-type rotators 30 are in the form of a cocoon having a smooth surface, are not in contact with each other, and are rotatably supported by shafts 32 (drive side) and 33 (driven side) which are supported on the body 20 and the lid 23. Upon the drive of the shaft 32 in the state of coupling with the rotating shaft of the rotator drive motor 22, the set of cocoon-type rotators 30 are rotated in directions indicated by respective arrows.

Further, an encoder 50 (not shown) is provided which outputs pulses in synchronization with the speed of rotation of the rotator drive motor 22 for detecting the speed of rotation of the cocoon-type rotators 30 (the speed of rotation of the rotator drive motor 22 driven in the state of coupling with the shaft 32).

In the constant volume flow regulator 16 according to the fourth preferred embodiment, upon the rotation of the set of cocoon-type rotators 30, the syrup forced out from the syrup tank 14 by the pressure of carbon dioxide fed from the carbon dioxide bomb 13 flows through the inflow port 20*a* into the body 20, is delivered to the outflow port 20*b* along the internal wall of the body 20 while being held in a space defined by the side wall of the cocoon-type rotators 30 and the internal wall of the body 20, and then flows out from the outflow port 20*b*. The amount of syrup delivered, during a period in which the set of cocoon-type rotators 30 are rotated by one turn, is four times larger than the volume of the space defined by the side wall of the cocoon-type rotators 30 and the internal wall of the body 20. Therefore, the delivery of syrup can be controlled by the volume of the space defined by the side wall of the cocoon-type rotators 30 and the internal wall of the body 20 and the speed of rotation (the speed of rotation per unit time) of the cocoon-type rotators 30. The syrup is delivered to the outflow port 20*b* along the internal wall of the body 20 while being held in a space defined by the side wall of the cocoon-type rotators 30 and the internal wall of the body 20, and flows out from the outflow port 20*b*. Therefore, a given volume of syrup can be surely delivered by controlling the speed of rotation of the cocoon-type rotators 30.

FIG. 21 is a diagram illustrating the sequential delivery of a liquid as a result of the rotation of the set of cocoon-type rotators in the constant volume flow regulator 16 shown in FIG. 20. FIG. 21A illustrates the holding of syrup in a space defined by the side wall of the cocoon-type rotators 30 supported on the shaft 33 and the internal wall of the body 20. Upon the rotation of the set of cocoon-type rotators 30 to create a state shown in FIG. 21B, the syrup held in the space defined by the side wall of the cocoon-type rotators 30 supported on the shaft 33 and the internal wall of the body 20 is transferred along the internal wall of the body 20, reaches the outflow port 20*b*, and flows out from the outflow port 20*b*. In addition, syrup, which has been forced out from the syrup tank 14 by the pressure of carbon dioxide fed from the carbon dioxide bomb 13 and flowed through the inflow port 20*a* into the body 20, is incorporated into a space defined by the side wall of the cocoon-type rotators 30 supported on the shaft 32 and the internal wall of the body 20. Further, upon the rotation of the set of cocoon-type rotators 30 to create a state shown in FIG. 21C, the syrup is held in a space defined by the side wall of the cocoon-type rotators 30 supported on the shaft 32 and the internal wall of the body 20. Upon the rotation of the set of the cocoon-type rotators 30 from the state shown in FIG. 21C to create a state shown in FIG. 21D, the syrup held in a space defined by the side wall of the cocoon-type rotators 30 supported on the shaft 32 and the internal wall of the body 20 is transferred along the internal wall of the body 20, reaches the outflow port 20*b*, and flows out from the outflow port 20*b*. In addition, the syrup, which has been forced out from the syrup tank 14 by the pressure of carbon dioxide fed from the carbon dioxide bomb 13 and flown through the inflow port 20*a* into the body 20, is incorporated into a space defined by the side wall of the cocoon-type rotators 30 supported on the shaft 33 and the internal wall of the body 20. The above operations are sequentially repeated, and, as soon as the set of cocoon-type rotators 30 are rotated by a preset number of times, the delivery of a predetermined amount of syrup is completed to terminate the rotation of the cocoon-type rotators 30.

According to the above-described fourth preferred embodiment of the invention, the use of a set of cocoon-type rotators 30 as a set of rotators can provide, in addition to advantageous properties attained by the first preferred embodiment of the invention, an effect such that the set of cocoon-type rotators 30 having a smooth surface can prevent the deposition of syrup or the like fixed onto the rotators, and can improve the capability of soil to be removed upon washing.

Figure 22A:
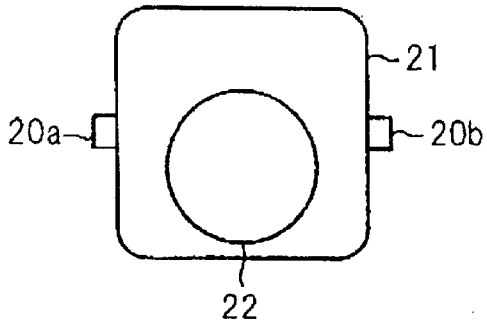
FIGS. 22A, 22B and 22C are diagrams showing the construction of a set of rotators, which are two clover type rotator, as a liquid delivery apparatus used in the fifth preferred embodiment of the invention.
Figure 22B:
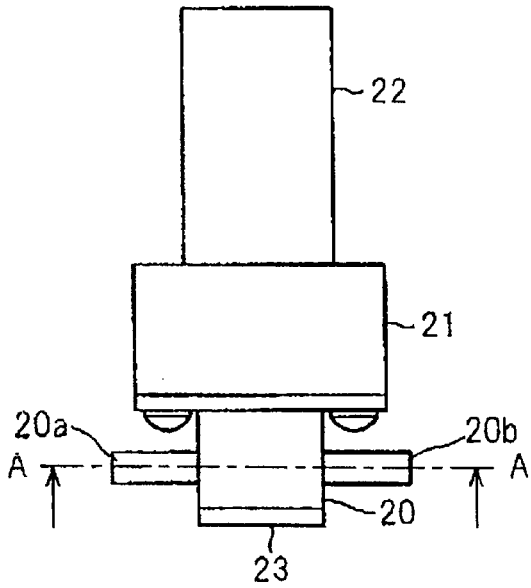
Figure 22C:
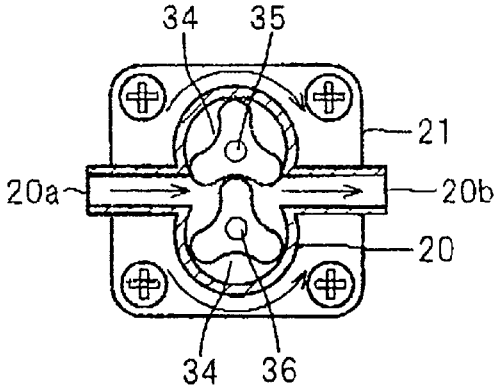
Figure 23A:
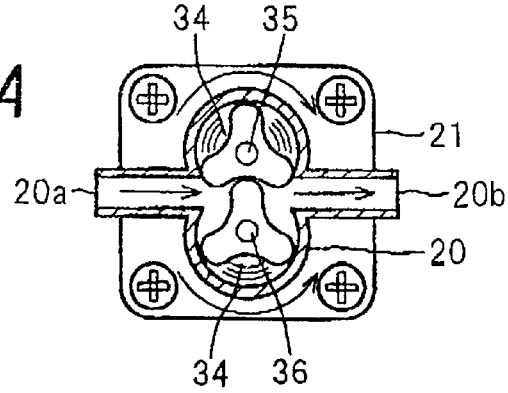
FIGS. 23A, 23B, 23C and 23D are diagrams illustrating the sequential delivery of a liquid as a result of the rotation of the two clover type rotators as a constant volume flow regulator in the fifth preferred embodiment of the invention.
Figure 23B:
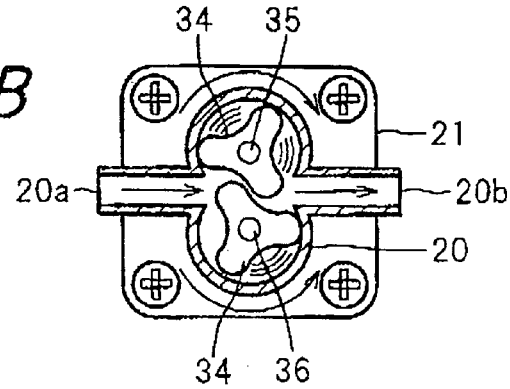
Figure 23C:
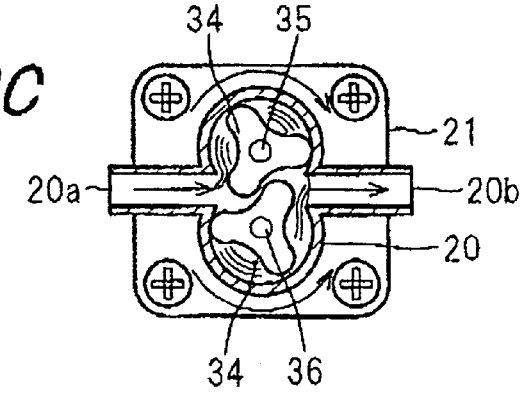
Figure 23D:
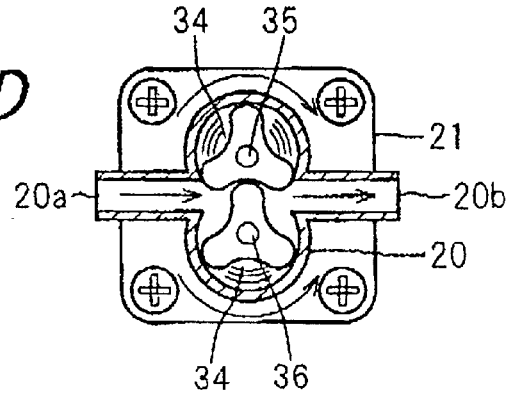

FIG. 22 is a diagram showing the construction of a constant volume flow regulator 16 according to the fifth preferred embodiment of the invention which comprises a set of rotators constituted by two three-leaf clover-type rotators, and moves a liquid from the inflow port to the outflow port along the internal wall of the body while holding the liquid in a space defined by the side wall of the three-leaf clover-type rotators and the internal wall of the body. FIG. 22A shows the constant volume flow regulator in its state as viewed from the plan, FIG. 22B the constant volume flow regulator in its state as viewed from the side, and FIG. 22C the cross section taken on line A—A of FIG. 22B as viewed from a direction indicated by arrows. In FIG. 2 showing the first preferred embodiment of the invention and FIG. 22 showing the fifth preferred embodiment of the invention, like parts have the same reference numerals to omit the repetition of the explanation of the same construction. This constant volume flow regulator 16 delivers a given volume of syrup in a continuous manner by moving the syrup forced out from the syrup tank 14 to the outflow port side along the internal wall of the body by the pressure of carbon dioxide fed from the carbon dioxide bomb 13 while holding the syrup in a space defined by the side wall of three-leaf clover-type rotators and the internal wall of the body. The set of three-leaf clover-type rotators 34 provided within the body 20 are in the form of a three-leaf clover having a smooth surface, and are rotated in the state of interlocking with each other while inserting a convex in one of the rotator into a concave in the other rotator and vice versa. The set of three-leaf clover-type rotators 34 are rotatably supported by shafts 35 (drive side) and 36 (driven side) which are supported on the body 20 and the lid 23. Upon the drive of the shaft 35 in the state of coupling with the rotating shaft of the rotator drive motor 22, the set of three-leaf clover-type rotators 34 are rotated in directions indicated by respective arrows.

Further, an encoder 50 (not shown) is provided which outputs pulses in synchronization with the speed of rotation of the rotator drive motor 22 for detecting the speed of rotation of the three-leaf clover-type rotators 34 (the speed of rotation of the rotator drive motor 22 driven in the state of coupling with the shaft 35).

In the constant volume flow regulator 16 according to the fifth preferred embodiment, upon the rotation of the set of three-leaf clover-type rotators 34, the syrup forced out from the syrup tank 14 by the pressure of carbon dioxide fed from the carbon dioxide bomb 13 flows through the inflow port 20*a* into the body 20, is delivered to the outflow port 20*b* along the internal wall of the body 20 while being held in a space defined by the side wall of the three-leaf clover-type rotators 34 and the internal wall of the body 20, and then flows out from the outflow port 20*b*. The amount of syrup delivered, during a period in which the set of three-leaf clover-type rotators 34 are rotated by one turn, is six times larger than the volume of the space defined by the side wall of three-leaf clover-type rotators 34 and the internal wall of the body 20. Therefore, the delivery of syrup can be controlled by the volume of the space defined by the side wall of the three-leaf clover-type rotators 34 and the internal wall of the body 20 and the speed of rotation (the number of revolutions per unit time) of the three-leaf clover-type rotators 34. The syrup is delivered to the outflow port 20*b* along the internal wall of the body 20 while being held in a space defined by the side wall of the three-leaf clover-type rotators 34 and the internal wall of the body 20, and flows out from the outflow port 20*b*. Therefore, a given volume of syrup can be surely delivered by controlling the speed of rotation of the three-leaf clover-type rotators 34.

In order to rotate the set of three-leaf clover-type rotators 34 in the state of interlocking with each other, instead of the rotation of the rotators in the state of interlocking with each other while inserting the convex of one rotator into the concave of the other rotator and vice verse, a set of gears are coaxially linked respectively to the set of three-leaf clover-type rotators 34 to rotate the set of three-leaf clover-type rotators in the state of interlocking with each other.

FIG. 23 is a diagram illustrating the sequential delivery of a liquid as a result of the rotation of the set of three-leaf clover-type rotators in the constant volume flow regulator 16 shown in FIG. 22. FIG. 23A illustrates the holding of syrup in a space defined by the side wall of the three-leaf clover-type rotators 34 supported on the shafts 35, 36 and the internal wall of the body 20. Upon the rotation of the set of three-leaf clover-type rotators 34 to create a state shown in FIG. 23B, the syrup held in the space defined by one side wall of the three-leaf clover-type rotators 34 supported on the shaft 35 and the internal wall of the body 20 is transferred along the internal wall of the body 20, reaches the outflow port 20*b*, and flows out from the outflow port 20*b*. In addition, syrup, which has been forced out from the syrup tank 14 by the pressure of carbon dioxide fed from the carbon dioxide bomb 13 and flowed through the inflow port 20*a* into the body 20, is incorporated into a space defined by the side wall of the three-leaf clover-type rotators 34 supported on the shaft 36 and the internal wall of the body 20. Further, upon the rotation of the set of three-leaf clover-type rotators 34 to create a state shown in FIG. 23C, the syrup held in the space defined by one side wall of the three-leaf clover-type rotators 34 supported on the shaft 36 and the internal wall of the body 20 is delivered along the internal wall of the body 20, reaches the outflow port 20*b*, and flows out from the outflow port 20*b*. In addition, syrup, which has been forced out from the syrup tank 14 by the pressure of carbon dioxide fed from the carbon dioxide bomb 13 and flown through the inflow port 20*a* into the body 20, is incorporated into a space defined by the side wall of the three-leaf clover-type rotators 34 supported on the shaft 35 and the internal wall of the body 20. Upon the rotation of the set of the three-leaf clover-type rotators 34 from the state shown in FIG. 23C to create a state shown in FIG. 23D, the syrup is held in a space defined by the side wall of the three-leaf clover-type rotators 34 supported on the shafts 35, 36 and the internal wall of the body 20. The above operations are sequentially repeated, and, as soon as the set of three-leaf clover-type rotators 34 are rotated by a preset number of times, the delivery of a predetermined amount of syrup is completed to terminate the rotation of the three-leaf clover-type rotators 34.

According to the above-described fifth preferred embodiment, the use of a set of three-leaf clover-type rotators 34 as a set of rotators can provide, in addition to advantageous properties attained by the fourth preferred embodiment, an effect such that slipping is less likely to occur in a portion of contact of the clover-type rotators 34 with each other, realizing stable delivery of syrup.

Figure 24:
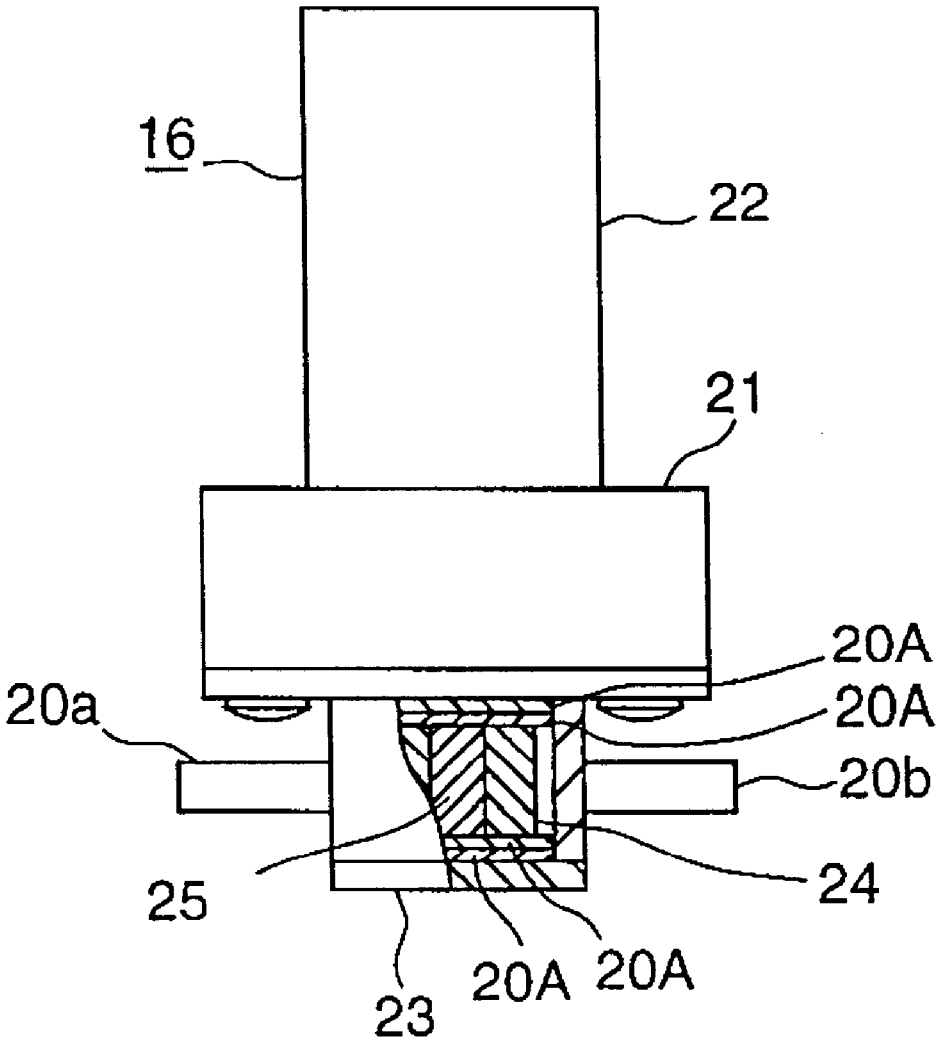
FIG. 24 is a partially sectional diagram showing a leak preventing member which is internally stored in the constant volume flow regulator.

FIG. 24 shows the constant volume flow regulator 16 in which a liquid leak prevention plate for preventing the le* of liquid from the edge face of the rotator is provided in the body. The circular gears 24 are assembled in the body 20 in a condition in which two liquid leak prevention plates 20A may be inserted in each of the edge faces. The liquid leak prevention plates 20A are thinly formed by a metal material such as stainless steel or the like having a different friction coefficient from the material which constitutes the circular gears 24. Alternatively, the liquid leak prevention plates may be made of heat resistant resin material. The invention is not limited to those stated materials. Any material that provides the liquid leak prevention functions is within the scope of this invention. The liquid leak prevention plates 20A mitigates a friction caused by contact with the edge faces during rotation of the circular gears 24, and leak of liquid caused by thermal deformation can be suppressed. The liquid leak prevention plates 20A can be also applied to the above-described other rotators other than the circular gears 24.

Figure 25:
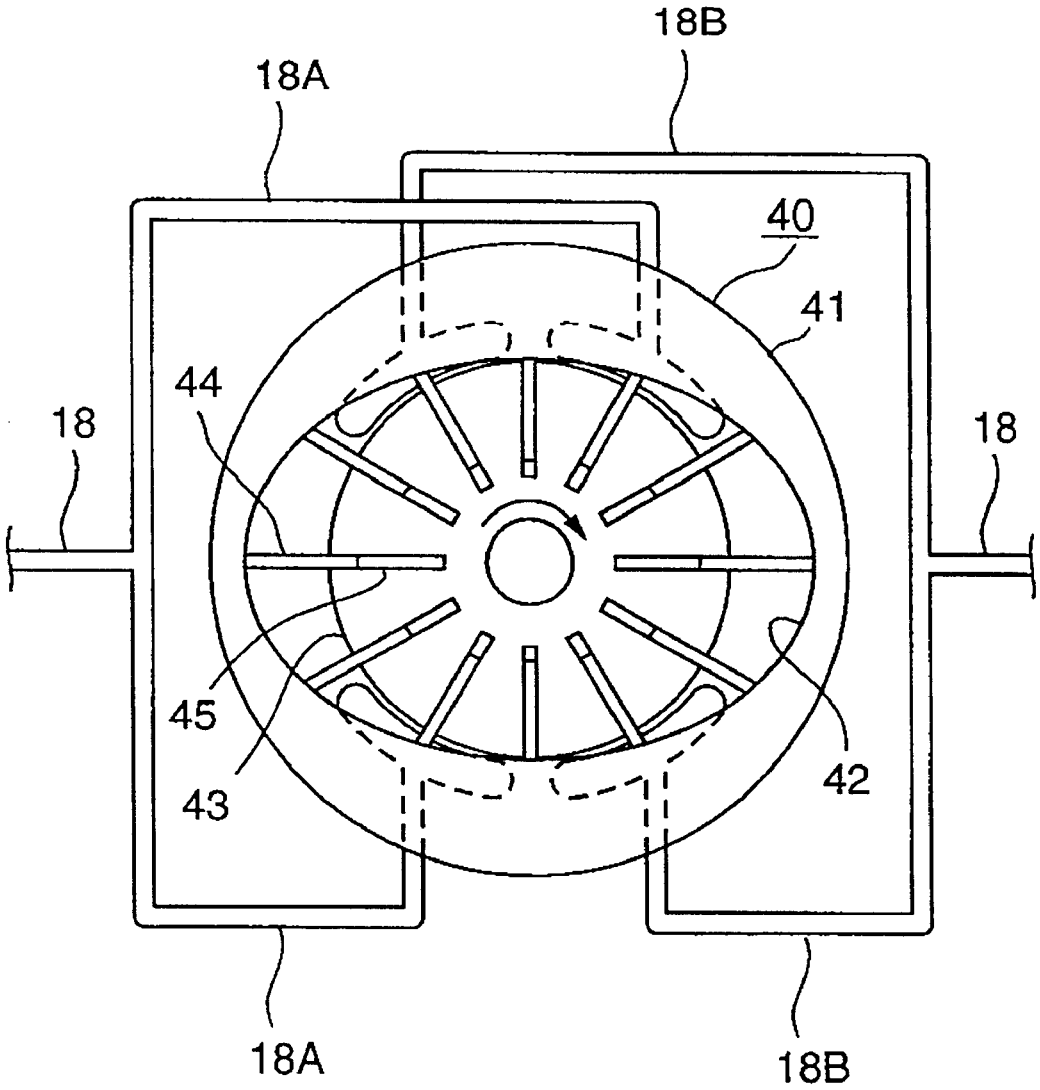
FIG. 25 is a diagram showing a construction of the constant volume flow regulator having a vane rotator in which a plural number of vanes are radially provided.

FIG. 25 is the vane type flow regulator 40 in which a plural number of vanes are provided on a rotor which is rotationally driven by a motor. The vane type flow regulator 40 comprises the body 41, the oval liquid storing part 42 which is formed in the body 41, the rotor 43 which is rotationally driven by a motor (not illustrated) in the body 41, a plural number of vanes 44 which are radially provided on the rotor 43, and the vane storing grooves 45 which elastically retain the vanes 44 to the axial direction of the rotor 43. This vane type flow regulator flows liquid such as syrup through the inflow tube 18A into a cavity in the liquid storing part 42, and flows out liquid from the outflow tube 18B based on the rotation of the rotor 43. The vanes 44 are energized to be closely contacted with the internal wall of the liquid storing part 42 by an elastic member which is stored in the vane storing grooves 45. The elastic membrane may be by example but not by way of limitation, a spring or the like which is not illustrated. The quantity of expansion and contraction becomes maximum at the major diameter portion of the ellipse and minimum at the minor diameter portion of the ellipse.

The delivery motion of liquid, such a syrup, by the vane type flow regulator 40 flows liquid in the liquid storing part 42 from the syrup feed line 18 through the inflow tube 18A, stores a given volume of liquid between the rotor 43, the two adjacent vanes 44 and the internal wall of the liquid storing part 42 by rotating the rotor 43 in a direction of the arrow shown in the illustration, moves liquid based on the rotation of the rotor 43 and flows out it from the outflow tube 18B. The delivery motion of liquid is simultaneously carried out at both the left side and right side of the rotor 43 as shown in the illustration, in the vane type flow regulator 40.

A constant volume of the liquid can be fed precisely and stably for a long period by the vane type flow regulator 40 without generating the leak of the liquid caused by the back-lash magnification of the gears based on the drive of a set of rotators using the gears that would lower the precision of measuring.

Figure 26:
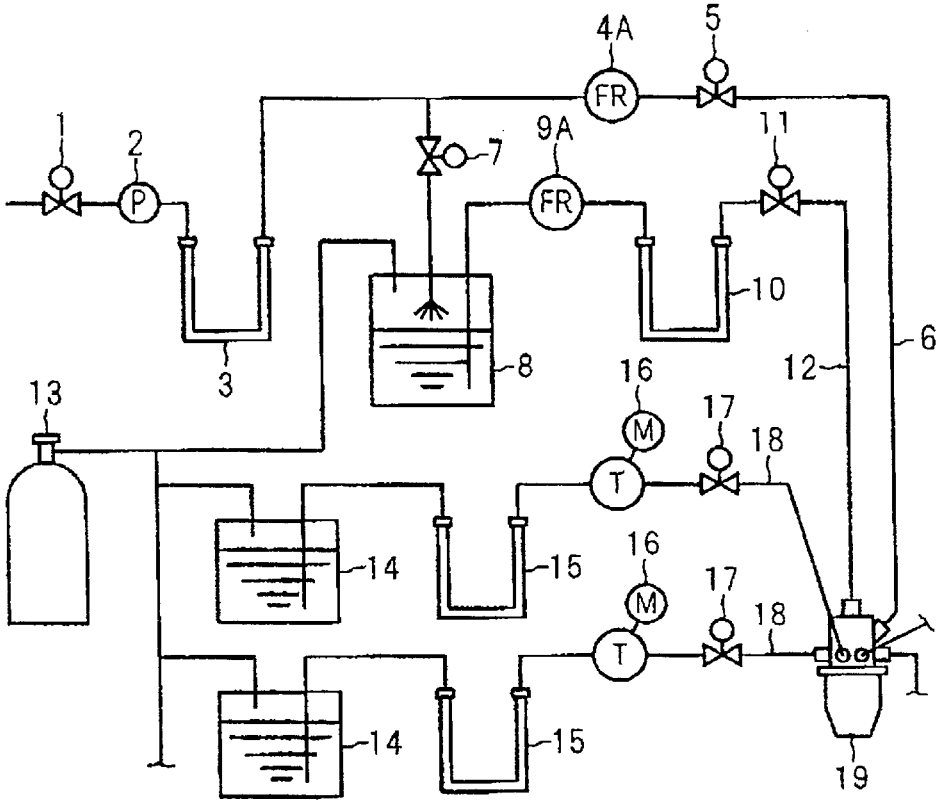
FIG. 26 is a schematic diagram showing the construction of a beverage feeding apparatus as the liquid delivery apparatus related to the sixth preferred embodiment of the invention.

FIG. 26 is a schematic diagram showing the construction of a beverage feeding apparatus as a liquid delivery apparatus according to the sixth preferred embodiment of the invention. The construction according to the sixth preferred embodiment of the invention is the same as the construction according to the first preferred embodiment of the invention, except that flow regulators 4A and 9A are provided respectively in the water feed line 6 and the carbonated water feed line 12. Therefore, the explanation of the construction of the sixth preferred embodiment in its parts which are the same as the construction of the first preferred embodiment will be omitted. The constant volume flow regulator 16 comprises: a body having an inflow port, through which syrup flows in the body, and an outflow port through which the syrup flows out from the body; a set of rotators which are rotated within the body in respective directions opposite to each other to move the syrup from the inflow port to the outflow port by given volumes along the internal wall of the body; and a drive unit for driving the set of rotators at a speed of rotation according to the properties of the syrup. The constant volume flow regulator 16 is a flow regulator which functions to continuously and accurately deliver a given volume of syrups having high viscosity, a high tendency to cause a change in viscosity upon a change in temperature, and different from each other in viscosity, without causing a change in flow rate even when the properties of syrup have varied due to a change in external environment such as a change in temperature. According to the sixth preferred embodiment, a set of circular gears (not shown) as described above in connection with the first preferred embodiment are provided as a set of rotators within the body.

Water enters a water pump 2 through a solenoid valve 1 for a water inlet, and is fed by means of a water pump 2 into a multivalve 19 through a water feed line 6, that is, through a water cooling coil 3 for cooling water, a flow regulator 4 for water, and a solenoid valve 5 for water. Further, the water feed line 6 is branched off at a position between the water cooling coil 3 and the flow regulator 4 for water, and is connected to a carbonator 8 through the solenoid valve 7 for water feed to a carbonator. The interior of the carbonator 8 is filled with carbon dioxide at a predetermined pressure (for example, 0.6 MPa gauge), fed from a carbon dioxide bomb 13. Carbonated water prepared by dissolving carbon dioxide in water fed into the carbonator 8 is forced out from the carbonator 8 by the pressure of carbon dioxide, and is fed into the multivalve 19 through a carbonated water feed line 12, that is, through a flow regulator 9 for carbonated water, a cooling coil 10 for cooling carbonated water, and a solenoid valve 11 for carbonated water.

Next, the control of the beverage feeding apparatus according to the sixth preferred embodiment of the invention will be described based on the operation of feed of a non-carbonated beverage.

Figure 27:
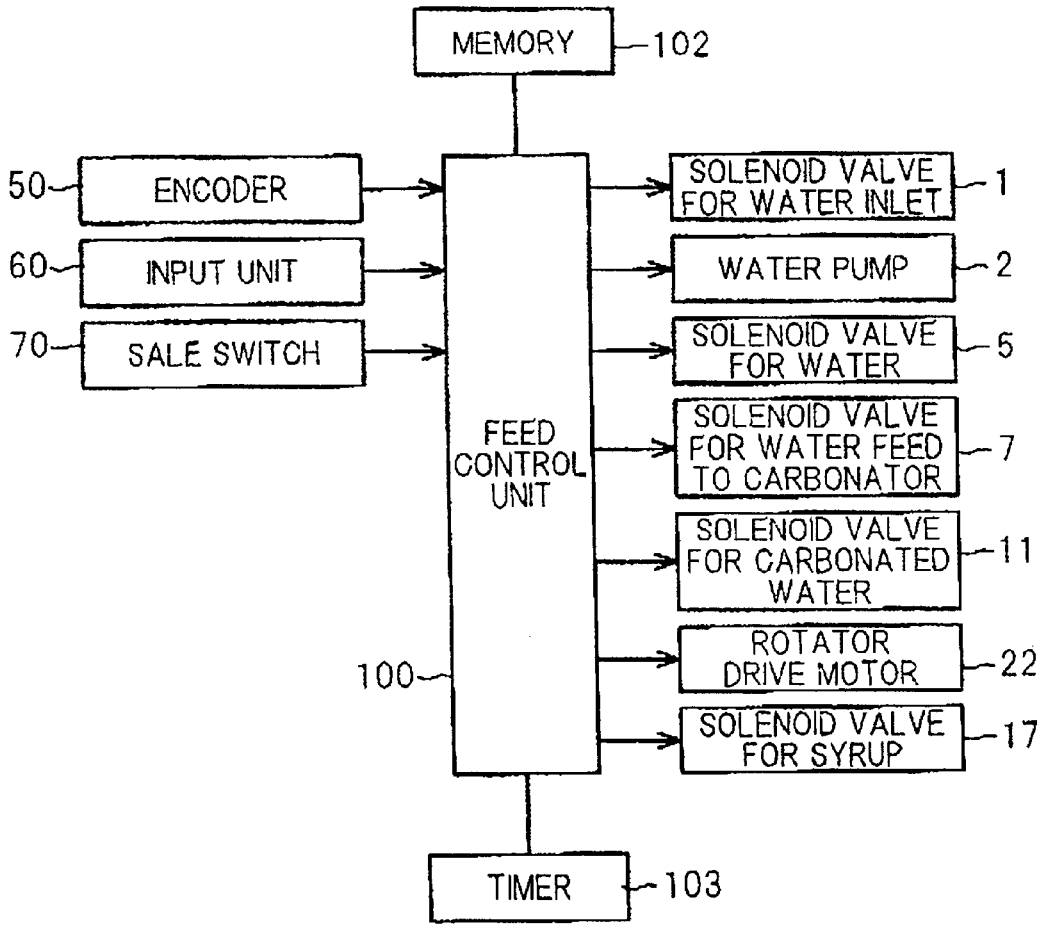
FIG. 27 is a control block diagram of the beverage feeding apparatus according to the sixth preferred embodiment of the invention.

FIG. 27 is a block diagram for the control of a beverage feeding apparatus according to the invention. In FIG. 27, reference numerals correspond to those in FIG. 26. This beverage feeding apparatus comprises: an input unit 60 having, for example, a key board for inputting various setting values for control; a plurality of sale switches 70 for the selection of beverages provided on the front of the beverage feeding apparatus; a memory 102 for storing data for controlling each section of the beverage feeding apparatus; and a timer 103 for counting a clock generated in a reference clock generator (not shown) to measure a time for which the solenoid valve 5 for water is opened (for example, about 5 sec). For example, a syrup number, the amount of sale (cup size: large, medium, and small), carbonation (carbonated beverage, weakly carbonated beverage, and non-carbonated beverage) are assigned to the sale switches 70, respectively. The feed control unit 100 supplies power to the rotator drive motor 22 based on voltage or current value stored for each beverage in the memory 102. Further, if necessary, the set value input by the input unit 60 is displayed on a display (not shown). The memory 102 stores, for each type of syrup: a time for which the solenoid valve 5 for water is opened; a voltage or current value supplied to the rotator drive motor 22 for driving the circular gears at a predetermined speed of rotation required for feeding a predetermined amount of syrup; a reference number of pulses which are compared with the number of pulses output from the encoder 50 provided in the constant volume flow regulator 16; and the ratio of the amount of diluting water fed, such as water or carbonated water, to the amount of syrup, that is, dilution ratio (dilution level).

As soon as a purchaser selects a sale switch 70, the feed control unit 100 sends a drive signal to the rotator drive motor 22 to rotate the set of circular gears. The set of circular gears allow the syrup, which is forced out from the syrup tank 14 by the pressure of carbon dioxide fed from the carbon dioxide bomb 13 and fed through the syrup feed line 18, to flow into the body 20 through the inflow port 20*a* in the constant volume flow regulator 16, and moves the syrup along the internal wall of the body 20 while holding the syrup in a space B defined by a portion, between the teeth of the circular gears, and the internal wall of the body 20 to continuously flow out from the outflow port 20*b*. The syrup is passed through the solenoid valve 17 for syrup and the syrup feed line 18, and reaches the multivalve 19. The multivalve 19 mixes the water fed through the water feed line 6 with the syrup fed through the syrup feed line 18 at a proper dilution ratio (a proper dilution level) to prepare a non-carbonated beverage having a proper syrup concentration which is then discharged.

Regarding the operation of feed of syrup, as soon as the number of pulses output from the encoder 50 in synchronization with the speed of rotation of the rotator drive motor 22 reaches a reference number of pulses stored for each type of syrup in the memory 102, the feed control unit 100 stops sending the drive signal to the rotator drive motor 22, the solenoid valve 17 for syrup, and the solenoid valve 5 for water or the solenoid valve 11 for carbonated water. Consequently, the rotation of the rotator drive motor 22 is stopped. Closing of the solenoid valve 17 for syrup and the solenoid valve 5 for water or the solenoid valve 11 for carbonated water stops the feed of the beverage.

The feed control unit 100 determines the speed of rotation of the set of circular gears per minute in the constant volume flow regulator 16 by a calculation formula $M \cdot 60/(R \cdot m)$ wherein R represents the dilution ratio of the syrup previously stored in the memory 102; M represents the flow rate of diluting water per second; and m represents the delivery of syrup per revolution of the set of circular gears. The speed of rotation of the rotator drive motor 22 per minute can be determined from the speed of rotation of the circular gears per minute determined by the above calculation formula and the reduction ratio of the rotator drive motor 22 and the circular gears 24. The feed control unit 100 outputs$_o$, based on the speed of rotation determined by the calculation formula, a drive signal which is input into the rotator drive motor 22.

Further, in the constant volume flow regulator 16, in order to drive the circular gears at a speed of rotation depending upon the dilution level or viscosity of the beverage, instead of storing the value of voltage or current supplied to the rotator drive motor 22 in the memory 102, time data representing the intermittent on-off intervals of the voltage supplied to the rotator drive motor 22 may be stored for each beverage in the memory 102. That is, intermittent supply of voltage to the rotator drive motor 22 based on the time data stored for each beverage in the memory 102 can also rotate the circular gears at a speed of rotation depending upon the dilution ratio or viscosity of the beverage. Thus, a plurality of types of beverages may be delivered by a proper time depending upon the dilution level or viscosity of the beverage.

An example of a method for changing the voltage supplied to the rotator drive motor 22 is a resistance control method wherein a voltage regulator comprising a transistor or a variable resistor is provided between a power supply (not shown), provided in the feed control unit 100, and the rotator drive motor 22 to vary the voltage. An example of a method for varying the intermittent on-off intervals of the voltage supplied to the rotator drive motor 22 is a pulse control method. In the pulse control method, the on or off state is repeated. Therefore, there is no power loss during off time. Even during on time, since the control transistor is completely saturated, the power loss is small.

According to the above-described sixth preferred embodiment, flow regulators 4 and 9 are provided respectively in the water feed line 6 and the carbonated water feed line 12, and pulses output from the encoder 50 based on the rotation of the rotator drive motor 22 are counted. As soon as the counted number of pulses reaches the reference number of pulses, sending a signal to the rotator drive motor 22, the solenoid valve 17 for syrup, and the solenoid valve 5 for water are stopped. By virtue of this construction, a given volume of syrup and a given volume of diluting water can be delivered with high accuracy. Further, a constant volume flow regulator 16 is provided in the syrup feed line, and syrup pressurized by carbon dioxide fed from the syrup tank 14 is fed into the constant volume flow regulator 16 and delivered based on the rotation of the rotator drive motor 22. Therefore, a given volume of syrup can be continuously delivered without being influenced, for example, by the type of syrup, a difference in viscosity, and a change in viscosity due to a change in temperature.

Figure 28A:
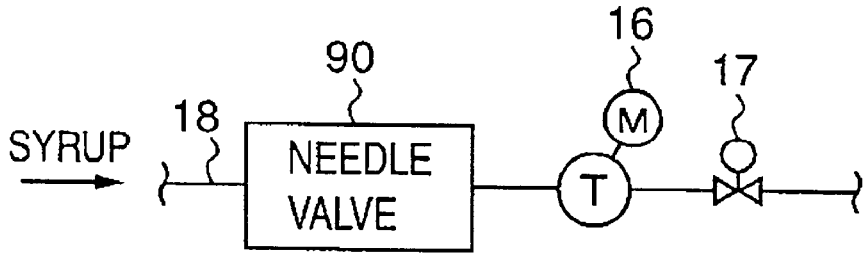
FIGS. 28A and 28B are diagrams showing the provisions of a needle valve in a syrup feed line.
Figure 28B:
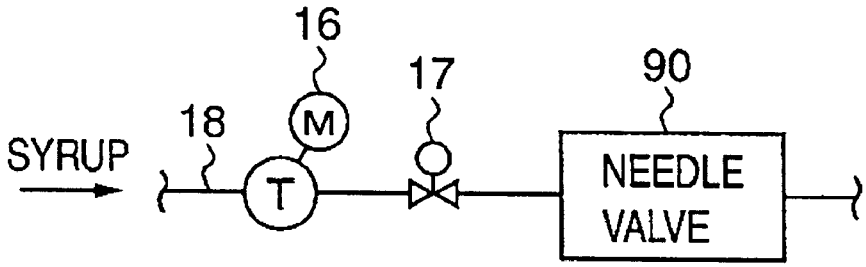

FIG. 28 is a partial view of a construction wherein a needle valve 90 is provided in the syrup feed line 18. FIG. 26A shows a construction wherein the needle valve 90 is provided upstream of the constant volume flow regulator 16, and FIG. 28B a construction wherein the needle value 90 is provided downstream of the constant volume flow regulator 16. The needle valve 90 regulates the passage of the syrup based on a needle (not shown). By virtue of this construction, in such a state that the syrup is not delivered, the pressure applied to the constant volume flow regulator 16 is reduced, and, when the viscosity of the syrup is small, the leakage of the syrup from the constant volume flow regulator 16 can be prevented. Further, when a liquid whose viscosity is considered to be low is delivered, the needle valve 90 may be preliminarily driven and the quantity of the opening of the syrup passing part may be limited, and further, the needle valve 90 may be manually operated not depending on the drive mechanism and the quantity of the opening of the syrup passing part may be limited. Further, an alternative construction may be adopted wherein, instead of the provision of the needle, a part of the syrup feed line 18 may be constituted by an pressure limiting material to clog the syrup feed line 18 based on the elastic deformation of the elastic deformable material, thereby regulating the application of the pressure.

In each of the above preferred embodiments, a method has been used wherein syrup is forced out from the syrup tank 14 by the pressure of carbon dioxide fed from the carbon dioxide bomb 13, and is then fed into the multivalve 19 through the syrup feed line 18, that is, through the cooling coil 15 for cooling syrup, the constant volume flow regulator 16 for delivering a given volume of syrup, and the solenoid valve 17 for syrup. However, the invention is not limited to this method. Specifically, regarding means for feeding a liquid material such as syrup, for example, the following method may be adopted. A bag is filled with syrup, and the bag filled with syrup is housed in a transport box to prepare a container for a liquid material (a bag-in-box or BIB). BIB is installed within a beverage feeding apparatus. The syrup is fed into the constant volume flow regulator 16 by utilizing the weight of the syrup per se. A given volume of syrup is continuously delivered from the constant volume flow regulator 16 for delivering a given volume of syrup, and is fed into the multivalve 19 through the syrup feed line 18, that is, through the solenoid valve 17 for syrup.

Further, in the beverage feeding apparatus according to the above preferred embodiments, a multivalve 19 has been used as a representative example of means for mixing syrup, fed from the syrup tank 14 through the syrup feed line 18, that is, through the cooling coil 15 for syrup, the constant volume flow regulator 16, and the solenoid valve 17 for syrup, with diluting water, such as water or carbonated water, in a valve. Alternatively, a method may be adopted wherein syrup feed nozzles (the number of syrup feed nozzles corresponding to the number of syrup beverages for sale), water nozzles, and carbonated water nozzles are arranged above a cup, and syrup and diluting water, such as water or carbonated water, are fed into the cup through the nozzles to mix them within the cup. Further, a mixing-in-the-air method may be used wherein mixing is carried out just above the cup.

Further, when syrup having properties excellent in water solubility and diffusion property is used for mixing syrup with diluting water and carbonated water, the stirring effect according to the flowing of the liquid at being delivered to a container such as a cup or the like through the multi-valve 19, and the dissolution of syrup are accelerated based on the above-mentioned properties even though the syrup which is delivered under control in accordance with the delivery motion of diluting water and carbonic acid water is discontinuous at a short period. Thus, the light and shade of syrup does not occur depending on the property of the syrup even though the delivery operation is discontinuously carried out, and a beverage in a good condition in which dilution ratio is constantly kept can be obtained.

Figure 29:
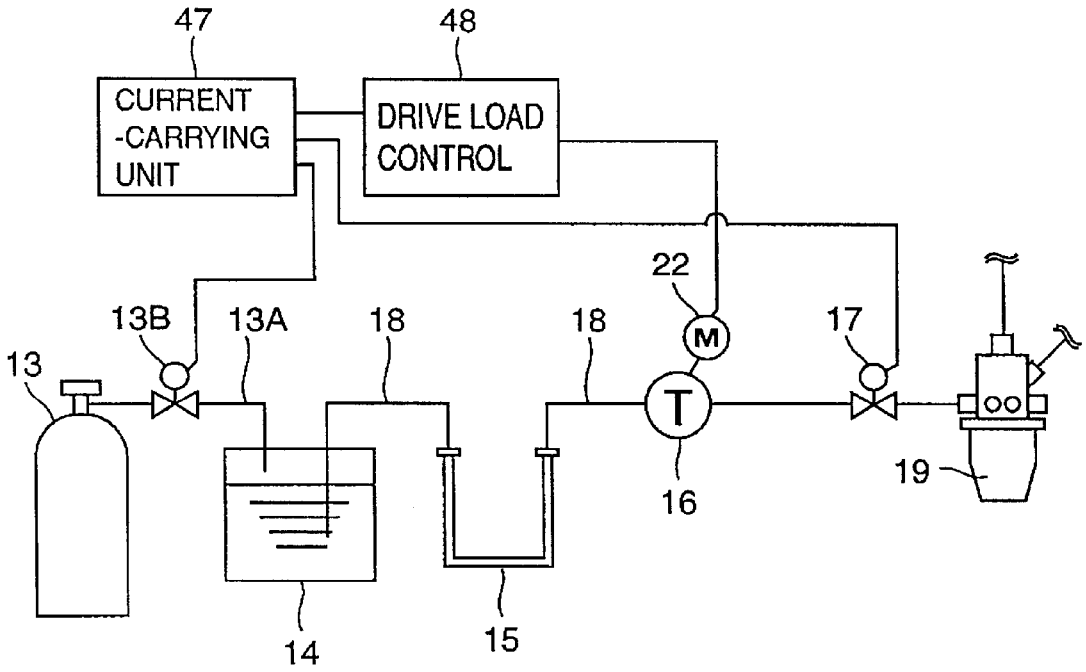
FIG. 29 is a schematic diagram showing the construction of a beverage feeding apparatus as the liquid delivery apparatus related to the seventh preferred embodiment of the invention.

FIG. 29 partially shows the beverage feeding apparatus as the liquid delivery apparatus related to the seventh preferred embodiment of the invention, and schematically shows the syrup feed line for delivering syrup as a liquid raw material by the beverage dispenser. The syrup feed line comprises the carbon dioxide bomb 13 storing high pressure carbon dioxide, the syrup tank 14 storing syrup as a liquid raw material, the carbon dioxide feed line 13A feeding carbon dioxide to the syrup tank, the carbon dioxide regulating valve 13B provided in the carbon dioxide feed line 13A, the cooling coil 15 cooling syrup by cooling water (not illustrated), the syrup feed line 18 delivering syrup, the constant volume flow regulator 16 delivering syrup at a constant volume level, the rotator drive motor 22 comprising a direct current motor which is provided in the constant volume flow regulator 16 and drives the rotator which delivers syrup at a constant volume level, the syrup electromagnetic valve 17 which opens and shuts the syrup feed line 18, the multi-valve 19 which mixes liquids such as syrup, diluting water, carbonated water and the like, the current-carrying unit 47 which supplies electric power to the rotator drive motor 22, and the drive load control unit 48 which changes the electrical load of the rotator drive motor 22. The constant volume flow regulator 16 stores rotatably a set of rotators which are composed of two circular gears which were illustrated in the above-described first preferred embodiment, in the body.

Figure 30:
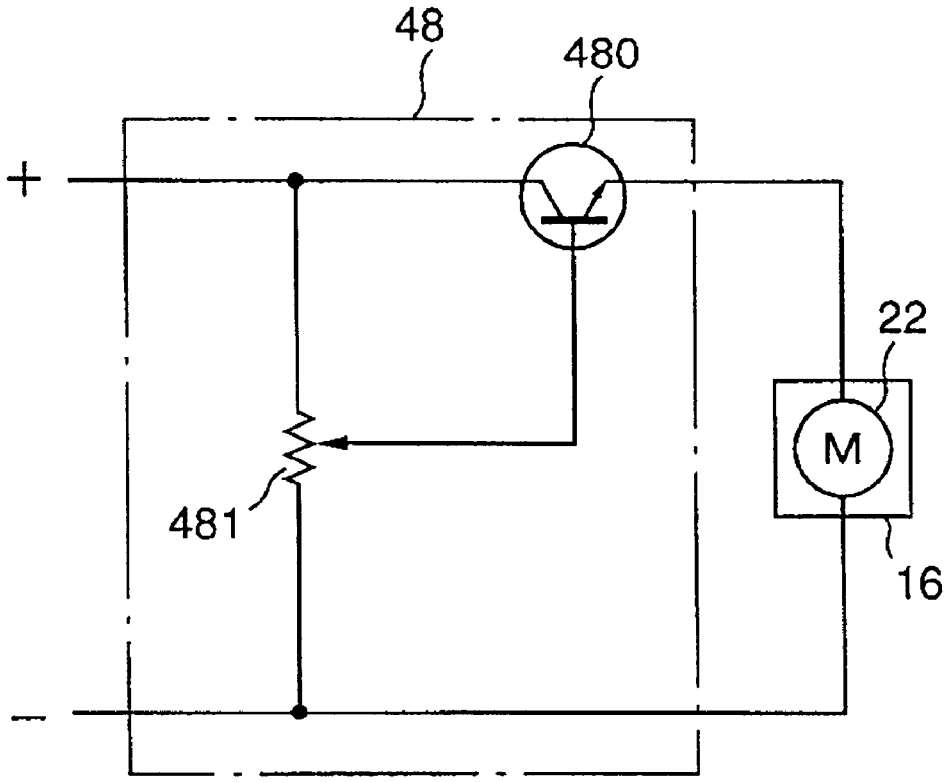
FIG. 30 is a circuit diagram showing the drive load control unit related to the seventh preferred embodiment of the invention.

FIG. 30 shows the drive load control unit 48 and comprises the power transistor 480 which is provided in the drive circuit of the rotator drive motor 22, and the variable resistance 481 which varies the equivalent resistance of the power transistor 480, and the positive electrode and negative electrode of the drive load control unit 48 are connected with the drive load control unit 48. The variable resistance 481 varies the electrical load of the rotator drive motor 22 by varying the resistance value by the resistance variable mechanism which is not illustrated, and the variable amount is set at a amount by which the rotational fluctuation of the rotator drive motor 22 does not occur against the external load which is bestowed by syrup at the delivery of syrup, according to data and the like which were obtained by an experiment and the like.

Figure 31:
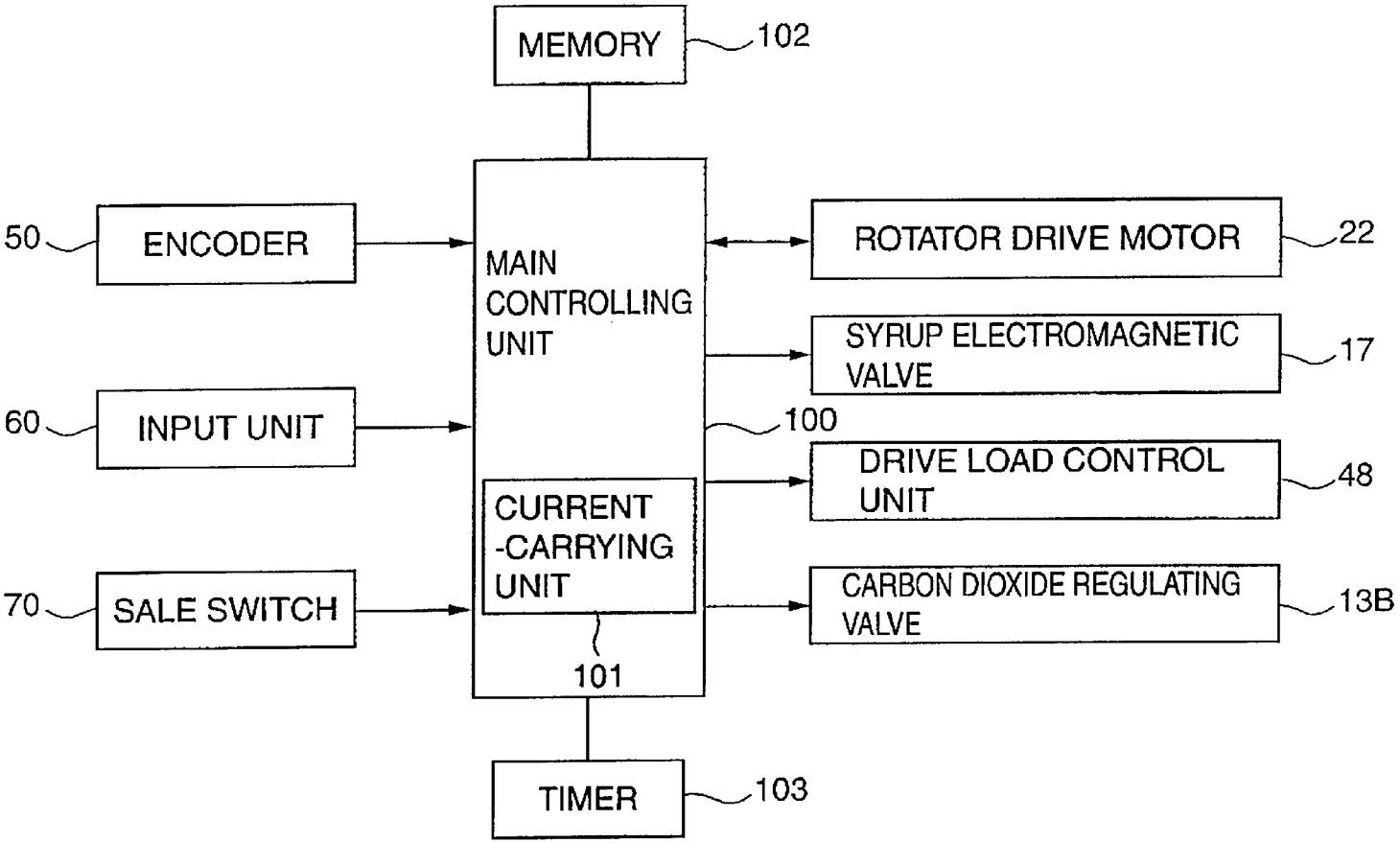
FIG. 31 is a control diagram of the beverage feeding apparatus related to the seventh preferred embodiment of the invention.

FIG. 31 shows a control block of the beverage feeding apparatus, and comprises the input unit 60 having a keyboard and the like which inputs various setting values on the control; the sale switches 70 for selecting beverages which were provided on the front panel of the beverage feeding apparatus in plurality; the memory 102 which houses the control data of the respective portions of the beverage feeding apparatus; the timer 103 which carries out the time measuring of a syrup feed time and the like; and the main controlling unit 100 which controls the above-mentioned respective portions. The main controlling unit 100 comprises the above-described current-carrying unit 47 which controls the electric power supplied to the rotator drive motor 22.

In the above-mentioned beverage feeding apparatus, the main controlling unit 100 inputs a sale signal based on that a purchasing person selects the beverage and pushes the sale switches 70. The main controlling unit 100 outputs a current-carrying signal to the current-carrying unit 47 based on the input of the sale signal. The current-carrying unit 47 inputs the current-carrying signal, and supplies electric power to the rotator drive motor 22 and the syrup electromagnetic valve 17. The syrup electromagnetic valve 17 opens the syrup feed line 18 based on the supply of electric power. Further, the rotator drive motor 22 drives the constant volume flow regulator 16 and delivers syrup to the multivalve 19 at a constant volume level. The rotator drive motor 22 rotates at the delivery of syrup accompanying the load in accordance with the resistance value of the variable resistance 481 which is provided in the drive load control unit 48. Thus, the electric current value at driving a motor becomes large, and it rotates thereby at a high torque region in comparison with the rotation which does not accompany the load in accordance with the resistance value.

According to the above-mentioned preferred embodiment, since the drive load control unit 48 increases electric current which is supplied to the rotator drive motor 22 by bestowing an electrical load to the rotator drive motor 22 at the delivery of syrup, the rotator drive motor 22 can be rotated at a high torque region, the drive condition does not come to be unstable even if the load is transferred to a set of the circular gears 24 by the abnormal delivery of syrup and pressure fluctuation in the syrup tank and the like, and a drive range in which the increase and decrease control of the delivery level is possible can be kept. Further, since the delivery control can be carried out by driving the rotator drive motor 22 at an appropriate speed reduction ratio against the load, based on the torque characteristic of the rotator drive motor 22, workings such as the selection of speed reduction gear and the like and assembly comes to be unnecessary, therefore a compact apparatus construction can be realized.

Further, when the load bestowed to a set of the circular gears 24 through syrup is large, it can be corresponded by making the resistance value of the variable resistance 481 large, but the heat generation amount of the variable resistance 481 becomes large in accordance with the increase of the current running amount. Accordingly, it is required to set the current-carrying level considering the heat generation of the variable resistance 481.

In the above-mentioned construction, was illustrated a construction in which the syrup delivery control is always carried out within the control range of the rotator drive motor 22 by providing the drive load control unit 48 which comprises an analog voltage regulator between the current-carrying unit 47 and the rotator drive motor 22, but for example, the syrup delivery control being more efficient in electric power can be also carried out by suppressing the generation of heat at current-carrying by carrying out the switching motion based on the PMW control.

A case of generating the fluctuation of flow caused by a primary factor at the liquid side was illustrated for the current-carrying control of the rotator drive motor 22, but it is also considered that the fluctuation of flow happens to occur based on the electrical characteristic of the rotator drive motor 22. For example, in a case of rotating the rotator drive motor 22, when the starting torque is in a rotational condition being capable of delivering syrup at a stable amount, namely it is out of the permitted range in comparison with the drive torque at normal drive, the error of flow happens to be large when the delivery control is carried out based on the flow in the delivery motion just before. It is preferable to watch the deviation with the reference value by housing the voltage value at the normal operation of the rotator drive motor 22 in the memory 102 and by comparing the voltage value at the delivery of syrup with a comparator using it as the reference value, in order to prevent the occurrence of such error. Further, current may be watched in place of the voltage.

Figure 32:
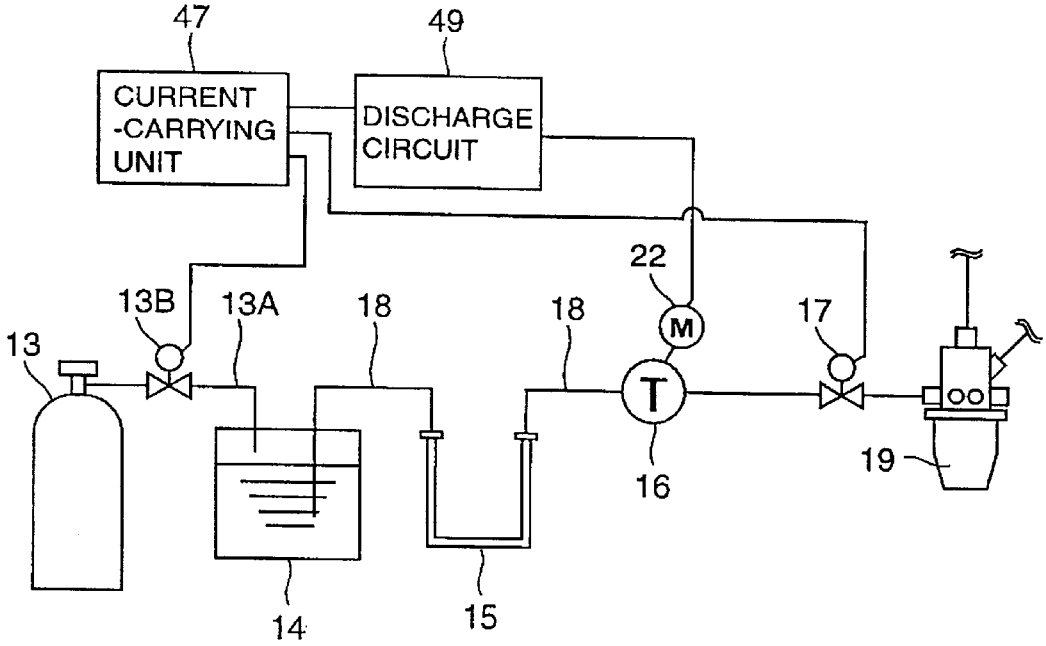
FIG. 32 is a schematic diagram showing the construction of a beverage feeding apparatus as the liquid delivery apparatus related to the eighth

FIG. 32 partially shows the beverage feeding apparatus as the liquid delivery apparatus related to the eighth preferred embodiment of the invention, and as a replace for the above-described the drive load control unit 48, the construction having the discharge circuit 49 for discharging electric power which was generated in the rotator drive motor 22 in the circuit of supplying electric power from the current-carrying unit 47 to the rotator drive motor 22, differs from the beverage feeding apparatus of FIG. 29.

The current-carrying unit 47 carries out the PMW control (Pulse Width Modulation) by which the rotational number is varied by changing a ratio (duty cycle) of Hi to Low of the pulse width, concerning the drive voltage (pulse) which is supplied to the direct current motor which is used as the rotator drive motor 22. Since the PMW control is a well-known technology, detailed illustration is abbreviated.

Figure 33:
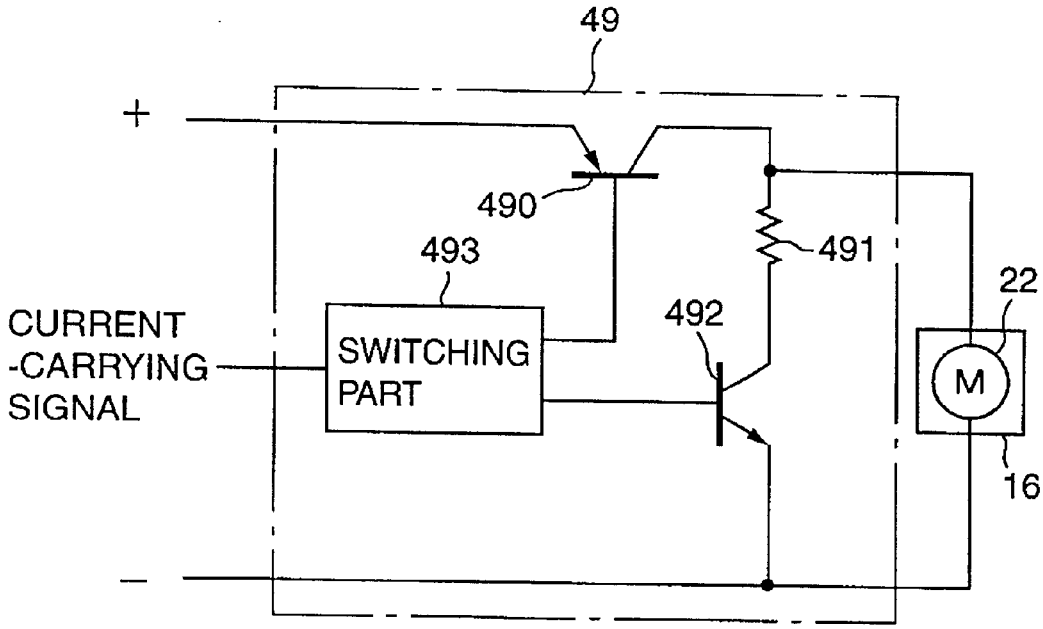
FIG. 33 is a circuit diagram showing the discharge circuit related to the eighth preferred embodiment.

FIG. 33 shows the discharge circuit, and comprises the transistor 490 which switches the circuit which supplies electric power to the rotator drive motor 22, to ON, the resistance 491 which discharges current generated at the rotator drive motor 22, the transistor 492 which switches the circuit which comprises the resistance 491, to ON, and the switching part 493 which carries out the switching motion of the transistor 490 and the transistor 492. The switching part 493 is operated based on the current-carrying signal which is input from the current-carrying unit 47, and supplies electric power from the current-carrying unit 47 to the rotator drive motor 22 by switching the transistor 490 to ON and switching the transistor 492 to OFF at driving the motor. The rotator drive motor 22 rotates at the rotational speed which is designated based on the electric power which is supplied from the current-carrying unit 47. Further, the circuit in which the resistance 491 is provided is set to ON switching the transistor 490 to OFF and switching the transistor 492 to ON at not driving the motor. In the constant volume flow regulator 16 used in the invention, when the viscosity of pressurized syrup which is flown in the body 20 is large, flow property is little, therefore the load reduction level which is bestowed to the circular gears 24 becomes little. Thus, the transistor 492 may be always set to OFF when the pressurized liquid which comprises a fixed viscosity or more is delivered. Further, when the viscosity of pressurized syrup which is flown in the constant volume flow regulator 16 is little, flow property is large, therefore the load reduction level which is bestowed to the circular gears 24 becomes large. In this case, the transistor 492 is set to ON at off-pulse in synchronization with the current running motion of the motor. The switching may be synchronized with the ON and OFF of the PWM.

In the beverage feeding apparatus having the above-mentioned construction, the main control unit 100 inputs the sale signal based on that a purchasing person selects a beverage and pushes the sale switch 70. The main control unit 100 outputs the current running signal to the current-carrying unit 47 based on the input of the sale signal. The current-carrying unit 47 inputs the current-carrying signal, and supplies electric power to the rotator drive motor 22 and the syrup electromagnetic valve 17. The syrup electromagnetic valve 17 opens the syrup feed line 18 based on the supply of electric power, and the rotator drive motor 22 drives the constant volume flow regulator 16 and delivers syrup to the multi-valve 19 at a constant volume level. The current-carrying unit 47 supplies electric power to the rotator drive motor 22 based on the duty ratio which was housed in the memory 102. The current-carrying unit 47 supplies electric power to the rotator drive motor 22 at the duty ratio of 100% until a fixed time (for example, 100 m/s) passes from the start of drive of the rotator drive motor 22, and supplies electric power at the duty ratio which was set by every beverage, after the lapse of a fixed time. The fixed time is set based on the properties such as the viscosity of the liquid and the like which are delivered by control and the electrical characteristic of the rotator drive motor 22.

Figure 34A:
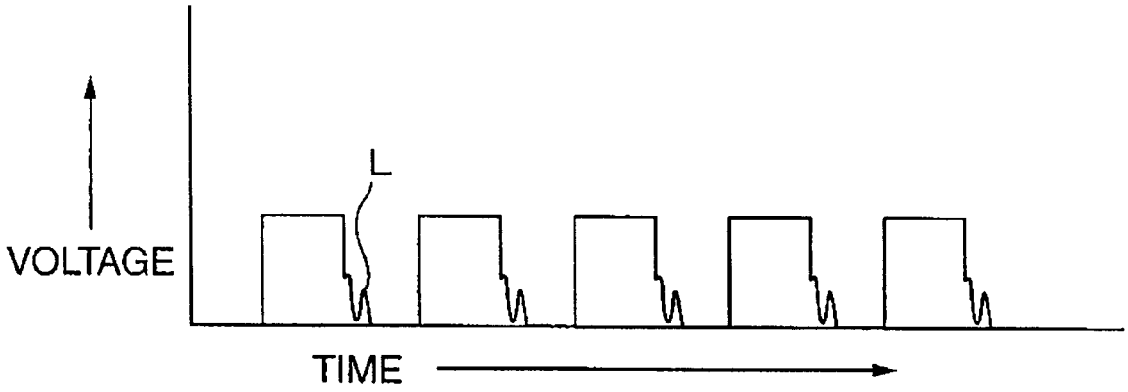
FIGS. 34A and 34B are waveform diagrams showing the waveform of pulses ar delivery of syrup in the eighth preferred embodiment.

FIG. 34A shows the waveform of pulses at delivery of syrup, and a pressure exceeding the controllable range of the rotator drive motor 22 is bestowed to a set of the circular gears 24. Accordingly, when a set of the circular gears 24 is driven by exceeding the control range of the rotator drive motor 22, an electromotive force is generated, and ripple L based on the electromotive force is generated at off-pulse. Since the flow equivalent to the amount of generating the ripple L is delivered, the deviation with a desired flow is generated. In particular, when the duty of the rotator drive motor 22 is little, for example, when the control load level to the rotator drive motor 22 was set as 20 g-cm and a duty of 25%, the control load level becomes 20% or less by which the control of the rotator drive motor 22 is possible, by feeding the pressurized syrup, and it exceeds the control limit of rotating the motor. When an applied voltage to the rotator drive motor 22 is made as 0% under this condition, it becomes an electric generator which generates voltage of a duty of about 40% by the pressurized syrup. The voltage which is applied by the drive circuit of the rotator drive motor 22 under this condition can give only the drive torque at starting the motor.

Figure 34B:
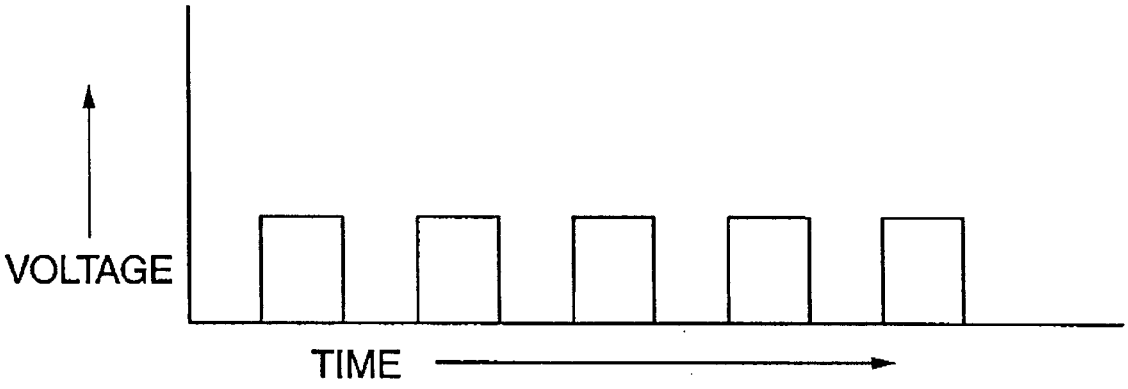

FIG. 34B shows the waveform of pulses at delivery of syrup when the discharge circuit 49 is operated, and the switching part 493 switches the transistor 492 to ON at off-pulse during running current to the motor, therefore electric power based on the electromotive force is discharged at the resistance 491. Thus, as shown in FIG. 34A, the generation of the ripple L is suppressed and the rotator drive motor 22 is rotated within the control range.

The rotator drive motor 22 drives a set of the circular gears 24 by rotation. The one set of the circular gears 24 flows the syrup which is fed through the syrup feed line 18, from the inflow port 20*a* of the constant volume flow regulator 16 to the inside of the body 20, and continuously flows syrup out from the outflow port 20*b* by feeding it along the internal wall of the body 20, while keeping it in the cavity B which is formed between the intervals of the gears of the circular gears 24 and the internal wall of the body 20. The muti-valve 19 mixes the syrup which is fed through the syrup feed line 18, in the valve, with diluting water and carbonated water which are not illustrated, and supplies it as a beverage.

In the above-mentioned syrup feed motion, concerning the drive time of the rotator drive motor 22, for example, the data of sale time based on cup sizes is housed in the memory 102, and the drive time can be also selectively decided according to the data. Concerning syrup, it is not limited to feed one kind of syrup to the syrup feed line, and for example, a mixed syrup which was obtained by mixing 2 or more of syrups having different densities, or 2 or more of syrups can be also continuously fed to the syrup feed line.

In the above-mentioned beverage feeding apparatus, for example, when the setting of syrup pressuring level after setting the apparatus is not appropriate and set at high pressure which exceeds the control range of the rotator drive motor 22, there is a fear that the constant volume flow regulator 16 becomes uncontrollable just after the start of feeding syrup, and a large quantity of syrup is not only fed, but also it causes the damage of the rotator drive motor 22, or the lowering of life time. This is prevented, and even if there is a situation in which liquids having any kind of properties are flown in by exceeding the controllable range, it can be prevented that the liquid delivery motion is deviated from the controllable range by converting the load which exceeds the controllable range of the rotator drive motor 22 to electric power and discharging it, the loss of delivery controllability caused by abnormal high pressure and the fluctuation of delivery property caused by the fluctuation of pressure are suppressed, and syrup can be precisely and stably delivered in a constant volume level based on the rotation of the one set of the circular gears 24. Further, a construction in which the load which exceeds the controllable range of the rotator drive motor 22 suppresses the rotation electrically is applied, therefore response property for the fluctuation of pressure is superior, and the delivery can be carried out even if a small motor is used as the rotator drive motor 22. Further, a mechanical deceleration machine can be unnecessary by varying the apparent deceleration ratio, a compact mechanical construction can be realized, and the rotator drive motor 7A is stabilized and can be rotated at a constant speed.

As those discharging the load which exceeds the control range of the rotator drive motor 7A, electromotive force is discharged at the discharge circuit 49 which comprises the resistance 491, but they are not limited to this. For example, the current-carrying control can be also carried out by a pulse control method, a switching control method, or the combination of a chopper control method and resistance.

In the above-mentioned beverage feeding apparatus, the syrup delivery control was illustrated, but for example, syrup is filled in a bag, the liquid raw material container (back-in-box) which stored the bag in a transportation box is provided in the beverage feeding apparatus, the syrup is fed to the constant volume flow regulator 16 by the weight of the syrup itself, a constant volume of syrup is continuously delivered by the constant volume flow regulator 16, and may be fed to the multivalve 19 through the syrup electromagnetic valve 8. Further, the delivery control of a liquid having small viscosity such as diluting water or the like can be also carried out by the constant volume flow regulator 16. Further, it can be also applied to the delivery control of a pressurized liquid such as an oil or the like. Further it can be also applied to the delivery control of a case of pressurizing a powder and a gas in addition to the fluid and delivering it through a piping, and to the delivery control of a case of feeding a liquid and a powder by a falling and the like based on gravity.

Further, in the above-mentioned beverage feeding apparatus, the control for the load which exceeds the controllable range of the rotator drive motor 22 is carried out based on the electrical control of the rotator drive motor 22, but the rotation of the rotator drive motor 22 may be controlled by limiting the load by a valve device and the like when electromotive force was detected.

Figure 35:
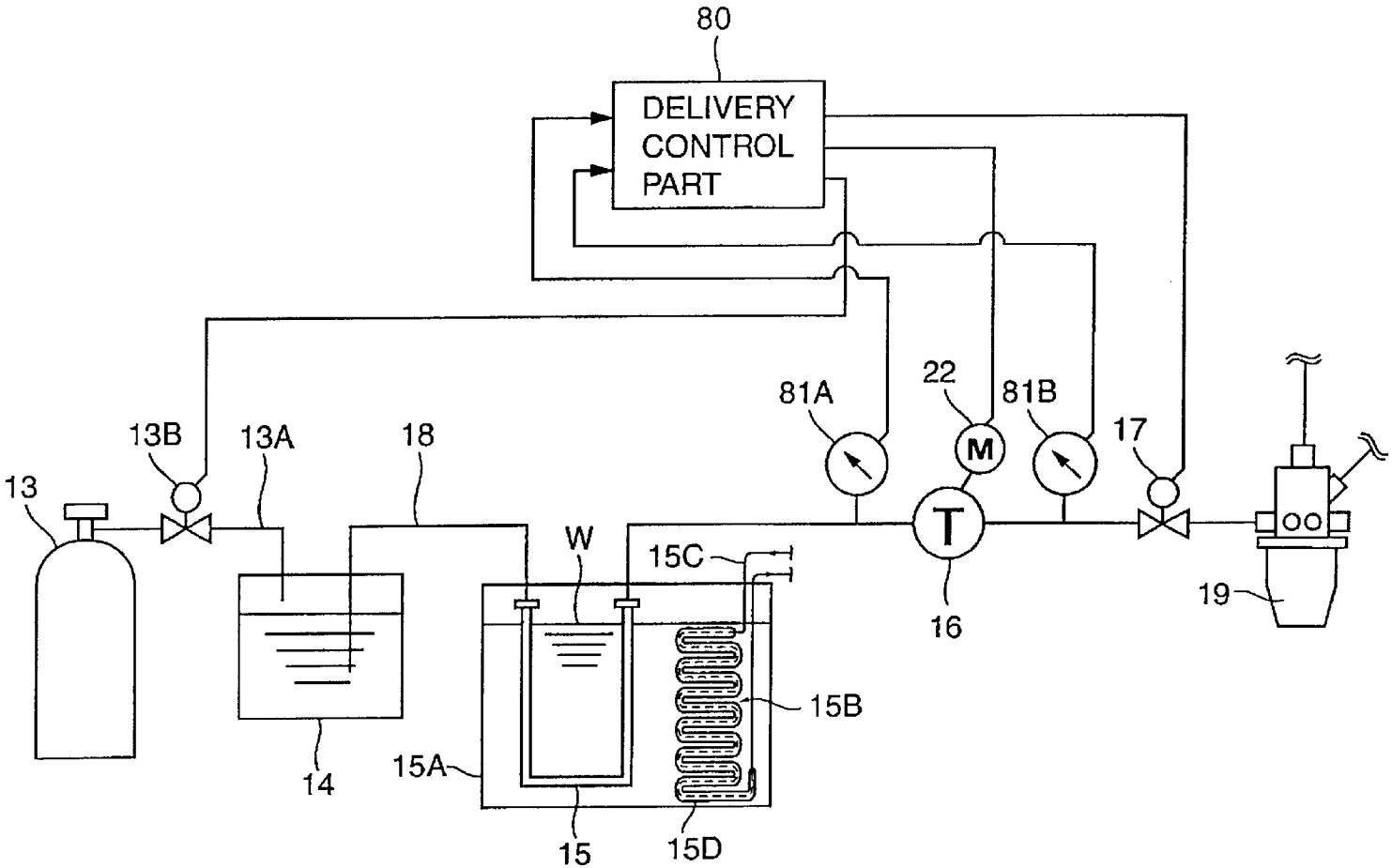
FIG. 35 is a schematic diagram showing the construction of a beverage feeding apparatus as the liquid delivery apparatus related to the ninth preferred embodiment of the invention.

FIG. 35 partially shows the beverage feeding apparatus as the liquid delivery apparatus related to the ninth preferred embodiment of the invention, and common reference figures are attached to the portions which have the same construction as other modes of operation. The syrup feed line which delivers syrup as the liquid raw material by the beverage dispenser is schematically shown. The syrup feed line comprises the carbon dioxide bomb 13 storing high pressure carbon dioxide, the syrup tank 14 storing syrup as a liquid raw material, the carbon dioxide feed line 13A feeding carbon dioxide to the syrup tank, the carbon dioxide regulating valve 13B provided in the carbon dioxide feed line 13A, the cooling coil 15 cooling syrup by cooling water W, the syrup feed line 18 delivering syrup, the constant volume flow regulator 16 delivering syrup at a constant volume level, the rotator drive motor 22 which is provided in the constant volume flow regulator 16 and drives the rotator which delivers syrup at a constant volume level, the syrup electromagnetic valve 17 which opens and shuts the syrup feed line 18, the multi-valve 19 which mixes liquids such as syrup, diluting water, carbonated water and the like, the pressure gauge 81A which outputs the pressure detection signal corresponding to pressure by detecting the pressure of upstream side of the constant volume flow regulator 16, the pressure gauge 81B which outputs the pressure detection signal corresponding to pressure by detecting the pressure of downstream side of the constant volume flow regulator 16, the delivery control part 80 which controls the carbon dioxide regulating valve 13B or the rotator drive motor 22, the cooling water vessel 15A which stores the cooling water W, the evaporator 15B which cools the cooling water W based on the evaporation of cooling medium which is fed from a cooling unit which is not illustrated, and the cooling medium tube passage 15C which circulates the cooling medium to the evaporator 15B. The constant volume flow regulator 16 stores rotatably a set of the rotators which is composed of two circular gears which were illustrated in above-described first preferred embodiment, in the body. The evaporator 15B forms the ice 15D on surface by evaporating the liquid cooling medium which is fed through the cooling medium tube passage 15C, and cools the cooling water W based on the ice 15D.

Figure 36:
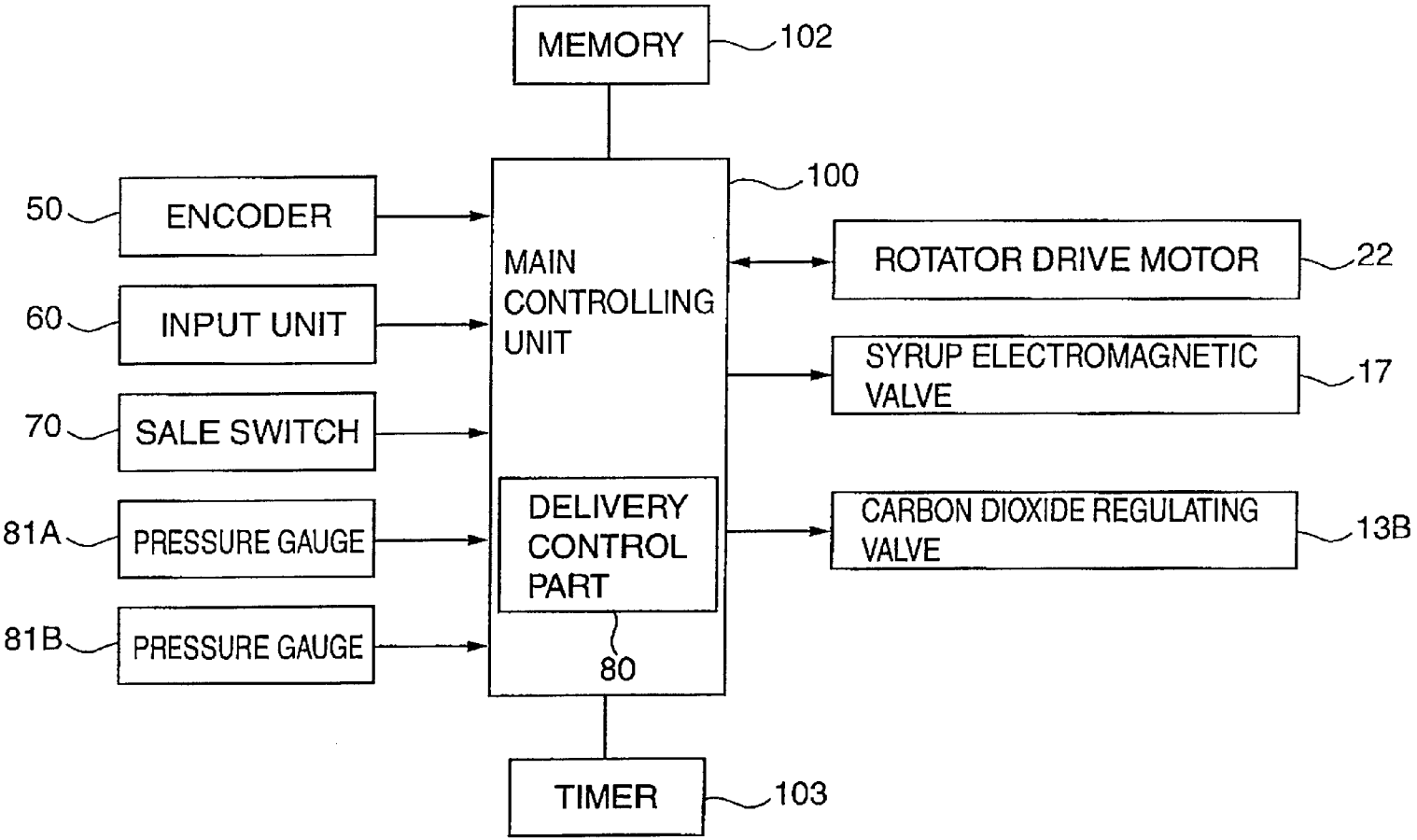
FIG. 36 is a control block diagram of the beverage feeding apparatus related to the ninth preferred embodiment.

FIG. 36 shows a control block of the beverage feeding apparatus, and comprises the encoder 50 which outputs pulses in accordance with the rotational speed of the rotator drive motor 22, the input device 60 which comprises a keyboard and the like for inputting various measurement values on the control, the sale switches 70 for selecting a beverage which provided in plurality on the front face of the beverage feeding apparatus, the memory 102 which houses the control data of the respective parts of the beverage feeding apparatus, the timer 103 which carries out the time measuring of syrup feed time and the like, and the main control unit 100 which controls the above-mentioned respective parts. The above-mentioned main control unit 100 comprises the above-described delivery control part 80 which carries out the control of the rotator drive motor 22 based on the above-mentioned pressure detection signal.

The memory 102 houses the data such as the drive time of the rotator drive motor 22 which is set by every beverage, the duty ratio corresponding to electric power, the delay time for delaying the drive start of the rotator drive motor 22 and the like. Further, it houses the duty correction table for correcting the duty ratio of the rotator drive motor 22 at an arbitrary temperature based on a viscosity at the reference temperature (for example, 5° C.) of syrup, the flow correction value which is provided by every kind of syrup based on the relation of pressure and flow at the delivery of syrup, and the correction table of pressurized level which changes the opening and shutting level of the carbon oxide regulation valve 13B at a regulated level corresponding to pressure.

The main control unit 100 inputs the pressure detection signals which are output from the pressure gauges 81A and 81B to the delivery control part 80. The delivery control part 80 regulates the degree of opening of the carbon dioxide regulating valve 13B based on the pressure detection signals of the pressure gauges 81A and 81B. Further, The delivery control part 80 changes the duty ratio of the rotator drive motor 22 based on the pressure detection signals of the pressure gauges 81A and 81B.

In the beverage feeding apparatus having the above-mentioned construction, the main control unit 100 inputs the sale signal based on that a purchasing person selects a beverage and pushes the sale switch 70. The main control unit 100 outputs the current-carrying signal to the delivery control part 80 based on the input of the sale signal. The delivery control part 80 inputs the current-carrying signal, and supplies electric power to the rotator drive motor 22 and the syrup electromagnetic valve 17. The syrup electromagnetic valve 17 opens the syrup feed line 18 based on the supply of electric power. Syrup pressurized by carbon dioxide is delivered from the syrup tank 14 to the syrup feed line 18 by opening the syrup electromagnetic valve 17, cooled by the cooling coil 15, and flown in the constant volume flow regulator 16. The rotator drive motor 22 drives the constant volume flow regulator 16 and delivers syrup to the multi-valve 19 at a constant volume level.

The delivery control part 80 supplies electric power to the rotator drive motor 22 based on the duty ratio which was housed in the memory 102. The delivery control part 80 supplies electric power to the rotator drive motor 22 at the duty ratio of 100% until a given time (for example, 100 m/s) passes from the start of drive of the rotator drive motor 22, and supplies electric power at the duty ratio which was set by every beverage, after the lapse of a given time. The given time is set based on the properties such as the viscosity of the liquid and the like which are delivered by control and the electrical characteristic of the rotator drive motor 22. Further, when the pulse frequency which the encoder 50 outputs is deviated from the reference pulse frequency, the control of rotational speed is carried out based on the change operation of the above-mentioned duty ratio.

The pressure gauges 81A and 81B output the pressure detection signals corresponding to the syrup feed line 18, to the delivery control part 80. When the pressure detection signal indicating the negative pressure is input from the pressure gauge 81A, the delivery control part 80 reads the flow correction value which is housed in the memory 102, corrects the duty of the rotator drive motor 22 and the reference pulse frequency of the encoder 50 so that the desired flow is obtained from the flow corresponding to the pressure, and opens the carbon dioxide regulating valve 13B so as to be the degree of opening corresponding to the degree of the pressure based on the correction table of pressurizing level which is housed in the memory 102 and enlarges the pressurizing level of syrup.

Further, when the pressure detection signal which exceeds the normal pressure range from the pressure gauge 81B is input, the delivery control part 80 regulates the carbon dioxide regulating valve 13B so as to reduce the feed pressure of carbon dioxide, and changes the duty ratio so that the speed of the rotator drive motor 22 is reduced. Thus, the rotator drive motor 22 is decelerated.

Figure 37:
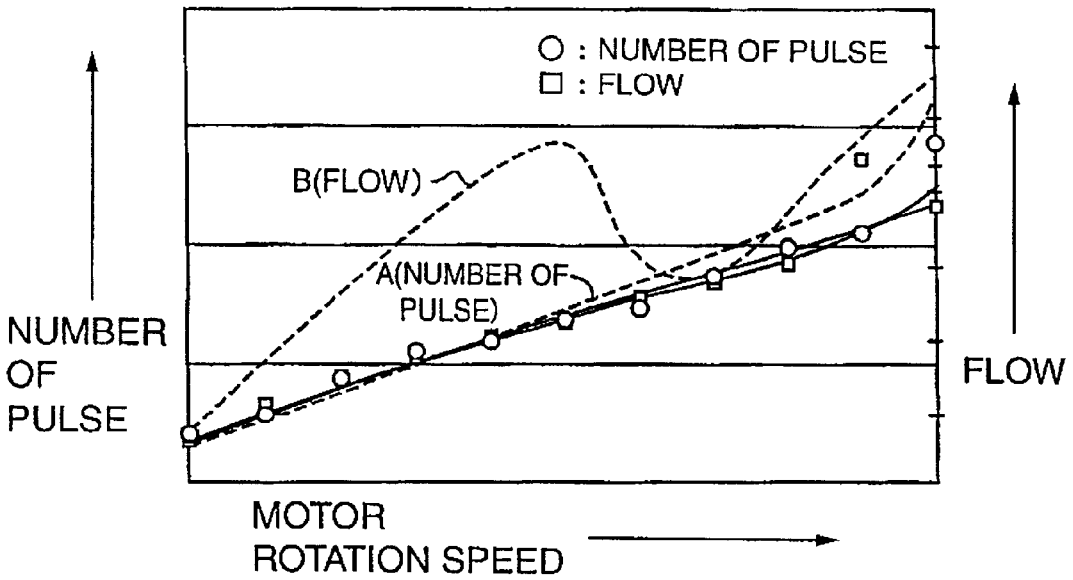
FIG. 37 is a characteristic diagram showing the frequency of output pulses from the encoder related to the ninth preferred embodiment.

FIG. 37 shows the syrup delivery property when the pressure of carbon dioxide which is fed to the syrup tank 14 is set at 0.15 Mpa, and shows the number of pulses which is output in accordance with the rotational speed of the rotator drive motor 22 and the flow at the outflow side of the constant volume flow regulator 16. Firstly, when syrup was delivered by setting the pressure of carbon dioxide at 0.10 Mpa at the start of feeding syrup, the pressure gauge 81A indicated the negative pressure, and the dispersion of the number of pulses (the dotted line A) and the flow (the dotted line B) occurs, therefore the delivery control part 80 sets the carbon dioxide regulating valve 13B at 0.15 Mpa by enlarging based on the regulated level which is obtained from the correction table of pressuring level. Under the pressuring condition, the inflow side pressure of the constant volume flow regulator 16 is improved to the positive pressure, and the pressures at the inflow port and outflow port came to be kept at the positive pressure even though the rotational speed is raised. Syrup pressurized by carbon dioxide is continuously flown in the constant volume flow regulator 16 under the pressure condition, therefore even though the rotational speed of the rotator drive motor 22 is raised, the dispersion of the flow does not occur as shown in a real line.

In the liquid delivery control using the constant volume flow regulator 16, when the circular gears 24 are driven at the rotational speed corresponding to the dilution ratio and viscosity of a beverage, the table of the time data which represents the interval which intermittently switches the voltage which is supplied to the rotator drive motor 22 to ON and OFF is made by every beverage, in addition to make a table of the voltage or current value which is supplied to the rotator drive motor 22 and to memorize it in the memory 102, and an appropriate control mode may be selectively carried out. Further, when the more accurate liquid delivery control is carried out, the conditions of the liquid in the respective lines are detected by detectors such as pressure gauges, liquid sensors which detect the presence and absence of the liquid and the like, and it is preferable to continuously flow the liquid into the constant volume flow regulator 16 without any stagnation by carrying out the delivery control including these detection signals.

Figure 38:
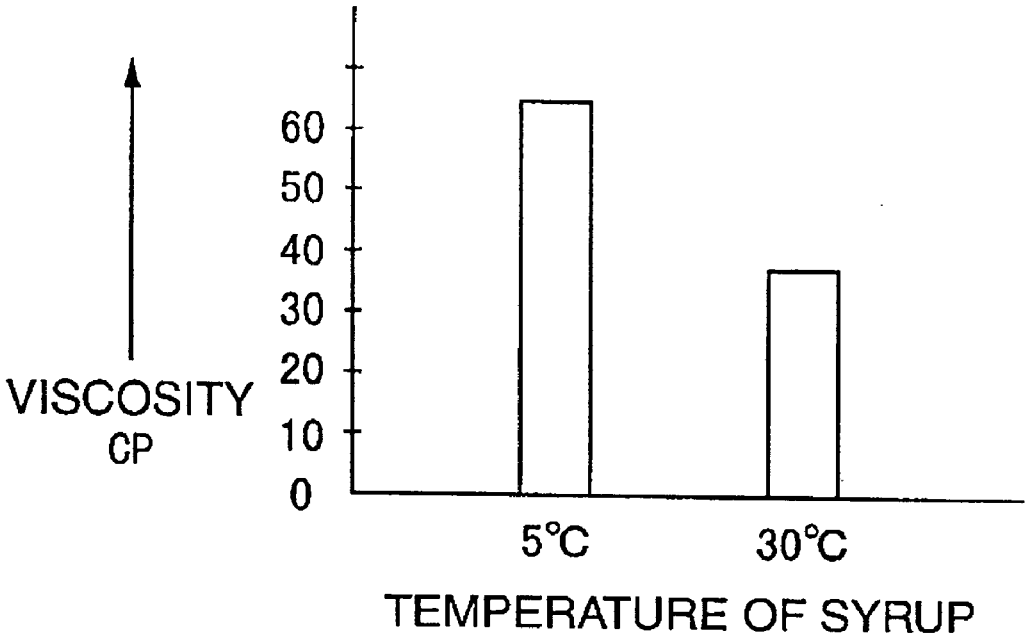
FIG. 38 is a characteristic diagram showing the relation of the temperature and viscosity of a syrup related to the ninth preferred embodiment.

FIG. 38 shows the relation of the temperature and viscosity of syrup, and the syrup comprises a characteristic of varying viscosity depending on temperature. For the syrup used in the invention, the viscosity is about 38 cp at 30° C. and 65 cp at 5° C., and becomes large. When the viscosity is larger, the pressure drop of the syrup feed line 18 becomes large and the pressure becomes large. Accordingly, when the setting operation of flow of the constant volume flow regulator 16 is carried out just after installing a beverage dispenser, temperature differs from that of syrup at the time of a real sale, therefore the fluctuation of flow based on the above-mentioned temperature dependency of viscosity happens to occur. For example, when a service man carries out the setting operation of flow of the constant volume flow regulator 16 after installing a beverage dispenser, the temperature of syrup which passed the cooling coil 15 is larger than a proper temperature (for example, 5° C.) at the time of a real sale and the viscosity is little, because the cooling water W of the cooling water vessel 15A is not adequately cooled just after installation. When the setting operation of flow is carried out at the temperature of syrup, the flow of syrup increases by 10 to 15% in comparison with the flow of syrup at the proper temperature.

Thus, in order to obtain a desired flow when syrup becomes the proper temperature, the pressure of the syrup feed line 18 is watched by the pressure gauges 81A and 81B, and it is preferable that the pressure detection signal which was obtained is compared with the pressure detection signal at a proper temperature which was preliminarily measured, and further, the duty ratio variable control of the rotator drive motor 22 and the pressuring level control are carried out considering the temperature difference of syrup.

In the above-mentioned beverage feeding apparatus, syrup is fed by pressurizing syrup with carbon dioxide, but when a gas brake in which carbon dioxide dissolved in syrup generates a foam in the liquid by contacting with the circular gears 24, the inflow level of syrup is decreased, therefore the rotational speed of the rotator drive motor 22 is controlled based on the pressure detection signal of the pressure gauges 81A. Further, the pressuring level of syrup may be increased and decreased by regulating the degree of opening of the carbon dioxide regulating valve 13B which is provided in the carbon dioxide feed line 3 without changing the rotational speed of the rotator drive motor 22. Further, the regulation of the degree of opening of the rotational speed of a motor and the carbon dioxide regulating valve 13B may be carried out in combination.

According to the above-mentioned preferred embodiment, the pressure is watched to carry out the delivery control so that the inflow side pressure of the constant volume flow regulator 16 which is provided in the syrup feed line 18 is not negative pressure, therefore it is prevented that the syrup inflow level to the constant volume flow regulator 16 is deficient, and a constant volume of syrup having a desired flow can be surely delivered continuously. Further, the liquid is delivered based on the rotation of a set of the circular gears 24, therefore a highly precise liquid delivery becomes possible without being subject to the influence according to properties such as the viscosity of the liquid and the like. Further, since syrup which was pressurized with carbon dioxide is delivered to the constant volume flow regulator 16 through the syrup feed line 18, syrup is not inversely flown to the syrup tank 14 side, the force by which the rotator drive motor 22 is required for driving a set of the circular gears 24 becomes little by the pressurization with carbon dioxide, the rotator drive motor 22 can be minimized, and the reduction of cost can be designed. Further, the syrup delivery amount can be increased and decreased in accordance with the desired flow by changing the rotation of a set of the circular gears 24.

Further, the pressure of the syrup feed line 18 is watched by the pressure gauges 81A and 81B, the fluctuation of flow which was accompanied by the fluctuation of viscosity of syrup is prevented by carrying out the duty ratio variable control of the rotator drive motor 22 and the pressuring level control using the pressure at a proper temperature as a reference, and syrup can be precisely delivered. Alternatively, an operator such as a service man or the like may manually carry out a flow setting work or a flow regulating work referring to the pressure detection signal by the pressure gauges 81A and 81B.

Figure 39:
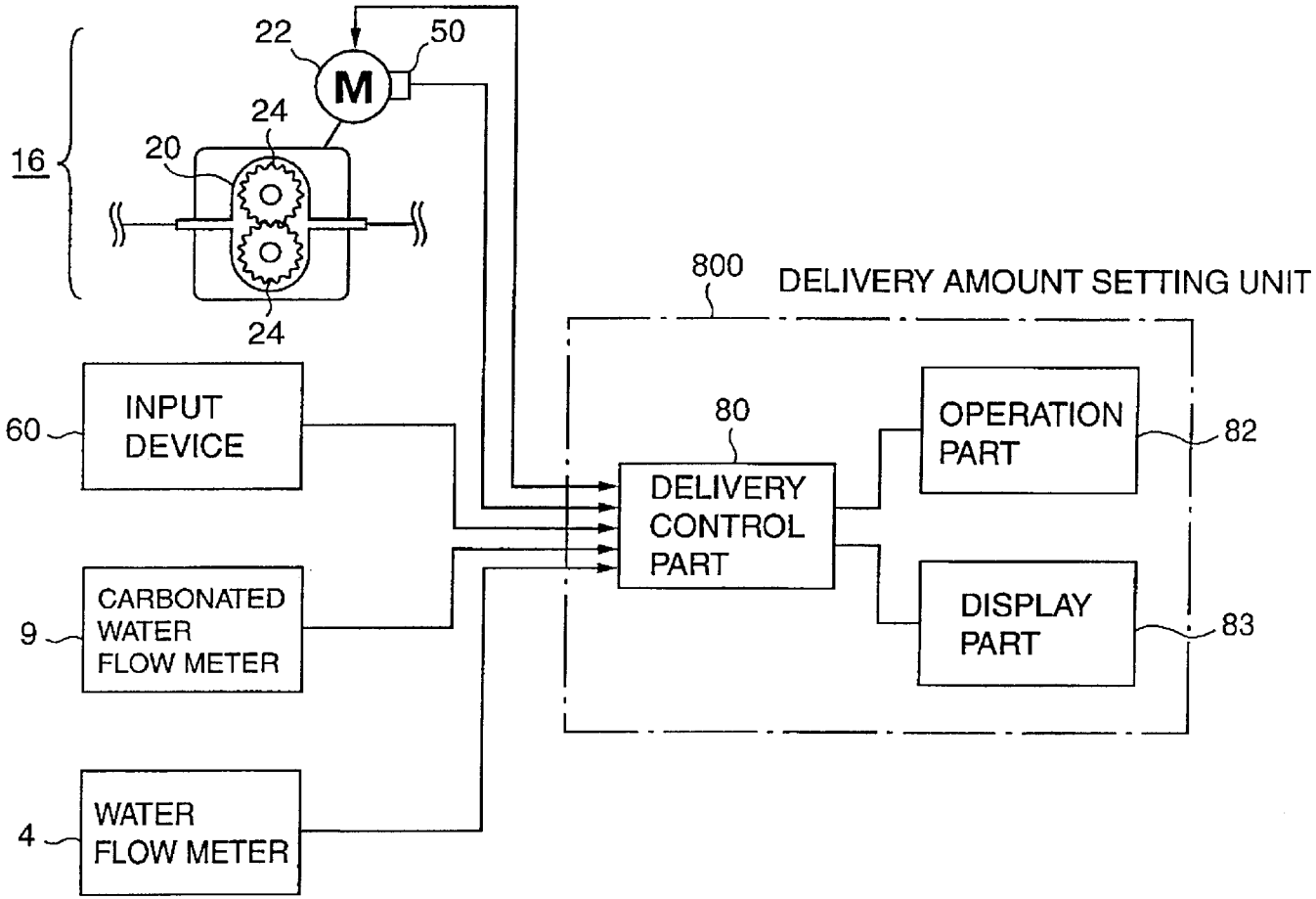
FIG. 39 is a schematic diagram showing the construction of the principal part of a beverage dispenser having a plural number of the liquid delivery lines related to the tenth preferred embodiment of the invention.

FIG. 39 schematically shows the principal part of a beverage dispenser having a plural number of the liquid delivery lines related to the tenth preferred embodiment of the invention, and common reference figures are bestowed to the portion having the same construction as other preferred embodiment. The principal part comprises the constant volume flow regulator 16 which is provided in the syrup feed line by which syrup as the liquid raw material is delivered, the input device 60 which inputs various data necessary for controlling the constant volume flow regulator 16, the carbonated water flow meter 9 for measuring the flow of carbonated water which is used for beverage cooking, the water flow meter 4 for measuring the flow of diluting water which is used for beverage cooking, and the delivery amount setting unit 800 which is constructed by the operation part 82, the display part 83 and the delivery control part 80. The constant volume flow regulator 16 rotatably stores a set of rotators which is composed of two circular gears which was illustrated in the first preferred embodiment.

For example, the carbonated water flow meter 9 and the water flow meter 4 have a wing wheel which is stored in the body in free rotation, detect the rotational number of wing wheel which rotates in accordance with the liquid which passes in the body, and output it as the flow signal.

The delivery amount setting unit 800 sets the current running level (duty) of the rotator drive motor 22. The operation part 82 operates the duty of the rotator drive motor 22 so that the syrup of the amount which is required at sale corresponding to syrup of the amount which is based on the dilution ratio of sale beverage and cup sizes (S, M, L and the like) is continuously delivered at a constant level based on the delivery test which was carried out for the syrup to be delivered. The display part 83 is a display comprising a display device such as a liquid crystal or the like, and displays the information such as input value which was input by the input device 2, duty which is set based on the delivery test, and the like. Further, the display part 83 carries out the warning displays (the sell out of syrup, the abnormality of apparatus, the lowering of carbon dioxide pressure) based on the threshold value which is described later when the flow of syrup fluctuates during sale motion. The delivery control part 80 houses the execution result of the delivery test to the memory part (not illustrated), and carries out the current-carrying control of the rotator drive motor 22 based on the duty which was operated so that a desired flow is continuously delivered in synchronization with the flows of diluting water and carbonated water and delivery time. Further, the delivery control part 80 comprises the clock function which carries out timing motion based on a reference clock which is generated at the reference clock generation part (not illustrated) which is internally stored.

Further, when syrup is delivered, the delivery control part 80 compares the output pulses which are input from the encoder 50 with the reference pulse which is memorized in the memory part which is described later, at an arbitrary time T (for example, 0.5 sec.), and detects the presence and absence of the deviation. When the output pulse number per a unit time (for example, 1 sec.) which the encoder 50 outputs is less than the reference pulse number, the rotational speed of the rotator drive motor 22 is enlarged by changing the duty. Further, when the output pulse number which is input from the encoder 50 is more than the reference pulse number, the rotational speed of the rotator drive motor 22 is made small by changing the duty. Thus, the rotational speed of the rotator drive motor 22 is controlled so that the output pulse number of the encoder 50 becomes the same as the reference pulse number which is preliminarily memorized in the memory part. The reference pulse number can be set by every syrup, by every sale beverage, or by every sale amount, and is set based on result which was obtained by experiments and the like.

Figure 40:
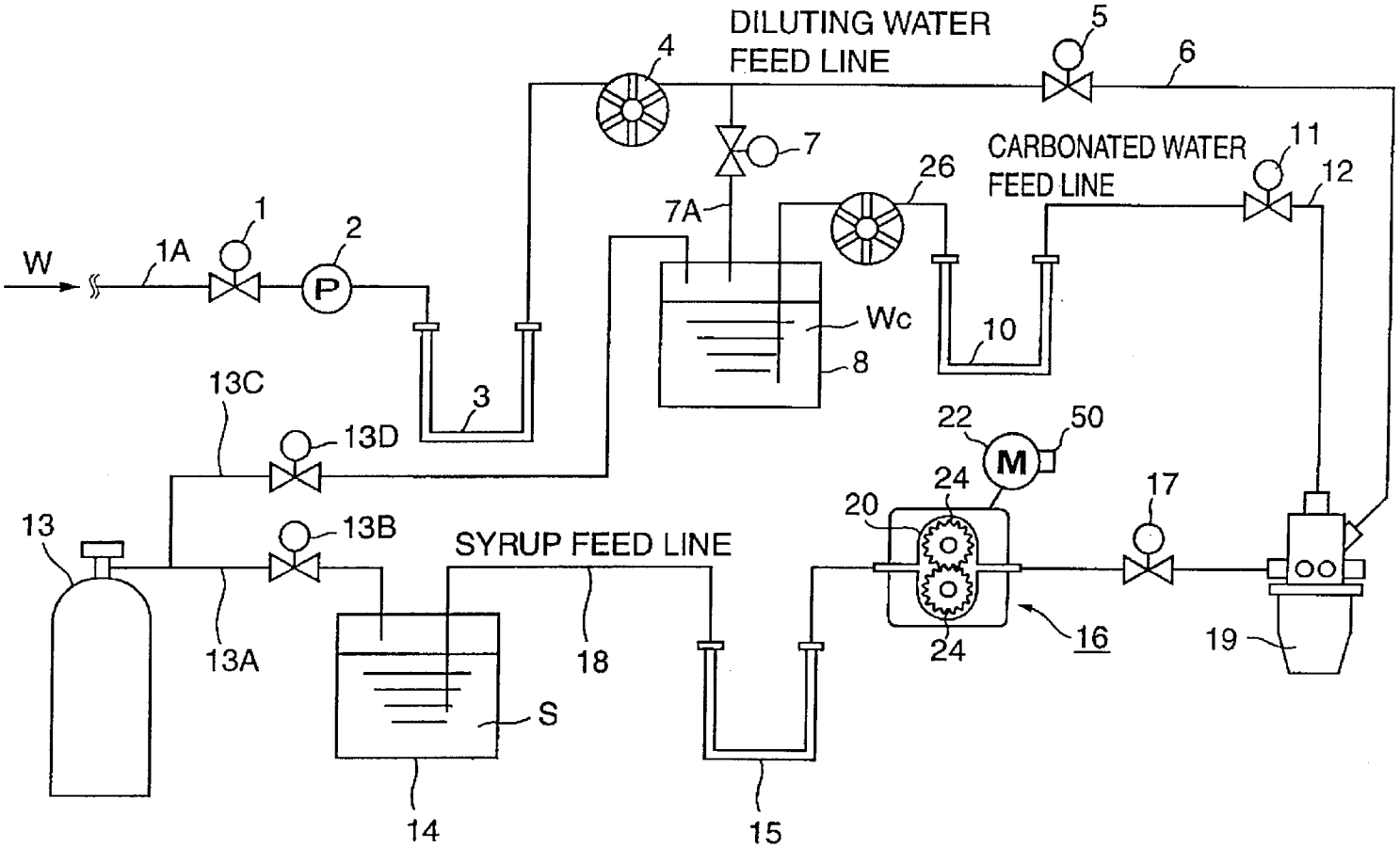
FIG. 40 is a schematic diagram showing the construction of a beverage dispenser related to the tenth preferred embodiment.

FIG. 40 schematically shows a beverage dispenser which comprises the delivery control system which is shown in FIG. 39, and it comprises the carbon dioxide bomb 13 storing high pressure carbon dioxide, the syrup tank 14 storing syrup, the carbon dioxide feed line 13A feeding carbon dioxide to the syrup tank 14, the carbon dioxide regulating valve 13B provided in the carbon dioxide feed line 13A, the cooling coil 15 cooling the syrup S by cooling water (not illustrated), the syrup feed line 18 delivering the syrup S, the constant volume flow regulator 16 delivering the syrup S at a constant volume level, the syrup electromagnetic valve 17 which opens and shuts the syrup feed line 18, the multi-valve 19 which mixes liquids such as the syrup S, diluting water, carbonated water and the like, the water catching tube 1A of the diluting water W, the water electromagnetic valve 1 which opens and shuts the water catching tube 1A, the water pump 2 which sending the diluting water W by pressure, the cooling coil 10 which cools the cooling water W by cooling water which is not illustrated, the diluting water feed line 6 which delivers the cooling water W, the water flow meter 4 which outputs pulses corresponding to the flow by measuring the flow of the cooling water W, the diluting water electromagnetic valve 5 which opens and shuts the diluting water feed line 6, the water branch line 7A which is provided by being branched from the diluting water feed line 6, the carbonater 8 which forms carbonated water Wc by mixing the diluting water W which is fed through the water branch line 7A and carbon dioxide which is fed through the carbon dioxide feed line 13C, the carbonated water feed line 12 which delivers the carbonated water Wc formed in the carbonater 8, the carbonated water flow meter 9 which measures the flow of the cooling water W and outputs pulses corresponding to the flow, and the diluting water electromagnetic valve 11 which opens and shuts the carbonated water feed line 12. The multi-valve 19 delivers a beverage which mixed the above-mentioned syrup S, the diluting water, the carbonated water and the like, to a cup which is not illustrated.

Figure 41:
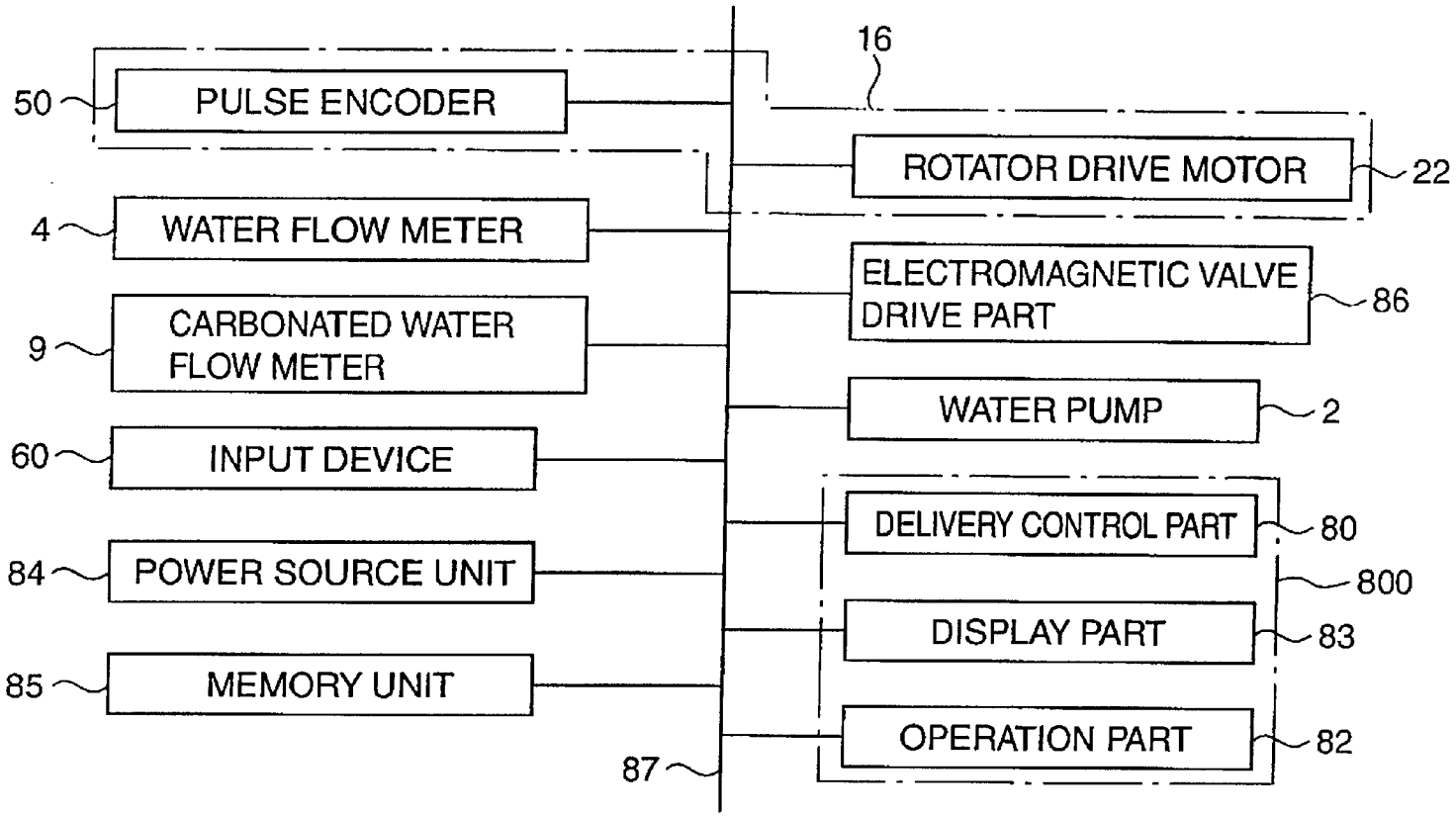
FIG. 41 is a control block diagram showing the beverage dispenser related to the tenth preferred embodiment.

FIG. 41 shows the control block of a beverage feed apparatus, and connects the power source unit 84 feeding electric power to the respective parts; the memory unit 85 which houses various data such as the reference pulse for comparison of the water flow meter 4 and the carbonated water flow meter 9 corresponding to the sale beverage, the reference pulse for comparison corresponding to the sale beverage of the encoder 50 based on that the syrup S is delivered in the constant volume flow regulator 16, the dilution ratio, the program of the delivery test, and the delivery test, and the like; and the electromagnetic valve drive part 86 which controls the drive of the respective electromagnetic valves; with the bus 87.

The memory parts 85 houses the threshold value for outputting an alarm when the output pulse of the encoder 50 is deviated against the above-mentioned reference pulse, and carries out the alarm indication on the display part 83 when other abnormality (abnormality in apparatus) of the apparatus side occurs. In the preferred embodiment, the threshold value B which judges the light degree fluctuation of flow and the threshold value A which judges the heavy degree fluctuation of flow are housed.

The liquid such as syrup or the like comprises different viscosities depending their kinds. Further, the viscosities happen to change in accordance with the change of temperature. In the constant volume flow regulator 16 having the rotator drive motor 22 as a drive source, the flow per a unit duty happens to occur when the rotational number of the rotator drive motor 22 is increased and decreased by the torque property of a motor and the viscosity of the liquid, and there is a fear of obstructing the liquid delivery control which requires precision. Since it is difficult to anticipate such fluctuation of flow, it is necessary to preliminarily grasp the flow corresponding to the viscosity of the liquid which is delivered through the constant volume flow regulator 16 when the liquid delivery control is carried out. Thus, in the preferred embodiment, the delivery test for identifying the presence and absence of the fluctuation of flow per a unit duty before starting the operation of a beverage dispenser.

Figure 42:
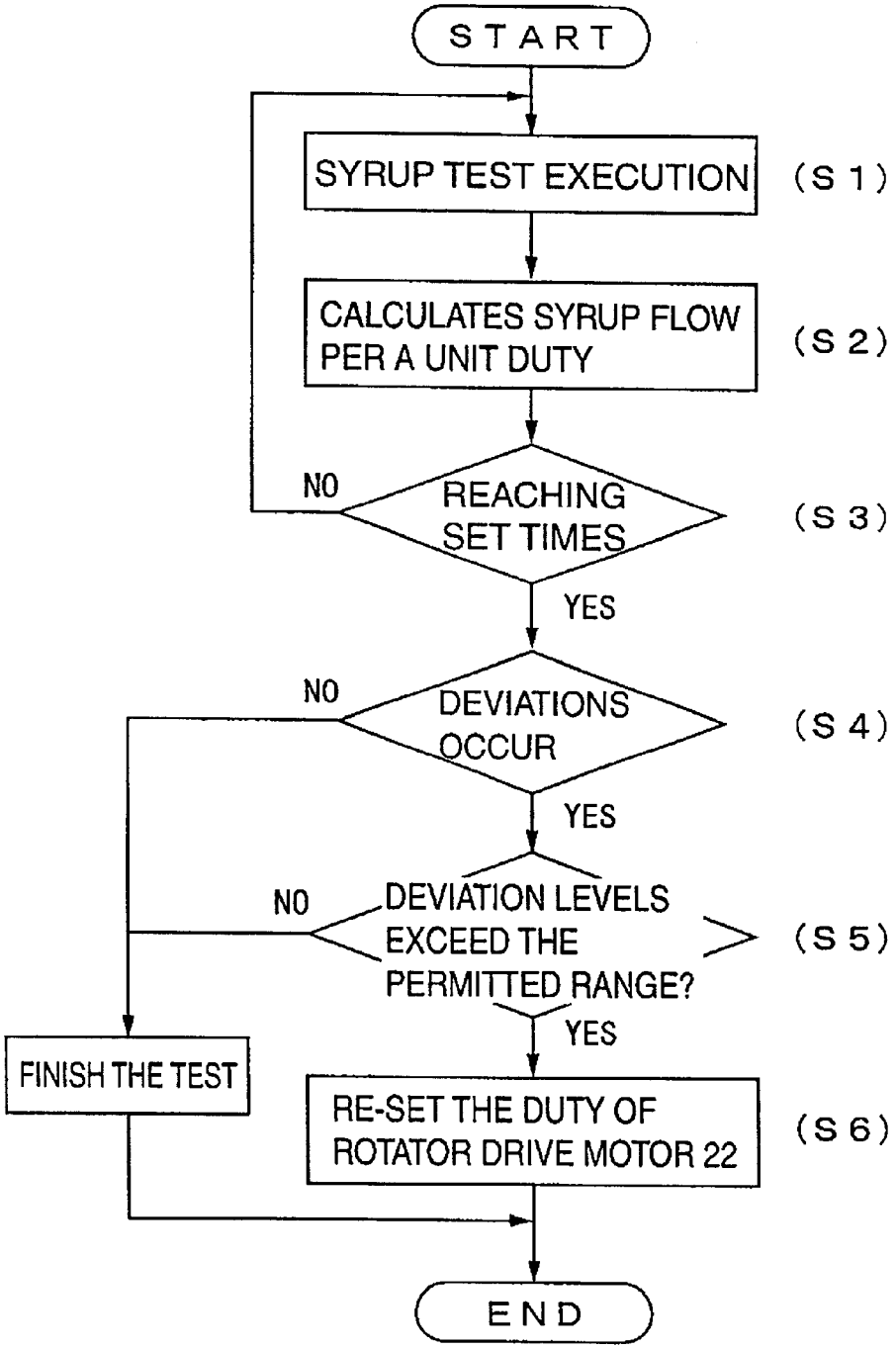
FIG. 42 is a flow chart of syrup delivery test before a beverage sale motion by the beverage dispenser related to the tenth preferred embodiment.

FIG. 42 shows a flow chart of the delivery test of the syrup S, and an operator who carries out the test inputs the execution order of the delivery test of the syrup S by operating the input device 60 (S1). When the delivery control part 80 inputs the execution order of the delivery test, it opens the syrup electromagnetic valve 17 by operating the electromagnetic valve drive part 86, reads in the duty value for the delivery test from the memory unit 85, drives the rotator drive motor 22 of the constant volume flow regulator 16 for a time (for example, 5 sec.) such as a sale time or the like, and delivers the syrup S from the multi-valve 19. The encoder 50 outputs the output pulses corresponding the delivery level of the syrup S which is delivered based on the drive of the rotator drive motor 22, to the delivery control unit 80. The delivery control unit 80 counts the output pulses which are input from the encoder 50, and houses it in the memory unit 85. An operator receives the syrup S which was delivered, by a cup or the like, measures the amount, and inputs a calculated value by operating the input device 60. The delivery control unit 80 calculates the syrup flow per a unit duty, from the delivery time (5 sec.) of the syrup S, the calculated value of the syrup S which was input by the operator, and the output pulses of the encoder 50, and houses it in the memory unit 85 (S2). Then, the delivery control unit 85 drives the rotator drive motor 22 at the duty different from the previous delivery test by the same procedure and time as the above-mentioned delivery test, and executes the delivery test of the syrup S. Thus, the delivery test is repeatedly executed until the setting time (at least 2 or more) by changing the duty of the rotator drive motor 22. When the delivery test of the syrup S reaches the set times (S3), the syrup flow per a unit duty which is housed in the memory unit 85 is compared for the respective delivery tests. Whereat, when the deviations occur in the syrup flows of the respective delivery tests (S4) and the deviation levels exceed the permitted range (S5), the delivery control unit 80 carries out the setting of the duty as a primitive setting again. The delivery control unit 80 outputs the operation order of duty to the operation unit 82 (S6).

Further, when the syrup flow per a unit duty of the respective delivery tests is constant, or when the deviation of the syrup flow per a unit duty is within the permitted value, the delivery control unit 80 judges that the primitive setting is unnecessary and terminates the delivery test. The delivery control unit 80 carries out the current running control of the rotator drive motor 22 based on the reference pulse number which was housed in the memory unit 85, in the syrup delivery motion in a sale motion which is described later. Further, when the delivery control unit 80 carries out the current running control of the rotator drive motor 22 based on the fluctuation of flow of diluting water and carbonated water and the fluctuation of flow of the syrup S, it carries out the duty again corresponding to the increase and decrease of the syrup S.

Figure 43:
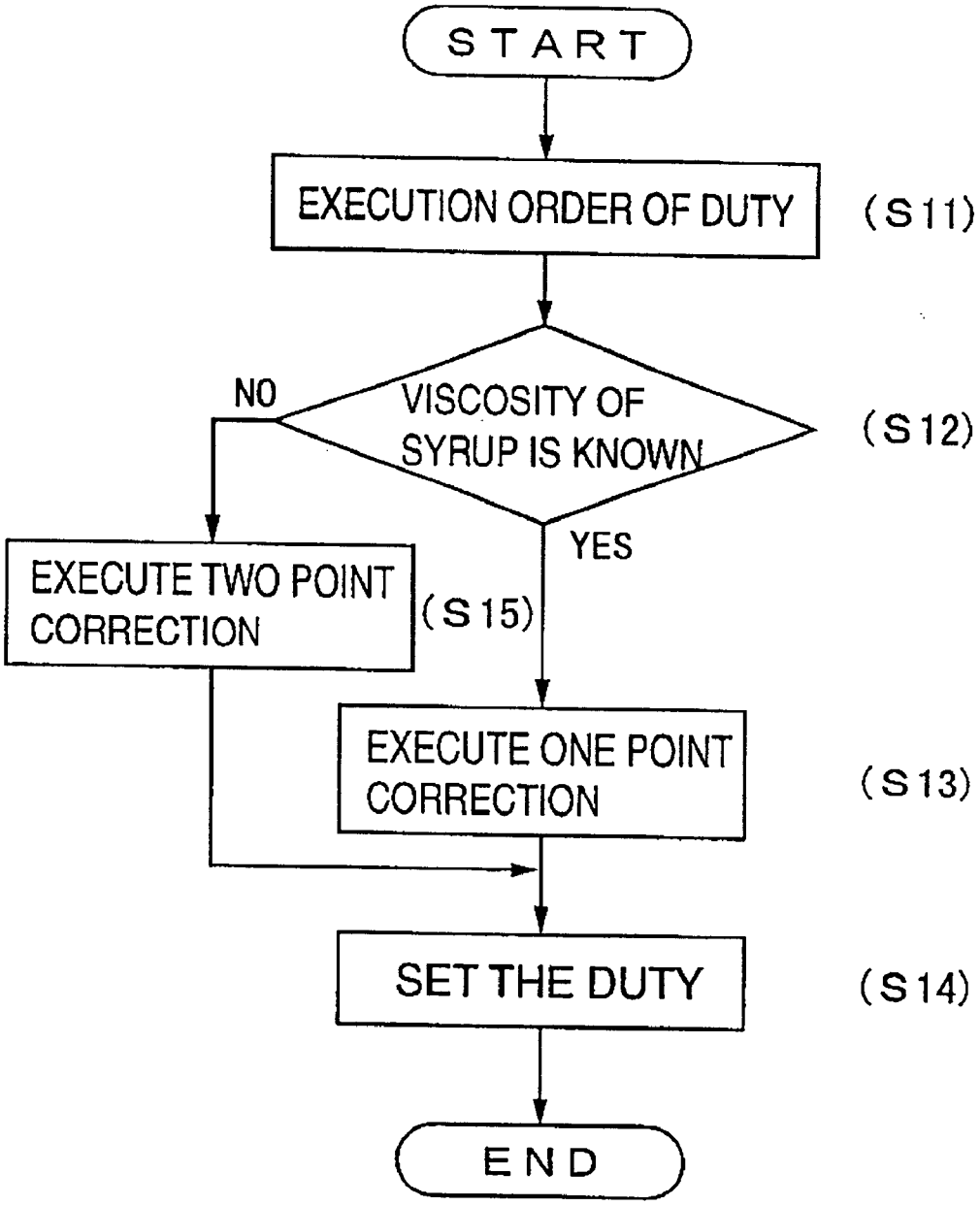
FIG. 43 is a flow chart when the duty of a rotator drive motor by the beverage dispenser related to the tenth preferred embodiment.

FIG. 43 shows a flow chart when the duty of the rotator drive motor 22 is set again as the primitive setting, and the operation unit 82 carries out the operation based on the execution order of the duty which is input from the delivery control unit 80 (S11). The delivery control unit 80 carries out the judgment whether the viscosity of the syrup S which should be delivered is known or not by the characteristic data such as a characteristic curve and the like (S12). For example, when the characteristic data concerning the syrup S is housed in the memory unit 85 and the viscosity is known thereby, the one point correction of the duty is carried out by a proportional calculation using the characteristic data (S13), and the operation order is output in the operation unit 82 so as to set the data of a desired syrup flow (S14). Further, when there is no information of the above-described characteristic data and the like concerning the syrup S which should be delivered and when the viscosity is not known, the delivery control unit 80 carries out the two points correction of the duty based on the result of the delivery test (S15), and outputs the operation order in the operation unit 82 so as to set the data of a desired syrup flow (S14).

Figure 44:
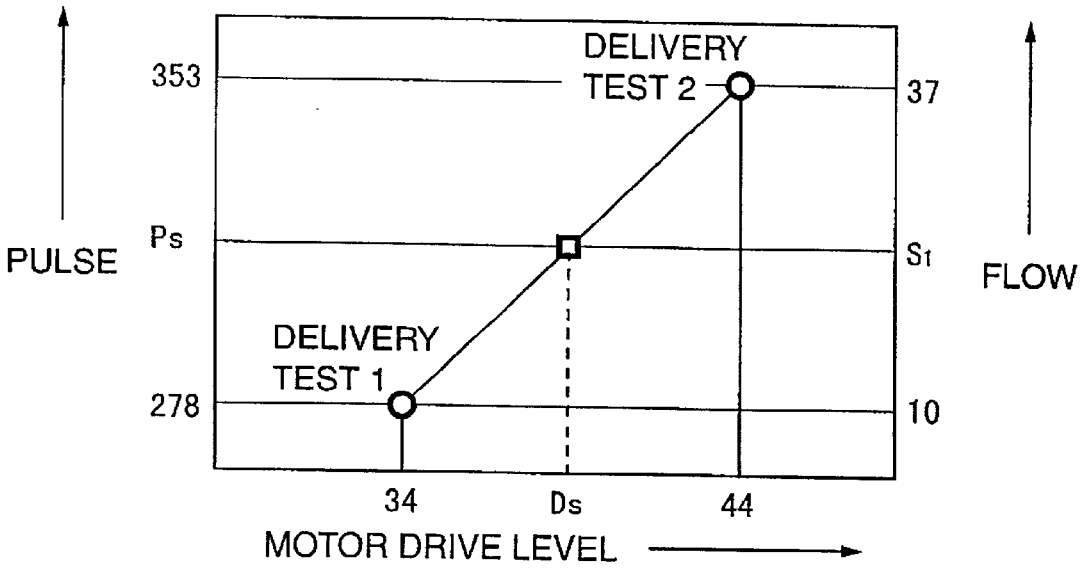
FIG. 44 is a characteristic diagram of a syrup obtained by carrying out the syrup delivery test by the beverage dispenser related to the tenth preferred embodiment.

FIG. 44 shows the result of the delivery test, and the duty Ds of the rotator drive motor 22 in the desired flow $S_1$ is determined based on the result of 2 times of the delivery tests 1 and 2 which were carried out at the same delivery time for the syrup S which should be delivered. Wherein the output pulse Ps at the flow $S_1$ is determined from the result of the delivery tests 1 and 2 for the desired f low $S_1$ of the syrup $S_1$ the duty Ds of the rotator drive motor 22 in the flow $S_1$ is determined from the relation of the output pulse Ps with the motor drive level.

According to the above-mentioned primitive setting motion, the delivery tests the syrup S are carried out several times under the different duties of the rotator drive motor 22 and the duty corresponding to the required syrup flow is set based on the output pulse and the delivery level which were obtained as a result, therefore the duty of the rotator drive motor 22 can be also set so as to continuously deliver the desired flow even though the constant volume flow regulator 16 comprises dispersion in the syrup flow per a unit duty. The duty which is set based on the primitive setting includes the fluctuation of flow which occurs in the constant volume flow regulator 16 caused by the viscosity of the syrup S which is delivered, and is a duty for continuously delivering the syrup S of the desired flow at a determined time such as a sale time or the like. Thereby, the dilution ratio of a sale beverage can be kept constant by the sale motion described later when the fluctuation of flow of carbonated water and diluting water occurs and the requirement for changing the flow of the syrup S occurs.

Figure 45:
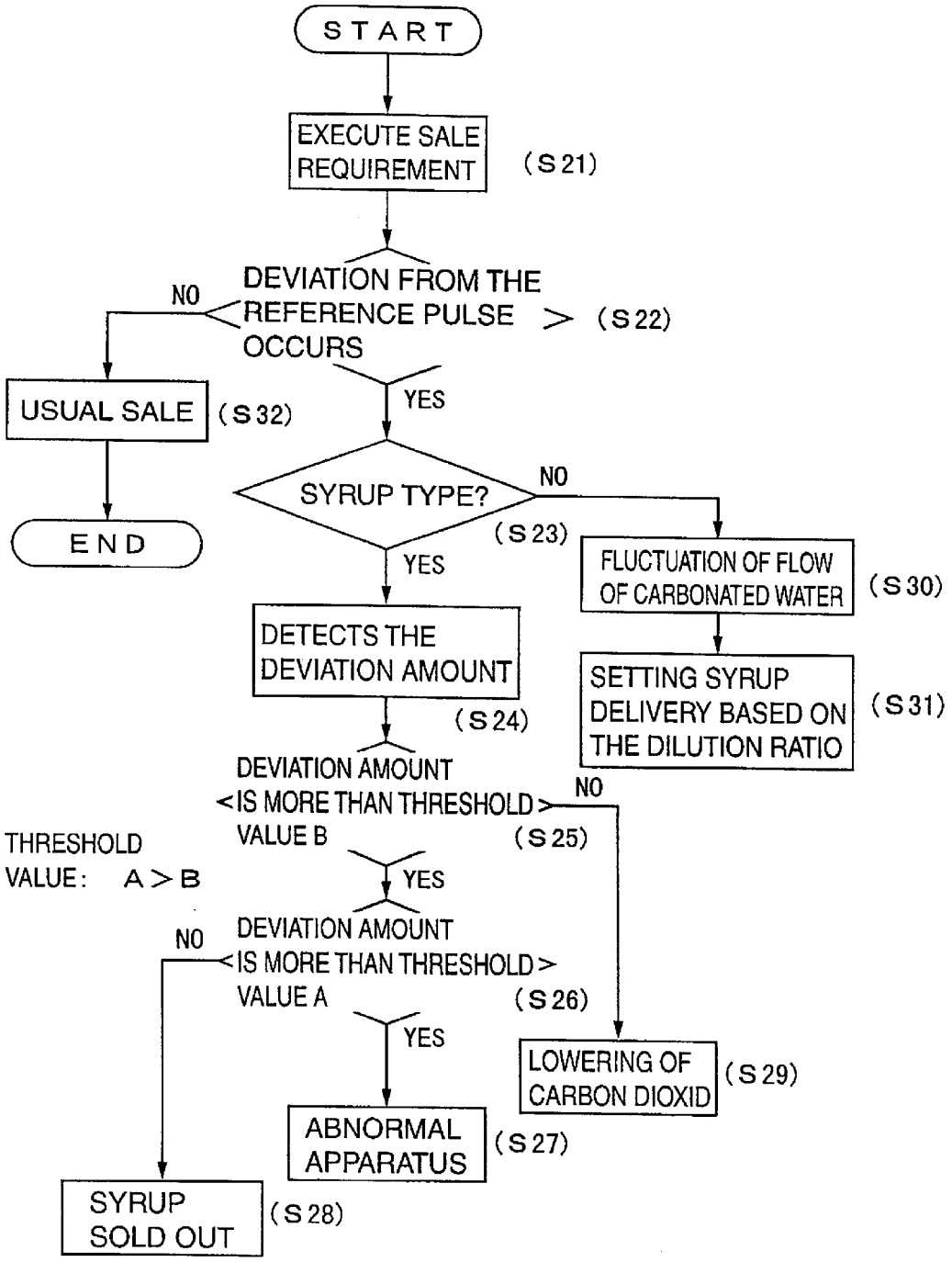
FIG. 45 is a flow chart showing a treatment procedure when the fluctuation of flow occurred during a beverage sale motion by the beverage dispenser related to the tenth preferred embodiment and FIG. 46 is a schematic diagram showing the construction of a flow meter related to the eleventh preferred embodiment of the invention.

FIG. 45 shows a flow chart for a treatment when the fluctuation of flow occurred during the execution of a sale motion, and the delivery control unit 80 carries out the sale motion of a sale beverage based on a sale requirement (S21). The output pulse based on the delivery motion of carbonated water, diluting water or the syrup S is deviated from the reference pulse (S22), and when there is a deviation amount of the syrup (S23), the delivery control unit 80 detects the deviation amount (S24). The delivery control unit 80 compares the deviation amount between the syrup and the threshold value B which is housed in the memory unit 85 (S25), and further carries out the comparison with the threshold value A when the deviation amount of the syrup exceeds the range (S26). The delivery control unit 80 judges that any abnormality occurs when the deviation amount of the syrup exceeds the threshold value A, and outputs the display of abnormal apparatus on the display unit 83 (S27). The delivery control unit 80 judges that the syrup S is sold out when the deviation amount of the syrup does not exceed the threshold value A, and outputs the display of the sell out of syrup on the display unit 83 (S28). The delivery control unit 80 judges that the carbon dioxide pressure which pressurizes the syrup S is lowered when the deviation amount of the syrup does not exceed the threshold value B, and outputs the display of the lowering of carbon dioxide on the display part 83 (S29). Further, when the fluctuation of flow of carbonated water, diluting water or the syrup S occurs (S30), the duty of the rotator drive motor 22 is carried out again so as to obtain the dilution ratio with the syrup S. Wherein when the flow per a unit duty is fluctuated by the duty of the rotator drive motor 22 during controlling the delivery of the syrup in the constant volume flow regulator 16, the duty of the rotator drive motor 22 is set so that the desired flow is continuously delivered from the start of the delivery at the later sale motion, based on the result of the syrup delivery test at the above-described primitive setting (S31). Further, the usual sale motion is continued to be carried out unless there is the fluctuation of flow of the respective liquids (S32).

As mentioned above, when the deviation between the pulse corresponding to the rotational number of the rotor which is output from the encoder 50 of the constant volume flow regulator 16 by the fluctuation of flow of the water system, and the pulse corresponding to the flow which is output from the water flow meter 4 and the carbonated water flow meter 9, occurs, the dilution syrup ratio can be made constant by changing the duty of the rotator drive motor 22 corresponding to the fluctuation of flow of water system. Further, when the fluctuation of flow of the S occurs, the cause of the fluctuation of flow can be identified based on the pulse which is output from the encoder 50.

The present invention can be applied to other beverage feed apparatus other than the above-mentioned beverage dispenser, but for example, it is considered that sale beverages having different sale amount based on the cup size and the like are sold in a cup-based automatic vendor. Further, it is also considered in a beverage dispenser that the delivery control corresponding to a cup size, the size of a sale container other than the cup is carried out. In such a case, the requirement for changing the flow of the above-mentioned diluting water, carbonated water and the syrup S occurs. For example, when the duty of the rotator drive motor 22 in the syrup delivery motion of a cup size of S is set again at the above-described primitive setting, the error of flow happens to occur according to the difference of syrup delivery level when the duty of the rotator drive motor 22 is set again based on the sale amount of a cup size of M. Accordingly, the duty correction level at the sale of M size and L size is preliminarily calculated, and the correction of the duty is carried out in accordance with the sale amount. The delivery control unit 80 calculates the correction of the duty in accordance with the sale amount at the above-described primitive setting, houses it in the memory unit 85, reads out the duty correction level based on the selected sale amount from the memory unit 85 at the later sale motion, and carries out the correction of the duty.

Thus, by carrying out the correction of the duty, the syrup delivery motion can be precisely carried out from the start of the delivery even though the reference values of diluting water and carbonated water vary based on the sale amount of sale beverage of other beverage feed apparatus, and the stable sale beverage having a constant dilution ratio and a constant concentration can be sold.

In the above-mentioned preferred embodiment, a construction in which the liquid delivery control is carried out by controlling to drive the rotator drive motor 22 which is provided in the constant volume flow regulator 16, but other construction may be well if it is possible to continuously deliver a constant volume.

Figure 46:
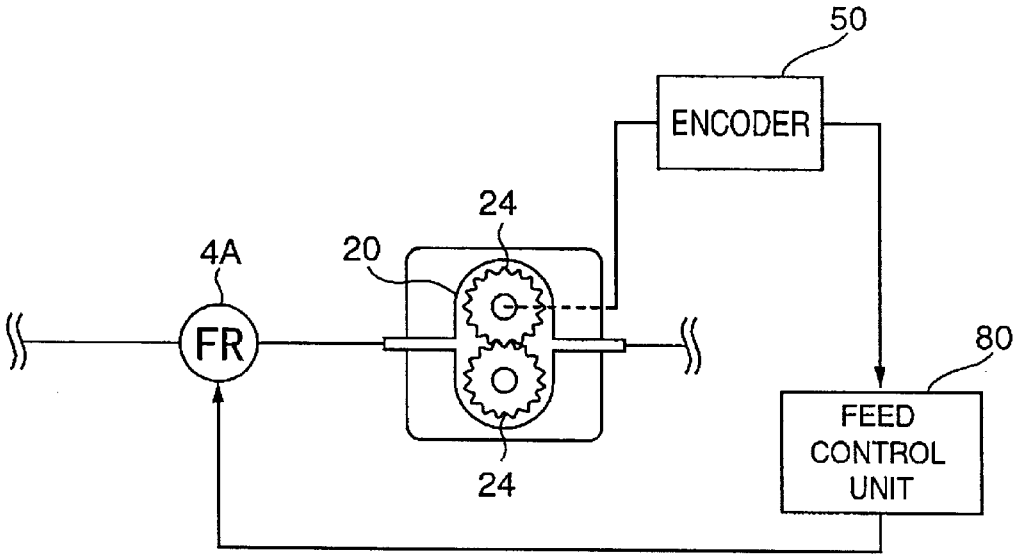

FIG. 46 shows the construction of other flow delivery apparatus which continuously delivers a constant volume of a liquid, and comprises the flow meter 16A which rotatably stores a set of the circular gears 24 in the internal part of the body 20 and is provided in the syrup feed line 18; the encoder 50 which generates output pulses corresponding to the rotational speed of a set of the circular gears 24; the flow regulator 4A which is provided in the syrup feed line 18 of the upstream side of the flow meter 16A; and the delivery control unit 80 which electrically or mechanically opens and shuts the flow regulator 4A in accordance with the flow control level. The flow regulator 4A carries out the degree of opening of the flow regulator 4A so that the desired flow of syrup which should be delivered is continuously delivered. In the liquid delivery control, the delivery control unit 80 is equipped with the output pulse value corresponding to the desired flow, and the memory (not illustrated) which houses data such as the converted value by which the flow of one pulse per a unit time is converted, and carries out the degree of opening of the flow regulator 4A by comparing these data with the output pulse which is input from the encoder 50.

Thus, since the degree of opening of the flow regulator 4A is carried out, a constant volume of the desired flow of syrup can be continuously delivered to the syrup feed line 18. Further, the flow regulator 4A may be provided in the syrup feed line 18 of the downstream side of the flow meter 16A, or may be provided in the upstream side and the downstream side of the flow meter 16A, respectively. Further, the continuous property at the liquid delivery can be enhanced by delivering the syrup by pressurizing.

Further, a tube pump using BIB which is used for a beverage feed apparatus has been known as those capable of delivering a constant volume, but the tube pump can continuously deliver a constant volume by fluidizing a liquid in the tube by sandwiching a tube which delivers syrup between a guide and a roller and elastically deforming it. However, since the changes such as the viscosity of syrup and the like which passes in the tube cannot be detected, the accuracy of delivery control can be secured by controlling a voltage to a motor which drives the roller when it is used under the condition of a constant temperature or under the condition thereof nearly.

Further, in the above-mentioned respectively preferred embodiment, even though there are many cases having various conditions such as the fluctuation of flow which will be generated based on the property of liquid and the structure of a delivery apparatus, the dilution ratio with other liquids which are simultaneously delivered, or the coincidence of the delivery time, the liquid delivery control which continuously delivers a constant volume was illustrated, but it can be also applied to the liquid delivery control which discontinuously delivers a constant volume. Further, under a situation in which a liquid having different property is fed in a liquid delivery apparatus during delivering a liquid having a property by the liquid delivery apparatus, an optimum delivery condition corresponding to the liquid having different property can be obtained by precisely setting the control level based on the property of liquid and the structure of a delivery equipment.

Further, in the above-mentioned liquid delivery apparatus, when the syrup which is a controlled objective is continuously and accurately delivered at a constant volume amount, the delivery motions of other liquids such as a diluting water, a carbonated water and the like which are delivered in connection with the delivery motion of the syrup are watched based on flows, and the delivery of the syrup is controlled in accordance with a fluctuation when the fluctuation occurs in the delivery motions of other liquids. The delivery motion of the syrup in accordance with detected amounts can be also carried out by detecting the delivery motions of other liquids by other detectors (for example, a flow speed meter, a pressure gauge, an electric liquid sensor) other than a flow meter which was illustrated in the beverage delivery apparatus. Further, concerning the delivery motion of the syrup, other delivery apparatus (for example, a tube pump, a vane-type pump) may be used when the constant volume amount of the syrup can be continuously delivered, in addition to the flow regulator which was illustrated in the beverage delivery apparatus.

As described above, since the construction comprises the rotators 24 which moves a constant volume of liquids having different properties such as density, viscosity and the like along the internal wall of the body from the inflow port 20*a* to the outflow port 20*b* by rotating in the body 20 which comprises the inflow port 20*a* and the outflow port 20*b;* and the constant volume flow regulator 16 which continuously delivers a constant volume of the liquid to the syrup feed line 18 based on the rotation of the rotators 24, a constant volume of a liquid can be continuously and precisely delivered even though the property of a liquid is changed by the change of external environment such as the change of a temperature or the like, when the liquids such as oils for food, for lubrication and the like, coatings, blood, or syrup which have large viscosity, further whose viscosities are easily changed by a temperature, and furthermore which have different viscosities according to their kinds, are delivered. Accordingly, it becomes possible to prevent the occurrences of great uselessness such as the occurrence of personnel expenses caused by working that the delivery level is regulated in accordance with the increase and decrease of the liquid delivery level when the property of a liquid is changed by the change of external environment such as the change of a temperature or the like; the loss of production and sale chance caused by stopping the liquid delivery apparatus during regulation, and the like.

Further, since the construction comprises the rotators 24 which move a constant volume of liquids having different properties such as density, viscosity and the like along the internal wall of the body from the inflow port 20*a* to the outflow port 20*b* by rotating in the body 20 which comprises the inflow port 20*a* and the outflow port 20*b;* the drive unit 22 which drives the rotators 24; and the constant volume flow regulator 16 which continuously delivers a constant volume of the liquid to the syrup feed line 18 based on the rotation of the rotators 24, a constant volume of liquids having various different viscosities can be continuously and precisely delivered at a desired flow.

Further, the rotator can use a set of rotators which are formed by the combination of a plural number of rotators.

The forms and combination thereof may be two circular gears which are engaged with each other, two polygonal which have at least three sides respectively and are engaged with each other, two oval gears which are engaged with each other, two cocoon-type rotators which are coaxially linked and whose gears are engaged with each other, or two clover-type rotators which rotate in link. Further, it may be a vane-type rotator in which a constant level of liquid which flows in a space which is sandwiched between the body and vanes which are stored in the body and adjoin is flown out from the outflow port based on the rotational drive. In the constant volume type flow regulator, these rotators may be those which can continuously move a constant volume of a liquid from an inflow port to the above-described outflow port while retaining the liquid in a space which is formed between the internal wall of the body and the side wall of the rotator. Accordingly, even if a liquid has large viscosity, a constant volume of a liquid can be continuously and surely delivered without damaging the delivery property.

Further, since the drive part flows out the pressurized liquid as the liquid which flows in from the inflow port 20*a* to the body 20 through the syrup feed line 18, from the outflow port 20*b* by every constant volume based on the rotational drive of the rotators 24, the fluidity in a tube passage which varies according to the viscosity of the liquid is secured, the load which is loaded to the drive part 22 (motor) is reduced and a stable liquid delivery control is realized.

Further, since the drive unit comprises the drive motor 22 which drives the rotators 24 and the control unit 80 for controlling the delivery of a pressured liquid so that the pressure of the inflow port 20*a* does not become the negative pressure, it is prevented that continuous property is deficient in the delivery passage of a liquid, and it becomes possible to precisely deliver a stable flow of the liquid.

Further, since the drive part comprises the drive motor 22 which drives the rotators 24 and the control unit 800 which sets the current running level of the drive motor 22 so as to continuously deliver the pressured liquid at a desired flow from the start of the delivery, the fluctuation of the liquid flow caused by the structure, the delivery property and the individual difference of the constant volume flow regulator 16 is corrected and an accurate flow can be delivered.

Further, since the liquid delivery line is equipped a liquid delivery line capable of delivering liquids such as syrup and the like and a plural number of other liquid delivery lines which deliver other liquids having different properties from the liquids such as syrup and the like and comprises a constant volume type flow controller in liquid delivery line for delivering liquids such as syrup and the like, a beverage in a stable mix condition having an appropriate dilution ratio and no light and shade in the step of producing a beverage which mixes a plural number of liquids becomes possible. Further, when the setting of the dilution ratio of diluting water and a liquid raw material is changed, the setting change of the dilution ratio can be also easily carried out.

Further, as the flow delivery apparatus, the flow meter 16A which comprises the rotators 24 in the body 20 and is provided in the syrup feed line 18, and the control level of the flow regulator 4A which controls the flow of a liquid which flows in the flow meter 16A through the syrup feed line 18 was designed to be controlled by the control unit 80, therefore a motor for rotationally driving the rotator becomes unnecessary, apparatus cost can be also cheap, and a constant volume of liquid corresponding to the desired flow can be delivered without carrying out a complicate control in comparison with the rotational control of a motor.

Further, a fluid delivery system for conveying a first fluid in response to the flow of a second fluid, comprising:

constant volume flow regulator for moving the first fluid therethrough at rate proportional to the flow rate of the second fluid and a control system responsive to the flow rate of said second fluid for controlling said constant volume fluid regulator to output said first fluid at a rate proportional to the flow rate of the second fluid. Thereby, the first liquid at a constant volume and the flow corresponding to the second liquid, and the delivery motion can be precisely synchronized.

Further, a fluid delivery system for conveying a first fluid in response to the flow of a second fluid, comprising:

a constant volume flow regulator for moving the first fluid therethrough at rate at least partially determined by the flow rate of the second fluid, and a control system comprising, a memory storing a flow rate of said second fluid and a value representing a ratio of a first fluid volume to a second fluid volume, and a feed control unit responsive to a stored flow rate of the second fluid and ratio value for controlling said constant volume fluid regulator to output said first fluid at a rate proportional to the flow rate of the second fluid and the ratio of the first fluid volume to the second fluid volume. Thereby, the first liquid at the same amount as the second liquid, and the delivery motion can be synchronized.

Further, A fluid delivery system for conveying a first fluid in response to the flow of a second fluid, comprising:

a constant volume flow regulator for moving the first fluid therethrough at rate at least partially determined by the flow rate of the second fluid, and a fluid flow meter measuring the flow rate of said second fluid, and a control system comprising, a feed control unit responsive to the measured value of the flow rate of the second fluid for controlling said constant volume fluid regulator to output said first fluid at a rate proportional to the measured flow rate of the second fluid. Thereby, the proper flow of the liquid corresponding to the fluidity caused by the viscosity of the liquid can be delivered at a constant volume.

Further, a fluid delivery system for conveying a first fluid in response to the flow of a second fluid, comprising:

a constant volume flow regulator for moving the first fluid therethrough at rate determined by the flow rate of the second fluid, including a set of rotators which are rotated within the body in respective directions opposite to each other to move the first fluid therethrough, a mixing means for mixing said first and second fluids, a first valve means in a fluid line between said fluid flow meter and said mixing means to selectively block flow of said second fluid to said mixing means, a second valve means in a fluid line between said constant volume flow regulator and said mixing means to selectively block flow of said first fluid to said mixing means, and a control system comprising, a feed control unit responsive to the flow rate of the second fluid, for controlling said constant volume fluid regulator to output said first fluid at a rate proportional to the flow rate of the second fluid and said ratio, said feed control unit including a timer. Thereby, the first liquid based on the flow rate corresponding to the flow rate of the second liquid and the above-described ratio is continuously delivered at a constant volume, and can be precisely mixed with the second liquid.

Further, a fluid delivery system for conveying a first fluid at a constant volume over a time interval, comprising:

a constant volume flow regulator for moving the first fluid therethrough at a constant rate independent of changes in a physical property of said first fluid, said constant volume flow regulator producing a signal proportional to the rate of fluid flow therethrough, a control system coupled to said constant volume flow regulator and responsive to the fluid flow rate signal for controlling the flow rate through the constant volume flow regulator to be a constant rate independent of variations in a physical property of said first fluid that tend to alter its flow rate. Thereby, a constant volume of the liquid can be continuously delivered at a constant volume by receiving a signal corresponding to the flow of the liquid from the constant volume type flow regulator and without the change of the property of the first liquid.

Further, a fluid delivery system for conveying a first fluid at a constant volume over a selected time interval, comprising:

a constant volume flow regulator for moving the first fluid therethrough at a constant rate independent of changes in a physical property of said first fluid, said constant volume flow regulator producing a signal proportional to the rate of fluid flow therethrough, a control system coupled to said constant volume flow regulator and responsive to the fluid flow rate signal for controlling the flow rate through the constant volume flow regulator to be a constant rate independent of variations in a physical property of said first fluid that tend to_alter its flow rate, a first conduit for carrying said first fluid, an inlet for said second fluid, a second conduit connected to said inlet for carrying said second fluid to a first location, a third conduit for carrying said second fluid to a second location, said third conduit branching off from said second conduit, a fluid flow meter connected between the inlet and the location where the third conduit branches from the second conduit. Thereby, when liquids which are mixed with the first liquid are plural, the flow rate of the first liquid can be precisely delivered based on the changes of the flow rate of those liquids.

Further, as the liquid delivery method, since a flow regulator is provided in the passage in which the liquid is passed and the liquid is passed through the flow regulator, it can be delivered at a reference volume level without losing the continuous property of the liquid by controlling the flow regulation level so that the reference volume level of the liquid is continuously delivered in the passage.

Further, as the liquid delivery method, a flow regulator is provided in the passage in which the liquid is passed, the flow regulation level of the flow regulator which changes in accordance with the change of properties such as density, viscosity and the like of the liquid is detected, therefore even if the fluctuation of properties such as viscosity and the like occurs, the liquid can be delivered without the occurrence of the fluctuation of flow by controlling the flow regulator so that the flow regulation level is reference volume level.

Further, as the liquid delivery method, a liquid is pressurized by a container which stores the liquid, the pressurized liquid is fed from the container to a flow regulator through a passage, the flow regulation level of the flow regulator which receives the pressurized liquid is detected, and the flow regulator is controlled so that the flow regulation level is the reference volume level, therefore the liquid can be moved to a delivery direction without accumulation or flowing backward. Further, it can be prevented that the detection precision of the flow regulation level is lowered.

Further, as the liquid delivery method, the flow regulation level of a flow regulator which changes in accordance with the change of properties such as density, viscosity and the like which are different by the kind of the liquid is detected, and the flow regulator is controlled so that the flow of the liquid of the reference volume level is generated from the flow regulator, therefore the fluctuation of flow of the liquid whose mixing ratio or dilution ratio with other liquids is set can be prevented, and the precision of the mixing ratio or dilution ratio with other liquids can be enhanced.

Further, since the liquid delivery method comprises a feed step of pressurizing a liquid which was stored in a container and feeding the liquid in a passage which was connected with the container, a detection step of detecting in the passage the property values of properties such as density, viscosity and the like which are different by the kind of the liquid, and a control step of controlling the flow rate of the liquid to a constant flow rate which is decided in accordance with the reference volume level of the liquid even if the property values change, the flow rate of the liquid which delivered can be made constant based on the reference volume level even if the properties of the liquid fluctuate by temperature change and the like, therefore a desired flow can be continuously delivered.

Further, as the liquid delivery method, since a pressure control valve was provided at the upstream or downstream of the flow regulator, it can be prevented that the liquid which leaked from the flow regulator is contained in the flow.

Further, as the liquid delivery method, a feed medium is delivered in a tube passage at a constant volume level while limiting the flow of the feed medium based on the load portion which exceeds a limit range when the condition of the load of a flow regulator based on feeding the feed medium such as a liquid, a gas or the like is larger than the control range of a flow regulator, therefore it is prevented that the flow regulator becomes uncontrollable, and a desired flow can be continuously delivered without relating to the kind of the liquid, viscosity and the like.

Further, as the liquid delivery method, the flow of a pressurized liquid is measured by driving a flow regulator and the drive level of the flow regulator is set so as to deliver the pressurized liquid at a desired flow from the start of delivery based on the flow, therefore the liquid which is mixed based on the dilution ratio with other liquids can be precisely delivered. Accordingly, the mixing of liquids can be carried out in a condition in which the dilution ratio with other liquids is kept from the start of the delivery. For example, a beverage having no light and shade can be produced in case of the beverage which is produced by mixing diluting water and syrup at a dilution ratio.

Further, a method of conveying a first fluid at a constant volume over a selected time interval, comprising:

providing a constant volume flow regulator, measuring the flow rate of said first fluid, comparing the measured flow rate with a reference flow rate, and modifying the flow rate of the first fluid through said constant volume flow regulator to maintain said reference flow rate, whereby the flow rate of the first fluid is maintained constant independent of changes in a physical property of said first fluid that tend to alter its flow rate. Thereby, even if the change of properties occurs in the flow rate of the first liquid, the liquid can be continuously delivered at a constant volume level based on a reference flow.

Further, in a fluid delivery system a method of determining a quantify of available fluid to be delivered comprising:

providing a constant volume flow regulator including a set of rotators which are rotated within the body in respective directions opposite to each other to move the fluid, measuring the flow rate of said fluid, comparing the measured flow rate with a reference flow rate, and modifying the speed of rotation of said rotators to modify the flow rate of the fluid through said constant volume flow regulator to maintain said reference flow rate, producing a signal from said constant volume flow regulator derived from the load on said rotators, providing a reference signal value corresponding to a load change an said rotators resulting from the absence of said fluid, and signaling when said produced signal corresponds with said reference signal to indicate that the fluid has been used up. Thereby, the deficiency of a liquid which should be delivered can be rapidly grasped, and it can be rapidly known that a continuous delivery motion is not carried out caused by the residual insufficiency of the liquid or the abnormality of an apparatus.

Further, a method of conveying a fluid at a constant volume over a selected time interval, comprising:

providing a constant volume flow regulator, measuring the flow rate of said first fluid, comparing the measured flow rate with a reference flow rate, and modifying the flow rate of the first fluid through said constant volume flow regulator to maintain said reference flow rate, whereby the flow rate of the first fluid is maintained constant independent of changes in a physical property of said first fluid that tend to alter its flow rate, wherein said step of measuring said flow rate includes measuring one of a voltage and current supplied to said constant volume flow regulator, said step of comparing includes the step of comparing the measured current or voltage to a reference current or voltage, and said step of modifying the flow rate includes modifying one of the voltage and current applied to the constant volume flow regulator. Thereby, the voltage and electric current which were supplied to a constant volume type flow regulator can be corrected based on a reference voltage and electric current, and a constant volume level of the liquid can be precisely delivered thereby.

What is claimed is:

1. A liquid delivery apparatus equipped with a liquid delivery line which can deliver liquids different from each other in a property such as density, viscosity, or the like, wherein a flow regulation means is provided in said liquid delivery line, said flow regulation means comprising: a body having an inflow port into which said liquid flows and an outflow port out of which said liquid flows; rotators rotatable within the body to move said from said inflow port to said outflow port by given volumes along the internal wall of said body and to continuously deliver said liquid from said outflow port to said liquid delivery line; and a drive unit for driving said rotators, wherein the drive unit comprises;

a drive motor for driving said rotators; and a control unit for controlling current to said drive motor so that said rotators rotate at a given speed, and wherein said control unit comprises;

a memory for housing a reference voltage by which said rotators are in a stable rotational condition;

a comparing unit for comparing a difference between a derive voltage which is supplied when driving said drive motor with said reference voltage; and a power source unit for controlling current to said drive motor based on said difference to cause said rotators to be in said stable rotational condition.

2. A liquid delivery apparatus equipped with a liquid delivery line which can deliver liquids different from each other in a property such as density, viscosity, or the like, wherein a flow regulation means is provided in said liquid delivery line, said flow regulation means comprising: a body having an inflow port into which said liquid flows and an outflow port out of which said liquid flows; rotators rotatable within the body to move said from said inflow port to said outflow port by given volumes along the internal wall of said body and to continuously deliver said liquid from said outflow port to said liquid delivery line and a drive unit for driving said rotators, wherein said drive unit comprises;

a drive motor for driving said rotators; and a control unit for controlling current to said drive motor so that said rotators rotate at a speed corresponding to the property of said liquid.

3. The liquid delivery apparatus according to claim 2, wherein said control unit sets the current to said drive motor corresponding to a flow at a temperature condition at which said liquid is actually delivered based on the flow which is obtained when delivering said liquid under a reference temperature condition.

4. The liquid delivery apparatus according to claim 2, wherein said controller unit changes a supply voltage to said drive motor in accordance with a property of said liquid.

5. The liquid delivery apparatus according to claim 2, wherein said control unit changes an interval by which a supply voltage to the drive motor is intermittently switched to ON and OFF in accordance with a property of said liquid.

6. A liquid delivery apparatus equipped with a liquid delivery line which can deliver liquids different from each other in a property such as density, viscosity, or the like, wherein a flow regulation means is provided in said liquid delivery line, said flow regulation means comprising: a body having an inflow port into which said liquid flows and an outflow port out of which said liquid flows; rotators rotatable within the body to move said from said inflow Port to said outflow port by given volumes alone the internal wall of said body and to continuously deliver said liquid from said outflow port to said liquid delivery line; and a drive unit for driving said rotators, wherein the drive unit comprises;

a drive motor for driving said rotators; and a control unit for controlling current to said drive motor so that said rotators rotate at a given speed, and wherein said control unit comprises a brake for braking said drive motor in accordance with a load exceeding the control range of said drive motor is bestowed to said rotators through said liquid.

7. The liquid delivery apparatus according to claim 6, wherein said brake generates a braking force based on a torque characteristic of said drive motor when a load exceeding the control range of said drive motor is bestowed to said rotators through said liquid.

8. The liquid delivery apparatus according to claim 6, wherein said brake comprises a discharge circuit which discharges electromotive force which is generated based on the difference between the drive quantity of said drive motor and the rotational quantity of said rotators.

9. The liquid delivery apparatus according to claim 6, wherein said control unit sets said brake to ON after a lapse of a given time from the drive start of said drive motor.

10. The liquid delivery apparatus according to claim 6, wherein said brake comprises a switching circuit by which said discharge circuit is switched to OFF when the current to direct current motor as said drive motor is set to ON, and said discharge circuit is switched to ON when the current to said direct current motor is set to OFF.

11. The liquid delivery apparatus according to claim 10, wherein said switching circuit switches said discharge circuit to ON and OFF based on the duty ratio of a pulse signal input from a pulse width modulation circuit (PWM).

12. A liquid delivery apparatus equipped with a liquid delivery line which can deliver liquids different from each other in a property such as density, viscosity, or the like, wherein a flow regulation means is provided in said liquid delivery line, said flow regulation means comprising: a body having an inflow port into which said liquid flows and an outflow port out of which said liquid flows; rotators rotatable within the body to move said from said inflow port to said outflow port by given volumes along the internal wall of said body and to continuously deliver said liquid from said outflow port to said liquid delivery line: and a drive unit for driving said rotators, wherein said drive unit flows a pressurized liquid at a given volume from said outflow port based on the rotational drive of said liquid rotators.

13. The liquid delivery apparatus according to claim wherein said liquid delivery line comprises a valve means for closing the delivery of said pressurized liquid.

14. The liquid delivery apparatus according to claim 13, wherein said valve means opens before said drive unit is driven, and closed after the driving of said drive unit is stopped.

15. The liquid delivery apparatus according to claim 12, wherein said liquid delivery line comprises:

a first liquid delivery line for delivering a liquid raw material which is mixed with diluting water as another liquid; and a second liquid delivery line for delivering said diluting water which is mixed said liquid raw material.

16. The liquid delivery apparatus according to claim 15, wherein said first liquid delivery line comprises said flow regulating means for delivering said liquid raw material.

17. The liquid delivery apparatus according to claim 12, wherein said drive unit comprises;

a drive motor for driving said rotators; and a control unit for controlling the delivery of said pressurized liquid so that the pressure of said inflow port does not become a negative pressure.

18. The liquid delivery apparatus according to claim 17, wherein said control unit comprises at least;

a pressure detector for outputting a pressure detection signal in accordance with the pressure of said pressurized liquid of said inflow port; and a pressurized level regulator for enlarging said pressurizing level of said pressurized liquid when the pressure detection signal indicating a negative pressure of said inflow port is input.

19. The liquid delivery apparatus according to claim 17, wherein said control unit comprises a memory for housing the measurement value of flow and a reference pressure detection signal in accordance with the viscosity of said pressurized liquid at a reference temperature; and carries out flow correction for the flow of said reference temperature by comparing a pressure detection signal at the delivery of said pressurized liquid with said reference pressure detection signal.

20. A fluid delivery system as claimed in claim 19 further including, a fluid flow meter measuring the flow rate of said second fluid, said feed control unit being responsive to the measured flow rate of said second fluid to control said constant volume flow regulator.

21. The liquid delivery apparatus according to claim 17, wherein said control unit comprises at least;

a pressure detector for outputting a pressure detection signal in accordance with the pressure of said pressurized liquid of said inflow port;

a memory for housing a pressure detection signal which indicates the negative pressure of said inflow port; and a pressurizing level regulator for enlarging said pressurizing level of said pressurized liquid based on said pressure detection signal when a later liquid delivery motion is executed.

22. The liquid delivery apparatus according to claim 21, wherein said pressurizing level regulator comprises; a carbon dioxide feeder for feeding carbon dioxide to a liquid storage part; and a carbon dioxide regulator for regulating the feed level of carbon dioxide to said liquid storage part so as to be at a desired pressurizing level based on said pressure detection signal.

23. The liquid delivery apparatus according to claim 21, wherein said pressurizing level regulator comprises a motor controller for controlling the drive of said drive motor which rotationally drives said rotators based on said pressure detection signal.

24. The liquid delivery apparatus according to claim 12, wherein said drive unit comprises;

a motor for driving said rotators; and a control unit for setting the current through said drive motor so as to continuously deliver said pressurized liquid at a desired flow from the start of delivery.

25. The liquid delivery apparatus according to claim 24, wherein said control unit comprises;

a flow meter for outputting a flow signal corresponding to a flow of another liquid which is mixed with said pressurized liquid;

a pulse encoder for generating a output pulse based on the delivery of said pressurized liquid provided by the drive motor which rotationally drives said rotators;

an input unit for inputting the delivery level of said pressurized liquid which was delivered by driving said rotators for a time;

an operation unit for operating the flow of said pressurized liquid at a unit time based on said delivery level and said output pulse; and a setting unit for setting the drive level of said drive motor based on the flow of said pressurized liquid and said flow signal.

26. The liquid delivery apparatus according to claim 25, wherein said setting unit sets said drive level of said drive motor based on the viscosity of said pressurized liquid obtained by driving said drive motor at a plural number of drive levels, or by the flow of said pressurized liquid over a unit time and known viscosity for said pressurized liquid.

27. The liquid delivery apparatus according to claim 25, wherein said setting unit sets said drive level of said drive motor based on the dilution ratio of said another liquid and said pressurized liquid.

28. The liquid delivery apparatus according to claim 25, wherein said setting unit sets said drive level of said drive motor so that the dilution ratio with said another liquid from the start of delivery is maintained in a later delivery motion when the flow of said another liquid fluctuates.

29. The liquid delivery apparatus according to claim 25, wherein said setting unit sets said drive level of said drive motor so that the dilution ratio with another liquid from the start of delivery is maintained in a later delivery motion when the flow of said pressurized liquid fluctuates.

30. The liquid delivery apparatus according to claim 25, wherein said setting unit comprises an alarm display unit for outputting a delivery abnormal information when the flow fluctuation level of said pressurized liquid fluctuates and said another liquid exceeded a threshold value which is set in accordance with a degree of the fluctuation level.

31. The liquid delivery apparatus according to claim 25, wherein said setting unit corrects said drive levels of said drive motor based on the dilution ratio with said another liquid and a flow signal in accordance with a delivery motion of another liquid delivered at a unit time.

32. The liquid delivery apparatus according to claim 25, wherein said setting unit corrects said drive levels of said drive motor based on a correction value in accordance with the delivery level of said pressurized liquid.

33. The liquid delivery apparatus according to claim 25, wherein said control unit detects the liquid level insufficiency in said body based on a change of electric current which runs in said drive motor.

* * * * *